US006586170B1

(12) United States Patent
Yamada et al.

(10) Patent No.: US 6,586,170 B1
(45) **Date of Patent: *Jul. 1, 2003**

(54) THERMOGRAPHIC RECORDING ELEMENT

(75) Inventors: Kohzaburoh Yamada, Kanagawa (JP); Toshiaki Kubo, Kanagawa (JP); Hiroyuki Suzuki, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,021

(22) Filed: Apr. 28, 1998

(30) Foreign Application Priority Data

Aug. 11, 1997 (JP) ..... 9-228881
Sep. 19, 1997 (JP) ..... 9-273935

(51) Int. Cl.[7] ..... G03C 1/498
(52) U.S. Cl. ..... 430/617; 430/264; 430/598; 430/619; 503/216
(58) Field of Search ..... 430/617, 619, 430/264, 598, 613, 614, 615, 600; 503/216

(56) References Cited

U.S. PATENT DOCUMENTS 5,545,515 A * 8/1996 Murray et al. ..... 430/617
5,635,339 A 6/1997 Murray
6,277,553 B1 * 8/2001 Taniguchi et al. ..... 430/617
6,277,554 B1 * 8/2001 Yamada et al. ..... 430/619

FOREIGN PATENT DOCUMENTS

EP 0600586 A1 6/1994
WO WO 9711409 A 3/1991
WO WO 9804958 A 2/1998

OTHER PUBLICATIONS

C. Hansch and A.J. Leo, in "Substituent Constants for Correlation Analysis in Chemistry and Biology", Wiley, New York, 1979.*

* cited by examiner

*Primary Examiner*—Thorl Chea
(74) *Attorney, Agent, or Firm*—Birch, Stewart, Kolasch & Birch, LLP

(57) ABSTRACT

A thermographic recording element having at least one image forming layer contains an organic silver salt, a reducing agent, and optionally, a photosensitive silver halide. The element further contains a substituted alkene derivative of specific structure and preferably a specific hydrazine derivative. The element can be processed in a fully dry basis to produce images having high Dmax and gradation and free of black pepper.

8 Claims, No Drawings

THERMOGRAPHIC RECORDING ELEMENT

BACKGROUND OF THE INVENTION

1. Field of the Invention

This invention relates to a thermographic recording element and more particularly, to a photothermographic recording element suited for the manufacture of graphic printing plates.

2. Prior Art

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tone of silver, and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Such photothermographic materials have been used as microphotographic and radiographic photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices. The demand for simple dry processing is also increasing.

U.S. Pat. No. 3,667,958 discloses that a photothermographic element comprising a polyhydroxybenzene combined with a hydroxylamine, reductone or hydrazine has high image quality discrimination and resolution. This combination of reducing agents, however, was found to incur an increase of fog.

U.S. Pat. No. 5,496,695 discloses a heat-developable photothermographic element comprising an organic silver salt, a silver halide, a hindered phenol, and a certain hydrazine derivative. These hydrazine derivatives were found still insufficient to accomplish a maximum ultimate density or ultrahigh contrast.

U.S. Pat. No. 5,545,515 discloses the use of acrylonitriles as the co-developer. The hydrazine compounds used therein fail to achieve a fully satisfactory high contrast while the occurrence of black peppers was ascertained.

SUMMARY OF THE INVENTION

An object of the present invention is to provide a thermographic recording element having a high sensitivity and high Dmax and free of black peppers. Another object of the present invention is to provide a printing plate-forming photosensitive element which can be processed in a fully dry basis without a need for wet processing and produce images of quality.

According to the invention, there is provided a thermographic recording element having at least one image forming layer. The element contains an organic silver salt, a reducing agent, and at least one of substituted alkene derivatives of the general formulae (1) through (14).

formula (1)

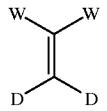

formula (2)

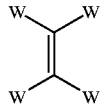

formula (3)

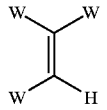

formula (4)

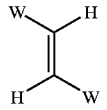

formula (5)

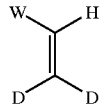

formula (6)

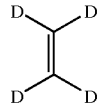

formula (7)

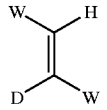

formula (8)

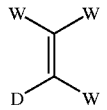

formula (9)

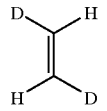

formula (10)

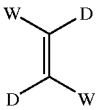

formula (11)

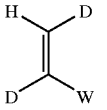

-continued formula (12)

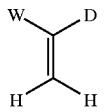

formula (13)

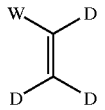

formula (14)

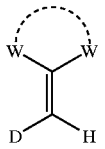

In formulae (1) through (14), W is an electron attractive group, D is an electron donative group, and H is hydrogen. The groups represented by W or D attached to the same carbon atom, taken together, may form a cyclic structure. The compound may assume either a trans or a cis structure when both trans and cis structures are possible with respect to W or D. Two W groups in formula (14) form a cyclic structure.

In one preferred embodiment, the thermographic recording element further contains a hydrazine derivative of the general formula (I).

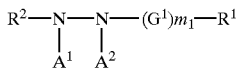

In formula (I), $R^2$ is an aliphatic, aromatic or heterocyclic group, $R^1$ is hydrogen or a block group, $G^1$ is —CO—, —COCO—, —C(=S)—, —$SO_2$—, —SO—, —PO($R^3$)— or iminomethylene group, $R^3$ is selected from the same range as defined for $R^1$ and may be different from $R^1$, $A^1$ and $A^2$ are independently hydrogen, alkylsulfonyl, arylsulfonyl or acyl groups, at least one of $A^1$ and $A^2$ is hydrogen, and letter m1 is equal to 0 or 1, with the proviso that $R^1$ is an aliphatic, aromatic or heterocyclic group when m1 is 0.

In one preferred embodiment, the thermographic recording element further contains a photosensitive silver halide so that the element may be photosensitive. That is, a photo-thermographic (or photosensitive, heat-developable) recording element is provided.

DETAILED DESCRIPTION OF THE INVENTION

The thermographic (or heat-developable) recording element of the invention has at least one image forming layer and contains an organic silver salt and a reducing agent. Preferably it further contains a photosensitive silver halide whereby the invention constitutes a photo-thermographic (or photosensitive, heat-developable) recording element. According to the feature of the Invention, the element further contains substituted alkene derivatives of the general formulae (1) through (14). The inclusion of such substituted alkene derivatives not only provides the thermographic recording element with a high Dmax, high sensitivity, and fully high contrast, but is also effective for suppressing the occurrence of black peppers.

These advantages are enhanced by further adding a hydrazine derivative of the general formula (I).

Substituted Alkene Derivative

First, the substituted alkene derivatives of the general formulae (1) through (14) are described in detail.

In formulae (1) through (14), W is an electron attractive group, D is an electron donative group, and H is a hydrogen atom. The groups represented by W or D attached to the same carbon atom, taken together, may form a cyclic structure. When both trans and cis structures are possible with respect to W or D, the compound may assume either a trans or a cis structure. Two W groups in formula (14) form a cyclic structure.

In formulae (1) through (14), the electron attractive groups represented by W include halogen atoms, cyano groups, nitro groups, alkenyl groups, alkynyl groups, acyl groups, alkoxycarbonyl groups, aryloxycarbonyl groups, alkylsulfonyl groups, arylsulfonyl groups, carbamoyl groups, carbonamide groups, sulfamoyl groups, sulfonamide groups, trifluoromethyl groups, trichloromethyl groups, phosphoryl groups, carboxy groups (or salts thereof), sulfo groups (or salts thereof), heterocyclic groups, imino groups, and phenyl groups having such electron attractive groups as a substituent. These groups may have substituents, examples of which include halogen atoms (e.g., fluorine, chlorine, bromine and iodine atoms), alkyl groups (including aralkyl, cycloalkyl and active methine groups), alkenyl groups, alkynyl groups, aryl groups, heterocyclic groups, quaternized nitrogen atom-containing heterocyclic groups (such as pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (including groups containing recurring ethyleneoxy or propyleneoxy units), aryloxy groups, heterocyclic oxy groups, acyloxy groups, (alkoxy or aryloxy) carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy) carbonylamino groups, sulfamoylamino groups, semicarbazide groups, thiosemicarbazide groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, (alkyl or aryl) sulfonyl groups, (alkyl or aryl) sulfinyl groups, sulfo groups or salts thereof, sulfamoyl groups, acylsulfamoyl groups, sulfonylsulfamoyl groups or salts thereof, and phosphoramide or phosphate structure-bearing groups. These substituents may be further replaced by other substituents selected from the foregoing examples.

The preferred electron attractive groups are those having 0 to 16 carbon atoms in total, especially 0 to 12 carbon atoms in total, for example, cyano, nitro, alkenyl, acyl, alkoxycarbonyl, aryloxycarbonyl, alkylsulfonyl, arylsulfonyl, carbamoyl, sulfamoyl, trifluoromethyl, phosphoryl groups, heterocyclic groups (5- and 6-membered heterocyclic groups which may have a benzene or naphthalene ring fused thereto), and phenyl groups having any electron attractive group as a substituent. It is noted that the heterocyclic groups in formulae (3) and (7) are non-aromatic heterocyclic groups.

In formulae (1) through (14), the electron donative groups represented by D include hydroxy groups (or salts thereof), mercapto groups (or salts thereof), alkoxy groups, aryloxy groups, heterocyclic oxy groups, alkylthio groups, arylthio groups, heterocyclic thio groups, amino groups, alkylamino groups, arylamino groups, heterocyclic amino groups, and phenyl groups having such electron donative groups as a substituent. These groups may have substituents, examples of which are the same as described for W.

The preferred electron donative groups are hydroxy groups (or salts thereof), mercapto groups (or salts thereof), alkoxy groups, alkylthio groups, arylthio groups, amino groups, alkylamino groups, arylamino groups, and phenyl groups having any electron donative group as a substituent.

Examples of the ring formed by W and D include saturated or unsaturated, carbocyclic or heterocyclic rings which may have a 4- to 6-membered ring fused thereto. Also the ring may be a cyclic ketone. The heterocyclic ring preferably contains at least one atom of nitrogen, oxygen and sulfur, more preferably one or two such hetero atoms.

Preferred among the compounds of formulae (1) through (14) are those of formulae (1), (2), (3), (5), (7), (8), (10), (11), (12), (13), and (14). More preferred are the compounds of formulae (1), (2), (3), (5), (7), (8), (10), (11), (12), and (14).

Illustrative, non-limiting, examples of the compounds of formulae (1) through (14) are given below.

1

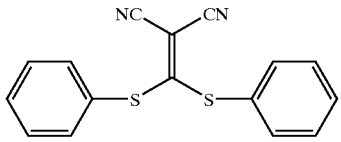

2

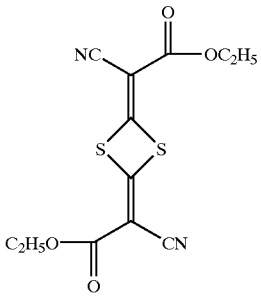

3

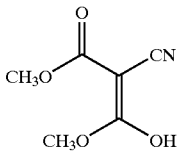

4

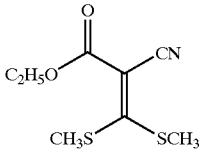

5

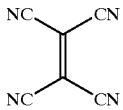

-continued

6

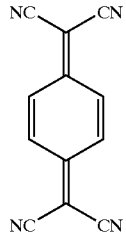

7

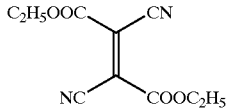

8

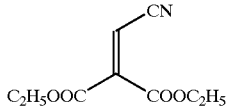

9

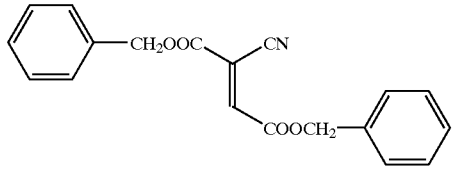

10

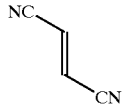

11

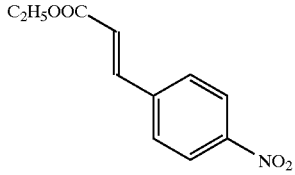

12

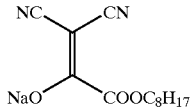

13

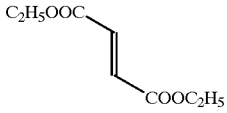

14

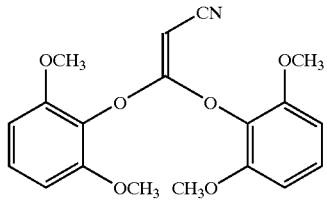

15

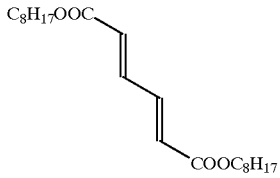

-continued
16
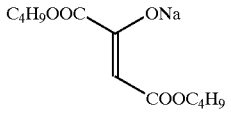
17
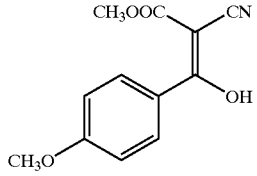
18
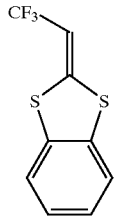
19
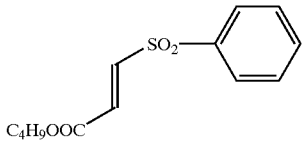
20
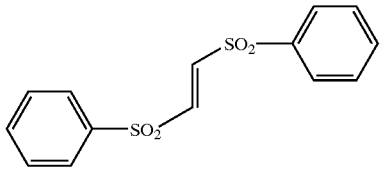
21
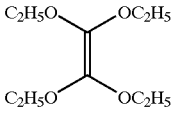
22
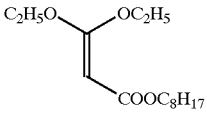
23
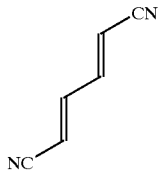
24
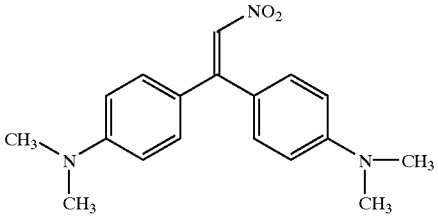
-continued
25
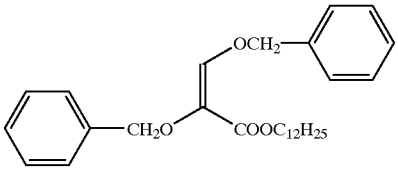
26
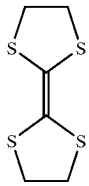
27
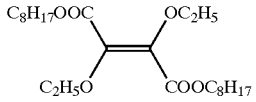
28
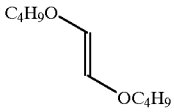
29
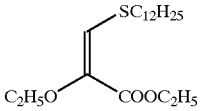
30
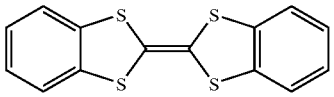
31
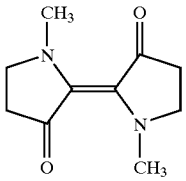
32
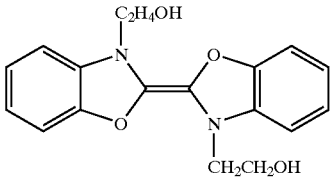
33
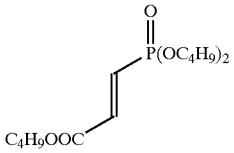
34
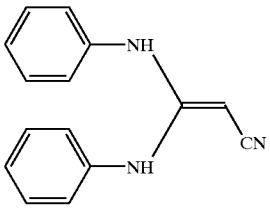

-continued
35
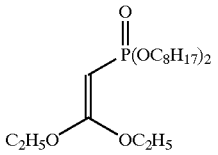
36
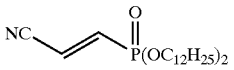
37
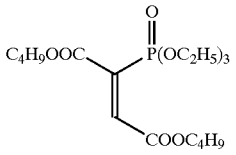
38
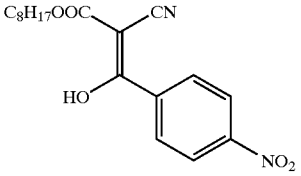
39
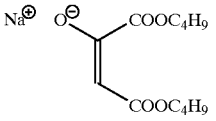
40
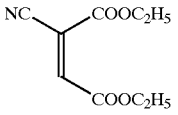
41
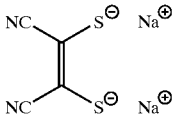
42
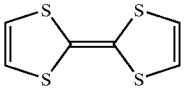
43
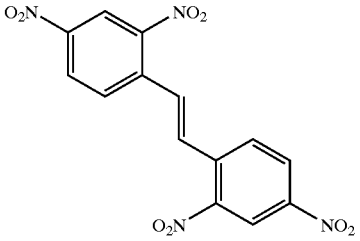
44
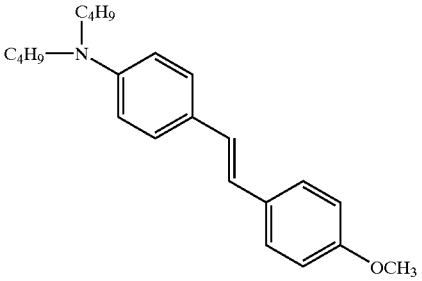
-continued
45
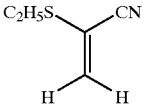
46
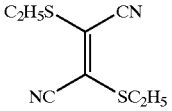
47
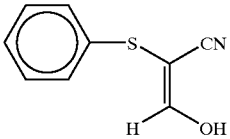
48
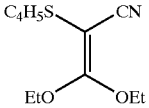
49
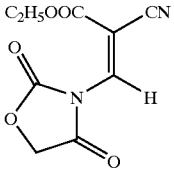
50
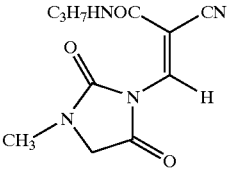
51
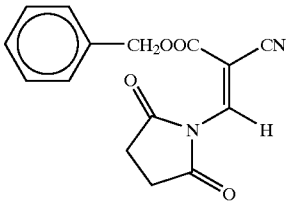
52
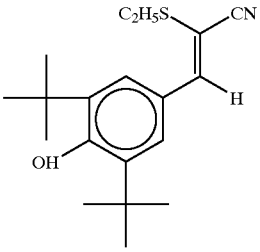

-continued

53

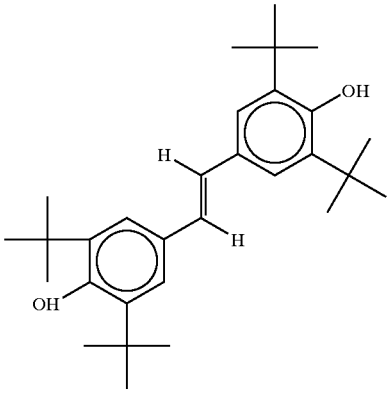

54

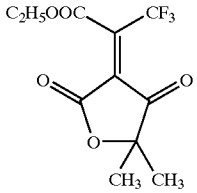

55

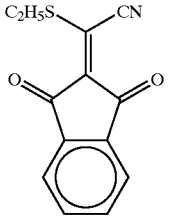

56

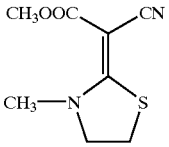

57

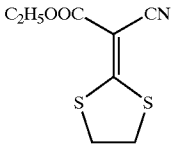

58

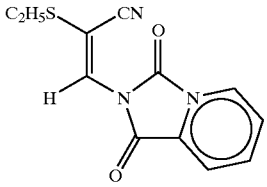

59

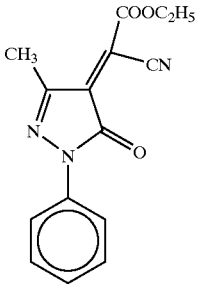

-continued

60

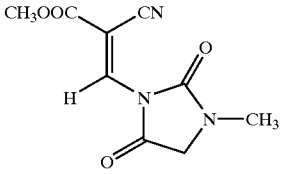

61

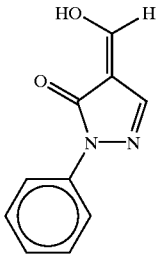

62

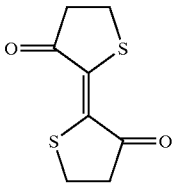

63

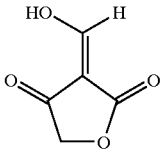

64

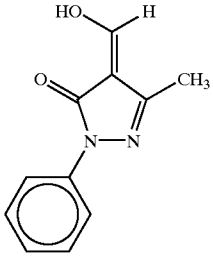

65

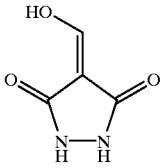

66

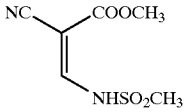

The compounds according to the invention can be readily synthesized by well-known methods and are also commercially available from chemical manufacturers.

These compounds may be used alone or in admixture of two or more. The amount of the compound(s) added is preferably $1\times10^{-6}$ to 1 mol, more preferably $1\times10^{-5}$ to $5\times10^{-1}$ mol, and most preferably $2\times10^{-5}$ to $2\times10^{-1}$ mol per mol of silver. The compound may be added to an image forming layer or any other layer on the image forming layer side of a support, and preferably to the image forming layer or a layer disposed adjacent thereto.

In the practice of the invention, the substituted alkene derivative is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the substituted alkene derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the substituted alkene derivative in powder form in water in a ball mill, colloidal mill or ultrasonic mixer.

Hydrazine Derivative

In the preferred embodiment, the thermographic recording element of the invention contains a hydrazine derivative of the general formula (I).

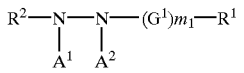

Herein $R^2$ is an aliphatic, aromatic or heterocyclic group. $R^1$ is hydrogen or a block group. $G^1$ is —CO—, —COCO—, —C(=S)—, —$SO_2$—, —SO—, —PO($R^3$)— or iminomethylene group. $R^3$ is selected from the same range as defined for $R^1$ and may be different from $R^1$. $A^1$ and $A^2$ are both hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter m1 is equal to 0 or 1. $R^1$ is an aliphatic, aromatic or heterocyclic group when m1 is 0.

In formula (I), the aliphatic groups represented by $R^2$ are preferably substituted or unsubstituted, normal, branched or cyclic alkyl, alkenyl and alkynyl groups having 1 to 30 carbon atoms.

In formula (I), the aromatic groups represented by $R^2$ are preferably monocyclic or fused ring aryl groups, for example, phenyl and naphthyl groups derived from benzene and naphthalene rings. The heterocyclic groups represented by $R^2$ are preferably monocyclic or fused ring, saturated or unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl, alkyl and aromatic heterocyclic groups are most preferred as $R^2$.

The group represented by $R^2$ may have a substituent. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoyl-amino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl) sulfinyl groups, sulfo groups or salts thereof, sulfamoyl groups, acylsulfamoyl groups, sulfonylsulfamoyl groups or salts thereof, and groups containing a phosphoramide or phosphoric ester structure. These substituents may be further substituted with such a substituent.

Preferred substituents that $R^2$ may have include, where $R^2$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^2$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (I), $R^1$ is hydrogen or a block group. Examples of the block group include aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^1$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxy-propyl, hydroxymethyl, 3-methanesulfonamidopropyl, benzenesulfonamidomethyl, trifluoroacetylmethyl, dimethyl-aminomethyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyano-diphenylmethyl, and methylthiodiphenylmethyl groups. The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyano-phenyl, 2-hydroxymethylphenyl, 2,6-dichloro-4-cyanophenyl, and 2-chloro-5-octylsulfamoylphenyl groups.

The heterocyclic groups represented by $R^1$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, quinolyl, hydantoyl and imidazolidinyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^1$ may be substituted ones, with examples of the substituent being as exemplified for the substituent on $R^2$.

In formula (I), $R^1$ may be such a group as to induce cyclization reaction to cleave a $G^1$—$R^1$ moiety from the remaining molecule to generate a cyclic structure containing the atoms of the —$G^1$—$R^1$ moiety. Such examples are described in JP-A 29751/1988, for example.

The hydrazine derivative of formula (I) may have incorporated therein a group capable of adsorbing to silver halide. Such adsorptive groups include alkylthio, arylthio, thiourea, thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^1$ and $R^2$ in formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ or $R^2$ in formula (I) may have a plurality of hydrazino groups as a substituent. In this case, the compounds of formula (I) are polymeric with respect to hydrazino group. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^1$ or $R^2$ in formula (I) may contain a cationic group (e.g., a group containing a quaternary ammonio group and a nitrogenous heterocyclic group containing a quaternized nitrogen atom), a group containing recurring ethyleneoxy or propyleneoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. Nos. 4,994,365 and 4,988,604, and German Patent No. 4006032.

In formula (I), each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette's substituent constants may be −0.5 or more), or a substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of the general formula (I) is described.

In formula (I), $R^2$ is preferably phenyl, substituted alkyl of 1 to 3 carbon atoms or aromatic heterocyclic groups.

Where $R^2$ represents phenyl or aromatic heterocyclic groups, preferred substituents thereon include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl, and chloro groups.

Where $R^2$ represents substituted alkyl groups of 1 to 3 carbon atoms, it is more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^2$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Where $R^2$ represents heterocyclic groups, preferred examples thereof are pyridine, quinoline, pyrimidine, triazine, benzthiazole, benzimidazole, and thiophene rings.

Most preferably, $R^2$ in formula (I) represents substituted phenyl groups.

In formula (I), m1 is equal to 0 or 1. When m1 is 0, $R^1$ represents aliphatic, aromatic or heterocyclic groups. When m1 is 0, $R^1$ more preferably represents phenyl groups, substituted alkyl groups of 1 to 3 carbon atoms or alkenyl groups. Of these, the preferred ranges of the phenyl groups and the substituted alkyl groups of 1 to 3 carbon atoms are the same as the preferred range of $R^2$. Where $R^1$ represents alkenyl groups, they are preferably vinyl groups, more preferably vinyl groups having one or two substituents selected from cyano, acyl, alkoxycarbonyl, nitro, trifluoromethyl and carbamoyl groups. Exemplary are 2,2-dicyanovinyl, 2-cyano-2-methoxycarbonylvinyl, and 2-acetyl-2-ethoxycarbonylvinyl groups.

Preferably m1 is equal to 1.

Where $R^2$ is a phenyl or aromatic heterocyclic group and $G^1$ is —CO—, the groups represented by $R^1$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^1$ represents alkyl groups, preferred substituents thereon are halogen, alkoxy, aryloxy, alkylthio, arylthio, hydroxy, sulfonamide, amino, acylamino, and carboxy groups.

Where $R^2$ is a substituted methyl group and $G^1$ is —CO—, the groups represented by $R^1$ are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamio and heterocyclic amino groups. Where $G^1$ is —COCO—, independent of $R^2$, $R^1$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^2$, $R^1$ is preferably selected from alkyl, aryl and substituted amino groups.

In formula (I), $G^1$ is preferably —CO— or —COCO—, and most preferably —CO—.

Illustrative, non-limiting, examples of the compound represented by formula (I) are given below.

TABLE 1

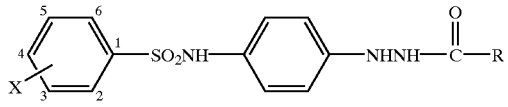

| | X = | R = —H | —$C_2F_4$—COOH or (—$C_2F_4$—$COO^{\ominus}K^{\oplus}$) | 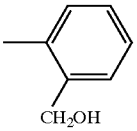 | 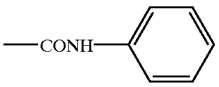 |
|---|---|---|---|---|---|
| 1 | 3-NHCO—$C_9H_{19}$(n) | 1a | 1b | 1c | 1d |
| 2 | 3-NHCONH—S—$C_7H_{15}$(n) | 2a | 2b | 2c | 2d |
| 3 | 3-$NHCOCH_2$—$N^{\oplus}$ (Cl$^{\ominus}$) | 3a | 3b | 3c | 3d |
| 4 | 3-$NHCOCH_2$—$N^{\oplus}$($CH_3$)($CH_3$)—$C_8H_{17}$ ($Cl^{\ominus}$) | 4a | 4b | 4c | 4d |
| 5 | 3-NHCO— | 5a | 5b | 5c | 5d |
| 6 | 3-NHCONH— | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |

TABLE 2
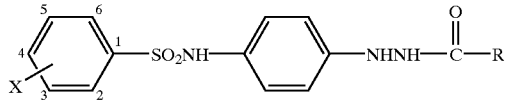
| | | R = | | | |
|---|---|---|---|---|---|
| | X = | —H | —$CF_2H$ | 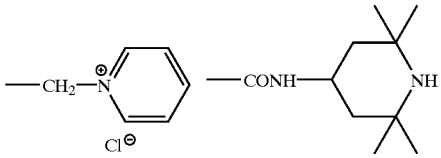 |  |
| 8 | 3-$CONHCH_2CH(C_2H_5)C_4H_9$ | 8a | 8e | 8f | 8g |
| 9 | 6-$OCH_3$-3-$C_5H_{11}$(t) | 9a | 9e | 9f | 9g |
| 10 | 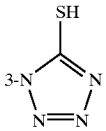 | 10a | 10e | 10f | 10g |
| 11 | 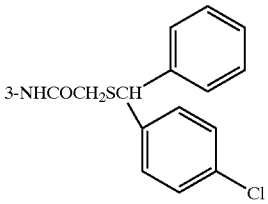 | 11a | 11e | 11f | 11g |
| 12 | 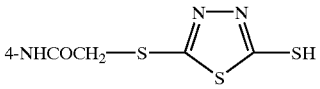 | 12a | 12e | 12f | 12g |
| 13 | 3-$NHCOCH(CH_2COOH)C_8H_{17}$ | 13a | 13e | 13f | 13g |
| 14 | 3,5-$(CONHCH_2CH(C_2H_5)C_4H_9)_2$ | 14a | 14e | 14f | 14g |
TABLE 3
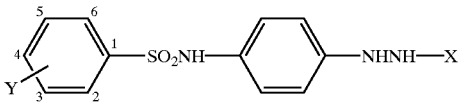
| | | X = | | | |
|---|---|---|---|---|---|
| | Y = | —CHO | —$COCF_3$ | —$SO_2CH_3$ | —$P(=O)(OC_2H_5)_2$ |
| 15 | 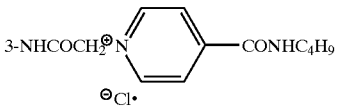 | 15a | 15h | 15i | 15j |

TABLE 3-continued
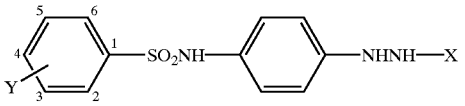
| | Y = | X = —CHO | —$COCF_3$ | —$SO_2CH_3$ | —$P(=O)(OC_2H_5)_2$ |
|---|---|---|---|---|---|
| 16 | 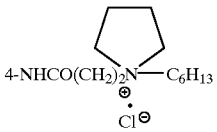 | 16a | 16h | 16i | 16j |
| 17 | 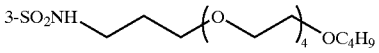 | 17a | 17h | 17i | 17j |
| 18 | 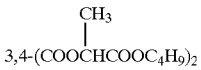 | 18a | 18h | 18i | 18j |
| 19 | 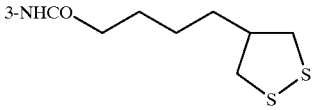 | 19a | 19h | 19i | 19j |
| 20 | 3-$NHSO_2NH$—$C_8H_{17}$ | 20a | 20h | 20i | 20j |
| 21 | 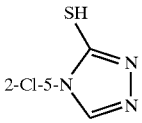 | 21a | 21h | 21i | 21j |
TABLE 4
| | | R = —H | —$CF_3$ | 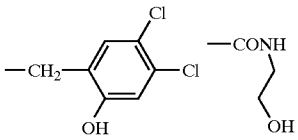 |  |
|---|---|---|---|---|---|
| 22 | 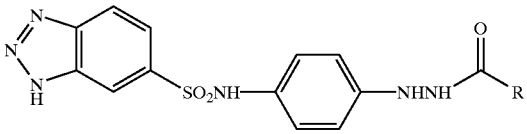 | 22a | 22h | 22k | 22l |
| 23 | 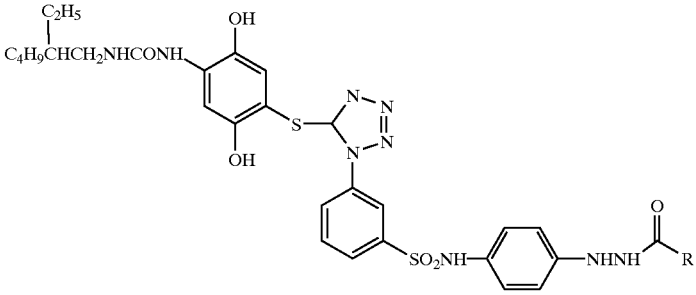 | 23a | 23h | 23k | 23l |

TABLE 4-continued
| | | R = | | | |
|---|---|---|---|---|---|
| | | —H | —$CF_3$ | —$CH_2$— 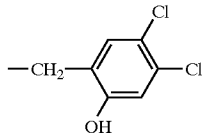 | —CONH— 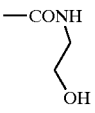 |
| 24 | 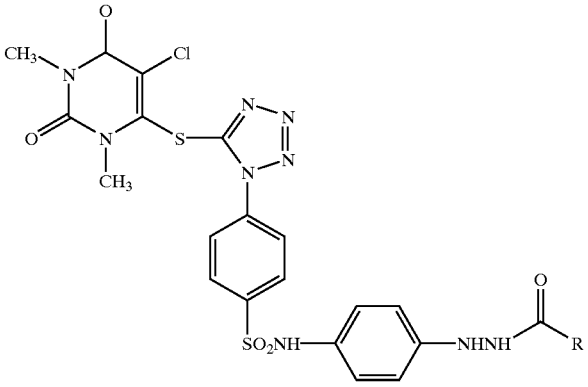 | 24a | 24h | 24k | 24l |
| 25 | 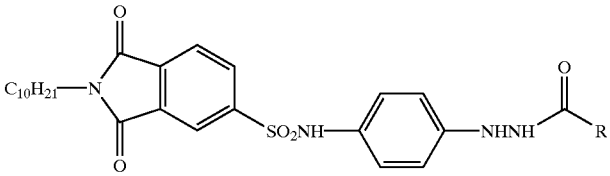 | 25a | 25h | 25k | 25l |
| 26 | 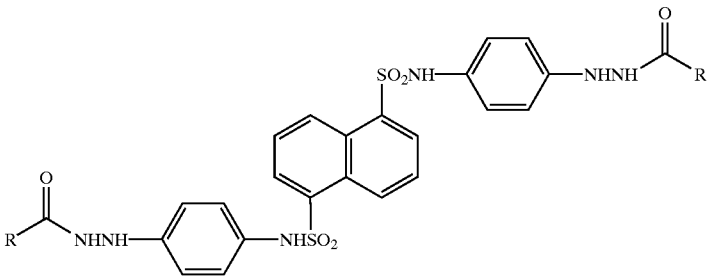 | 26a | 26h | 26k | 26l |
| 27 | 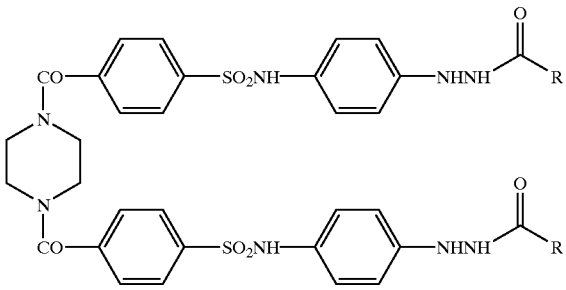 | 27a | 27h | 27k | 27l |
| 28 | 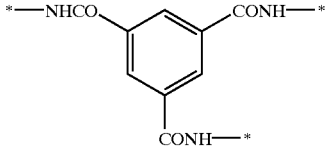 | 28a | 28h | 28k | 28l |

TABLE 4-continued
| | R = | | |
|---|---|---|---|
| | —H | —$CF_3$ | 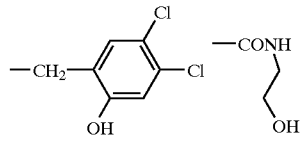 |
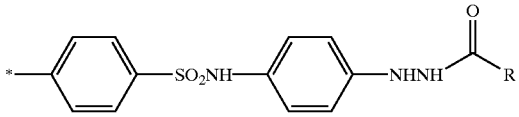
TABLE 5
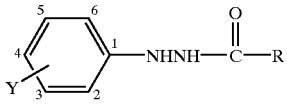
| | Y = | R = —H | —$CH_2OCH_3$ | 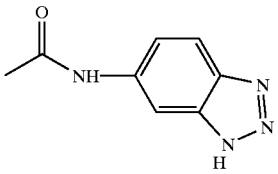 | 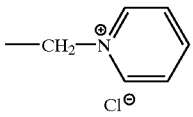 |
|---|---|---|---|---|---|
| 29 | 4-NHCNH—$C_8H_{17}$(n) (S) | 29a | 29m | 29n | 29f |
| 30 | 4-NHP(O)(O—$CH_2$—)$_2$ | 30a | 30m | 30n | 30f |
| 31 | 4-NHCONH—$(CH_2)_3$O— | 31a | 31m | 31n | 31f |
| 32 | 4-OH; 3-NHCONH$CH_2$CH($C_2H_5$)—$C_4H_9$ | 32a | 32m | 32n | 32f |
| 33 | 4-$NHSO_2(CH_2)_2NHCO$— | 33a | 33m | 33n | 33f |
| 34 | 4-$OCH_2$— | 34a | 34m | 34n | 34f |

TABLE 5-continued
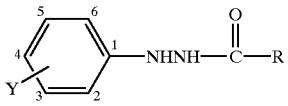
| | Y = | R = —H | —$CH_2OCH_3$ | 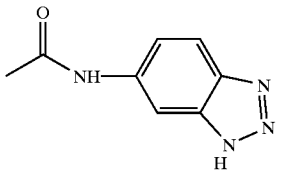 | 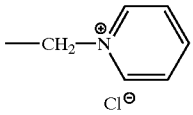 |
|---|---|---|---|---|---|
| 35 | 4-NHCONHN—(—$CH_2$— 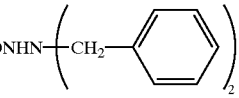 )$_2$ | 35a | 35m | 35n | 35f |
TABLE 6
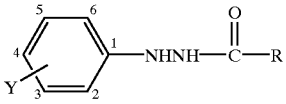
| | Y = | R = —H | —$CF_2SCH_3$ | —$CONHCH_3$ | 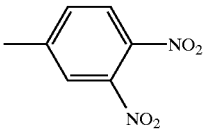 |
|---|---|---|---|---|---|
| 36 | 2-$NHSO_2CH_3$— 4-$NHCONH(CH_2)_3$— 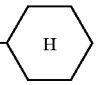 | 36a | 36o | 36p | 36q |
| 37 | 2-$OCH_3$-4-$NHSO_2C_{12}H_{25}$ | 37a | 37o | 37p | 37q |
| 38 | 3-$NHCOC_{11}H_{23}$-4-$NHSO_2CF_3$ | 38a | 38o | 38p | 38q |
| 39 | 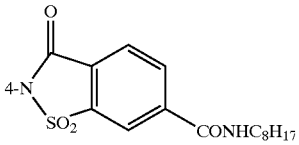 | 39a | 39o | 39p | 39q |
| 40 | 4-$OCO(CH_2)_2COOC_6H_{13}$ | 40a | 40o | 40p | 40q |
| 41 | 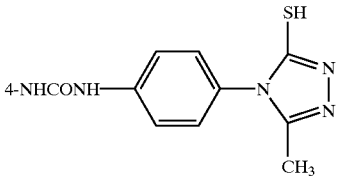 | 41a | 41o | 41p | 41q |
| 42 | 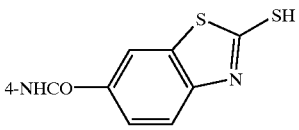 | 42a | 42o | 42p | 42q |

TABLE 7
43
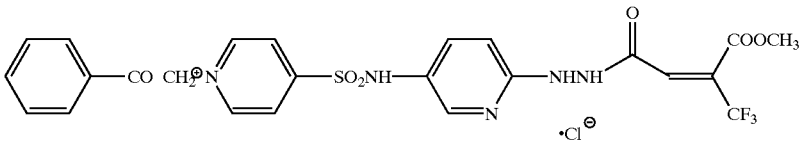
44
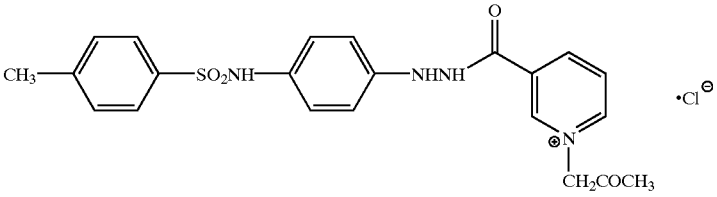
45
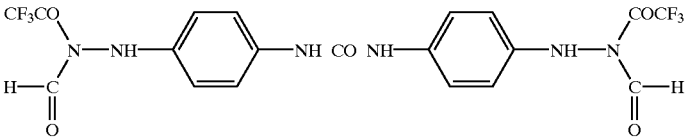
46
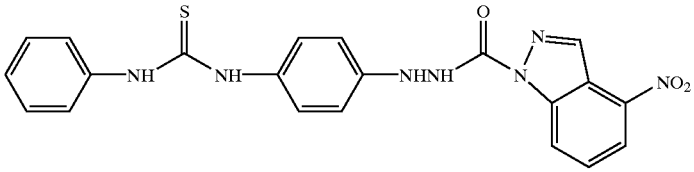
47
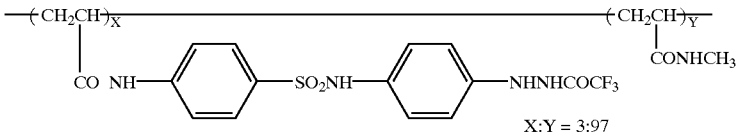
X:Y = 3:97
Average molecular weight ~ 100,000
48
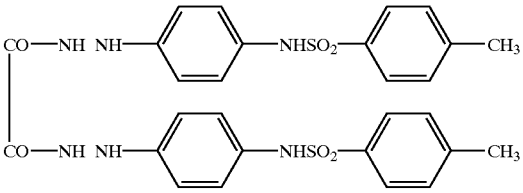
49
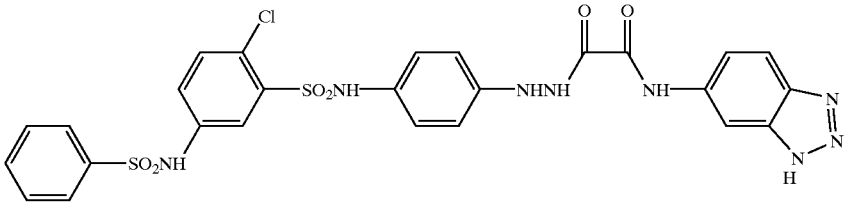
50
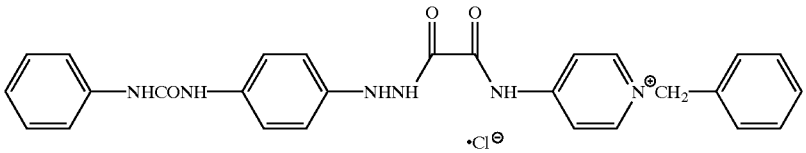

TABLE 8
| | |
|---|---|
| 51 | 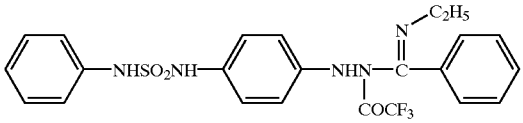 |
| 52 | 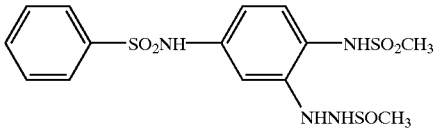 |
| 53 | 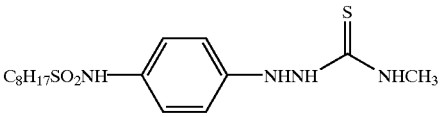 |
TABLE 9
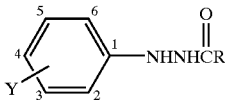
| | | R = | | | |
|---|---|---|---|---|---|
| | Y = | —H | —$CH_2OCH_3$ | —$CH_2O$— 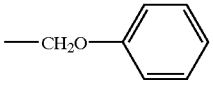 | —$CONHC_3H_7$ |
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 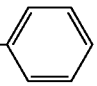 | 58a | 58m | 58r | 58s |
| 59 | 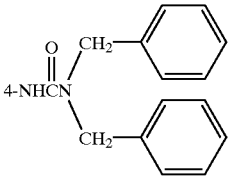 | 59a | 59m | 59r | 59s |

TABLE 10
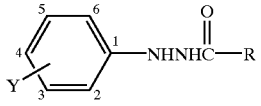
| | Y = | R = —H | 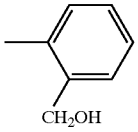 | 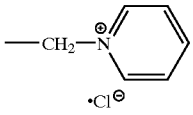 | 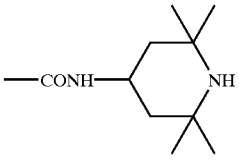 |
|---|---|---|---|---|---|
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |
| 64 | 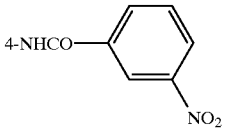 | 64a | 64c | 64f | 64g |
| 65 | 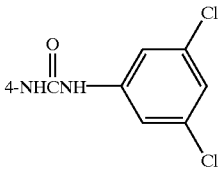 | 65a | 65c | 65f | 65g |
TABLE 11
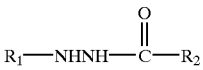
| | $R_1$ = | $R_2$ = —H | 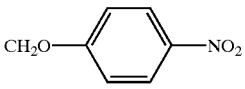 | 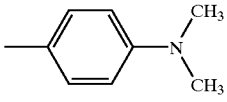 | 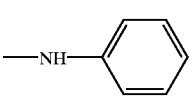 |
|---|---|---|---|---|---|
| 66 | 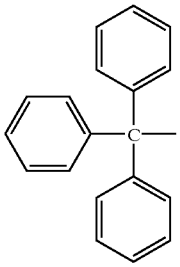 | 66a | 66u | 66v | 66t |

TABLE 11-continued
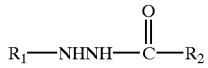
| $R_1$ = | $R_2$ = —H | $R_2$ = 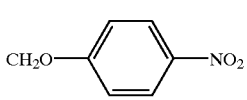 | $R_2$ = 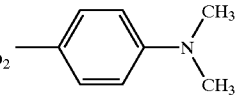 | $R_2$ = 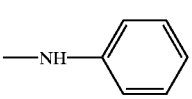 |
|---|---|---|---|---|
| 67 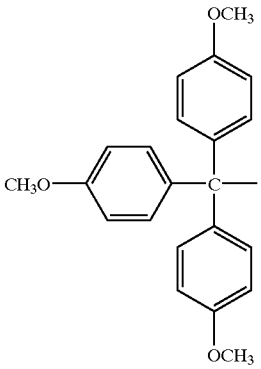 | 67a | 67u | 67v | 67t |
| 68 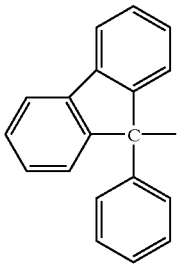 | 68a | 68u | 68v | 68t |
| 69 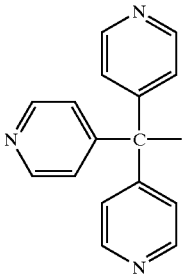 | 69a | 69u | 69v | 69t |
| 70 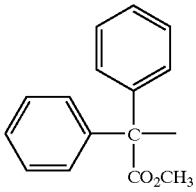 | 70a | 70u | 70v | 70t |
| 71 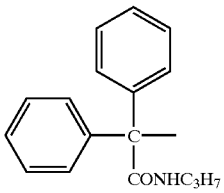 | 71a | 71u | 71v | 71t |

TABLE 12
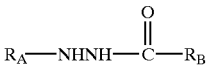
| $R_A$ = | $R_B$ = $-CNHC_3H_7$ | $R_B$ = $-CO-C_4H_9(t)$ | $R_B$ = $-OC_4H_9(t)$ | $R_B$ = 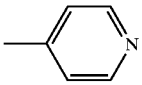 |
|---|---|---|---|---|
| 72 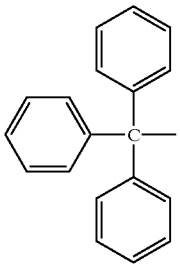 | 72s | 72x | 72y | 72w |
| 73 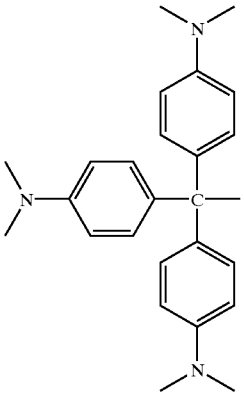 | 73s | 73x | 73y | 73w |
| 74 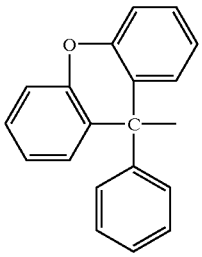 | 74s | 74x | 74y | 74w |
| 75 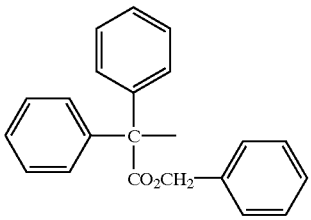 | 75s | 75x | 75y | 75w |

TABLE 12-continued
| $R_A$ = | $R_A$—NHNH—C(=O)—$R_B$ ; $R_B$ = —C(=O)NHC$_3$H$_7$ | —C(=O)—CO—C$_4$H$_9$(t) | —OC$_4$H$_9$(t) | 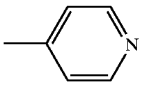 |
|---|---|---|---|---|
| 76 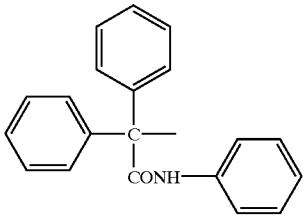 | 76s | 76x | 76y | 76w |
TABLE 13
| | R |
|---|---|
| 77 | 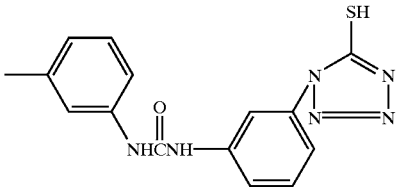 |
| 78 | —CH$_2$SCH$_2$CH$_2$SO$_2$— 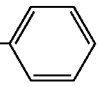 |
| 79 | —CH$_2$OCH$_2$CH$_2$SCH$_2$CH$_2$OCH$_3$ |
| 80 | —CF$_2$CF$_2$COOH |
| 81 | —CH$_2$OCH$_2$S— 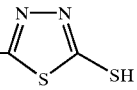 |
| 82 | —CH$_2$— 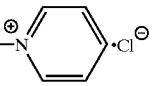 |
TABLE 14
| | |
|---|---|
| 83 | 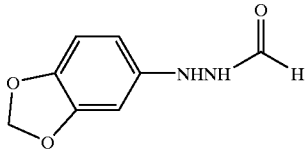 |
| 84 | 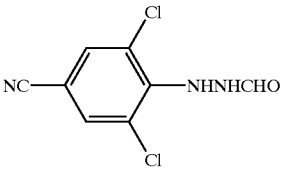 |
| 85 | 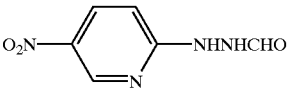 |
| 86 | 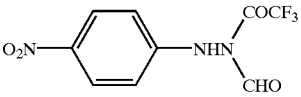 |
| 87 | 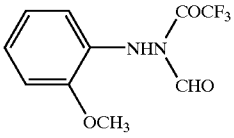 |
| 88 | 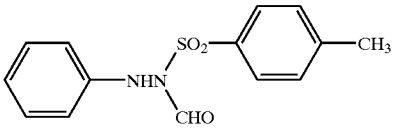 |

TABLE 15
89
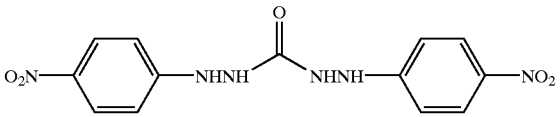
90
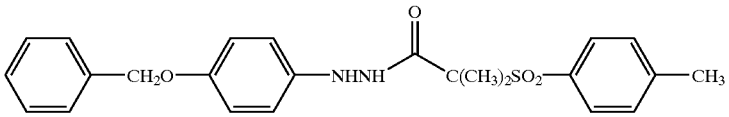
91
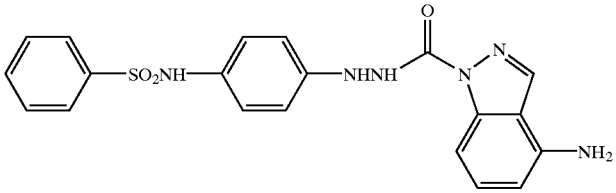
92
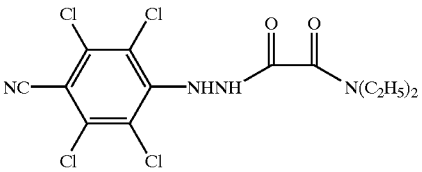
93
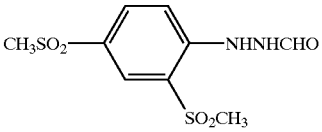
94
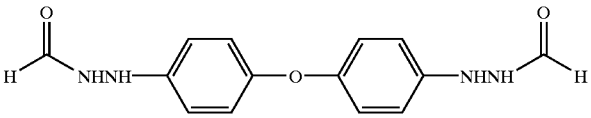

TABLE 16
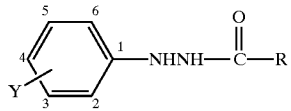
| | Y = | R = $-CH_2O-C_6H_4-C_2H_5$ | $-CH_2O-C(C_2H_5)-C_6H_4-t\text{-}C_4H_9$ | $-CH_2S-C_6H_5$ | $-CH_2-Cl$ |
|---|---|---|---|---|---|
| 95 | 4-NHCOCHO($C_2H_5$)-2,4-di-t-amylphenyl | 95-1 | 95-2 | 95-3 | 95-4 |
| 96 | 4-COOH | 96-1 | 96-2 | 96-3 | 96-4 |
| 97 | 4-NH-C(=S)-$NHC_2H_5$ | 97-1 | 97-2 | 97-3 | 97-4 |
| 98 | 4-$NHSO_2$-3-$NHCOC_9H_{19}$ | 98-1 | 98-2 | 98-3 | 98-4 |

TABLE 16-continued
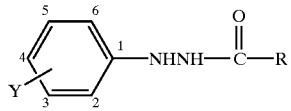
| | Y = | R = 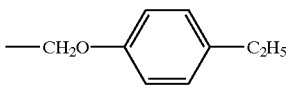 | 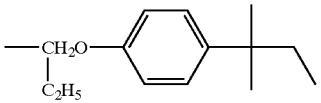 | 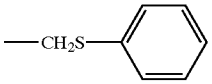 | —$CH_2$—Cl |
|---|---|---|---|---|---|
| 99 | 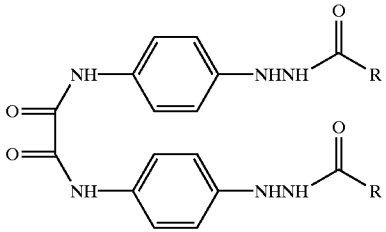 | 99-1 | 99-2 | 99-3 | 99-4 |
| 100 | 4-NHCONHCH$_2$CH($C_2H_5$)($C_4H_9$) | 100-1 | 100-2 | 100-3 | 100-4 |

TABLE 17
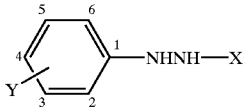
| | Y = | X = | | | |
|---|---|---|---|---|---|
| 101 | 4-NO | 101-5 | 101-6 | 101-7 | 101y |
| 102 | 2,4-$OCH_3$ | 102-5 | 102-6 | 102-7 | 102y |
| 103 | 4-$NHCOCH_2O$ | 103-5 | 103-6 | 103-7 | 103y |
| | Y = | X = | | | |
|---|---|---|---|---|---|
| 104 | 4-NHCONH $SC_4H_9$ | 104-8 | 104-9 | 104w[1] | 104x |
| 105 | 4-$NHSO_2$ $NO_2$ | 105-8 | 105-9 | 105w[1] | 105x |
TABLE 18
Y—NHNH —X
| | Y = | X = | | | |
|---|---|---|---|---|---|
| 106 | $CH_3$—C($CH_3$)$_2$— | 106-10 | 106a | 106m | 106y |

TABLE 18-continued
| | Y—NHNH —X | | | |
|---|---|---|---|---|
| | X = | | | |
| Y = | 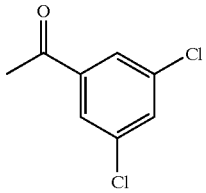 | 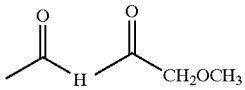 | | 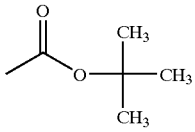 |
| 107 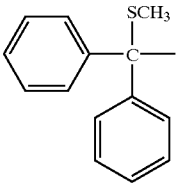 | 107-10 | 107a | 107m | 107y |
| 108 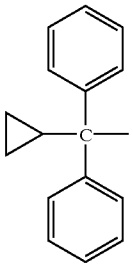 | 108-10 | 108a | 108m | 108y |
| 109 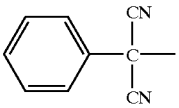 | 109-10 | 109a | 109m | 109y |
| 110 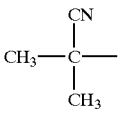 | 110-10 | 110a | 110m | 110y |
| 111 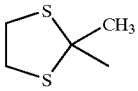 | 111-11 | 111a | 111m | 111y |

TABLE 19
| | Y—NHNH—X | | | | |
|---|---|---|---|---|---|
| | X = | | | | |
| Y = | 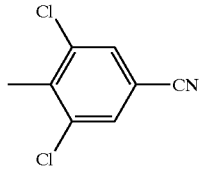 | 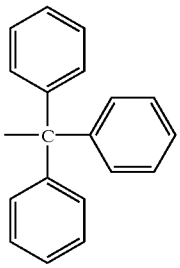 | 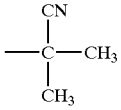 | 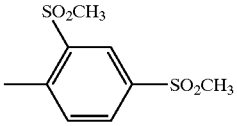 | |
| 112 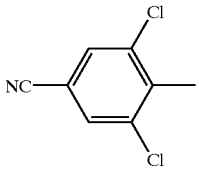 | 112-11 | 112-12 | 112-13 | 112-14 | |
| 113 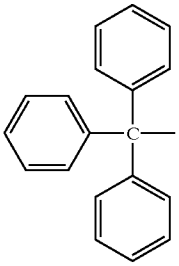 | 113-11 | 113-12 | 113-13 | 113-14 | |
| 114 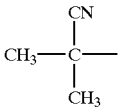 | 114-11 | 114-12 | 114-13 | 114-14 | |
| 115 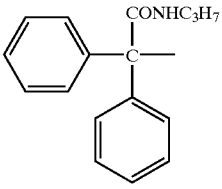 | 115-11 | 115-12 | 115-13 | 115-14 | |
| 116 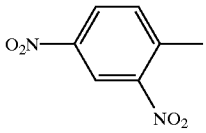 | 116-11 | 116-12 | 116-13 | 116-14 | |
| 117 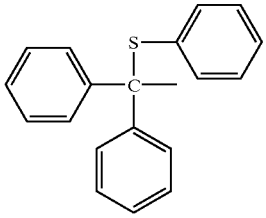 | 117-11 | 117-12 | 117-13 | 117-14 | |

TABLE 20
118
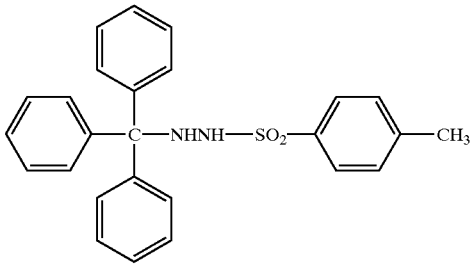
119
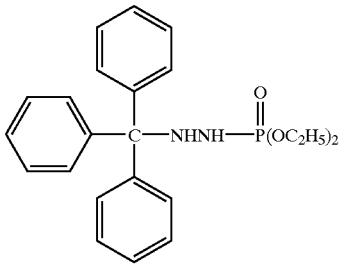
120
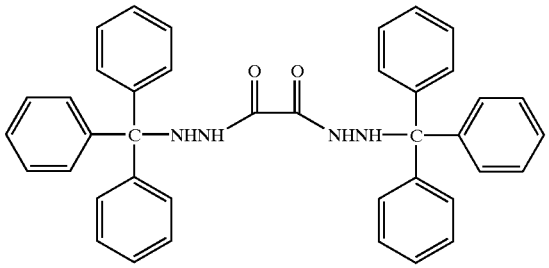
121
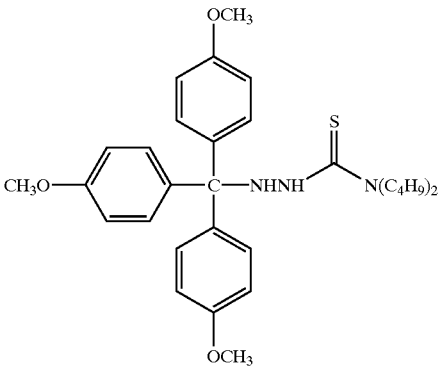
122
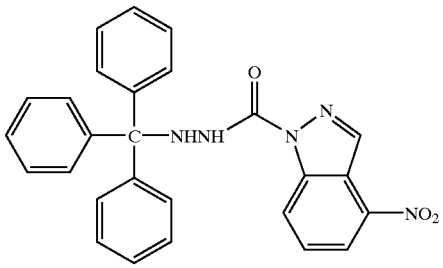

TABLE 20-continued
| | |
|---|---|
| 123 | 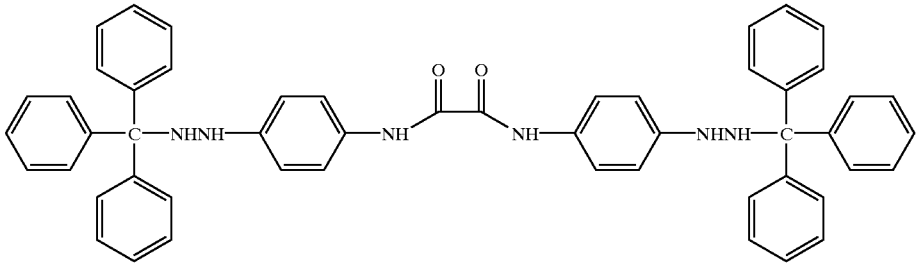 |
TABLE 21
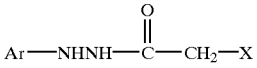
| | | X = | | | | | |
|---|---|---|---|---|---|---|---|
| | Ar = | —OH | —SH | —NHCOCF$_3$ | —NHSO$_2$CH$_3$ | —NHSO$_2$ph | —N(CH$_3$)$_2$ |
| 124 | 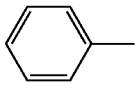 | 124a | 124b | 124c | 124d | 124e | 124f |
| 125 | 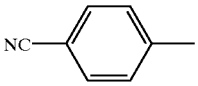 | 125a | 125b | 125c | 125d | 125e | 125f |
| 126 | 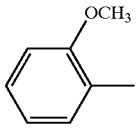 | 126a | 126b | 126c | 126d | 126e | 126f |
| 127 | 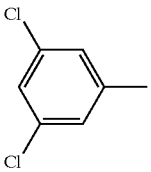 | 127a | 127b | 127c | 127d | 127e | 127f |
| 128 | 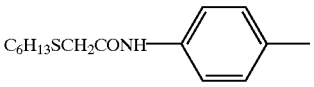 | 128a | 128b | 128c | 128d | 128e | 128f |
| 129 | 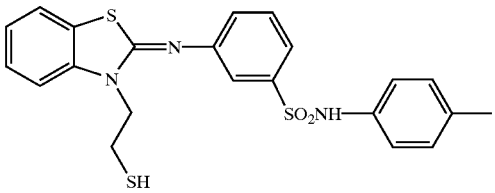 | 129a | 129b | 129c | 129d | 129e | 129f |
| 130 | 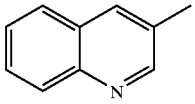 | 130a | 130b | 130c | 130d | 130e | 130f |
| 131 | 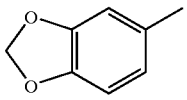 | 131a | 131b | 131c | 131d | 131e | 131f |

TABLE 21-continued

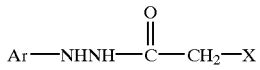

| Ar = | X = —OH | —SH | —NHCOCF$_3$ | —NHSO$_2$CH$_3$ | —NHSO$_2$ph | —N(CH$_3$)$_2$ |
|---|---|---|---|---|---|---|
| 132 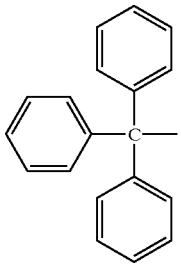 | 132a | 132b | 132c | 132d | 132e | 132f |
| 133 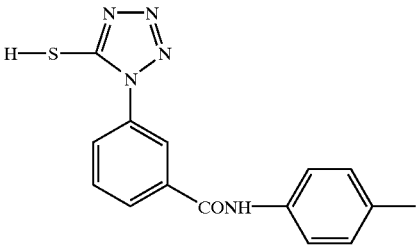 | 133a | 133b | 133c | 133d | 133e | 133f |
| 134 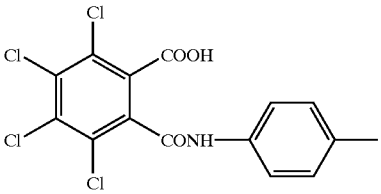 | 134a | 134b | 134c | 134d | 134e | 134f |

TABLE 22

135 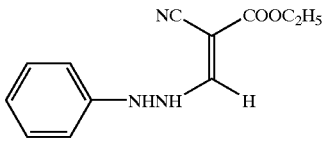

136 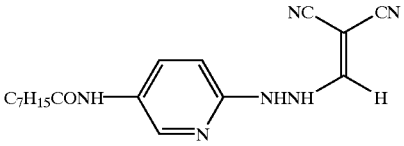

137 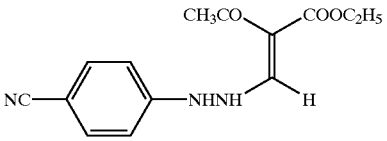

138 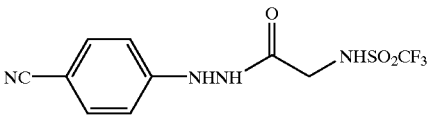

TABLE 22-continued

139 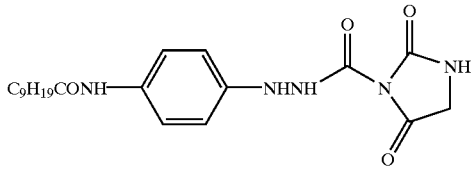

140 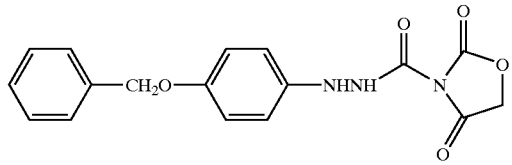

The compounds of formula (I) may be used alone or in admixture of two or more.

In addition to the above-described ones, the following hydrazine derivatives are also preferable for use in the practice of the invention. If desired, any of the following hydrazine derivatives may be used in combination with the hydrazine derivatives of formula (I). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1987, pages 6–7.

In the practice of the invention, the hydrazine nucleating agent is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to an image forming layer or any other layer on the image forming layer side of a support, and preferably to the image forming layer or a layer disposed adjacent thereto.

The hydrazine nucleating agent is preferably used in an amount of $1\times10^{-6}$ mol to 1 mol, more preferably $1\times10^{5}$ mol to $5\times10^{-1}$ mol, and most preferably $2\times10^{-5}$ mol to $2\times10^{-1}$ mol per mol of silver.

In the thermographic recording element of the invention, a nucleation promoter may be added in combination with the hydrazine derivative. The nucleation promoter used herein includes amine derivatives, onium salts, disulfide derivatives, and hydroxylamine derivatives.

Examples of the nucleation promoter are shown below.

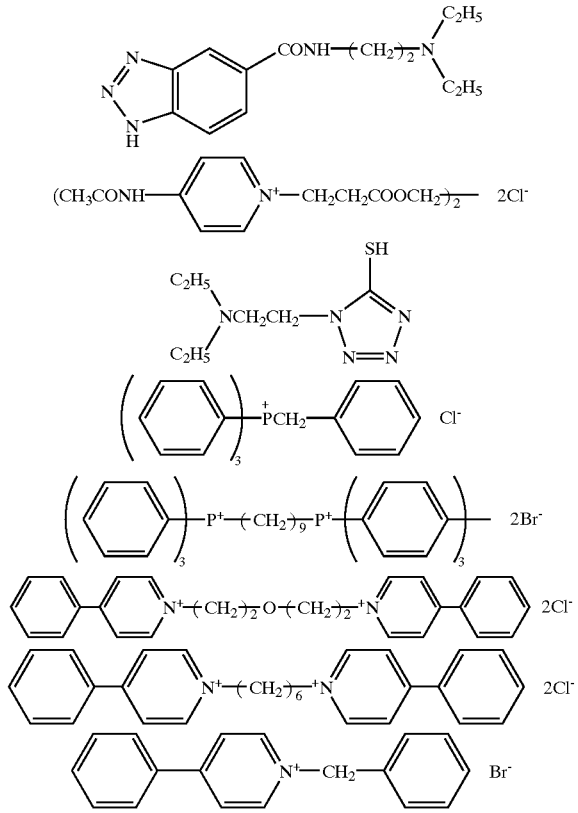

Other useful examples of the nucleation promoter include the compounds described in JP-A 77783/1995, page 48, lines 2–37, more specifically Compounds A-1 to A-73 described on pages 49–58 of the same; the compounds of the chemical formulae [21], [22] and [23] described in JP-A 84331/1995, more specifically the compounds described on pages 6–8 of the same; the compounds of the general formulae [Na] and [Nb] described in JP-A 104426/1995, more specifically Compounds Na-1 to Na-22 and Nb-1 to Nb-12 described on pages 16–20 of the same; the compounds of the general formulae (1), (2), (3), (4), (5), (6) and (7) described in JP-A 37817/1995, more specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 described therein; and the nucleation promoters described in Japanese Patent Application No. 70908/1996.

The nucleation promoter is preferably used in an amount of $1\times10^{-6}$ mol to $2\times10^{-2}$ mol, more preferably $1\times10^{-5}$ mol to $2\times10^{-2}$ mol, and most preferably $2\times10^{-5}$ to $1\times10^{-2}$ mol per mol of silver.

Reducing Agent

The thermographic recording element of the invention contains a reducing agent. In one embodiment of the invention, a compound of the following general formula (A) is contained as the reducing agent in the thermographic recording element.

(A)

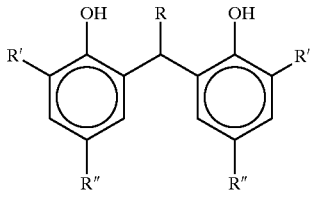

Herein, R is hydrogen or alkyl groups having 1 to 10 carbon atoms such as —$C_4H_9$ and 2,4,4-trimethylpentyl, R' and R" are alkyl groups having 1 to 5 carbon atoms such as methyl, ethyl and n-butyl.

Illustrative, non-limiting examples of the compound of formula (A) are given below.

A-1

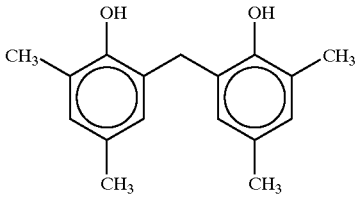

A-2

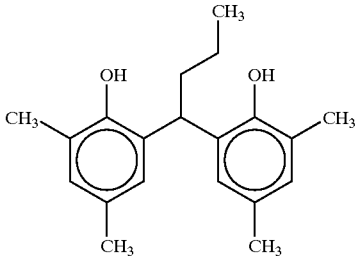

A-3

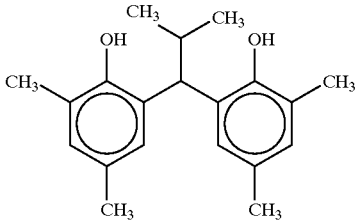

A-4

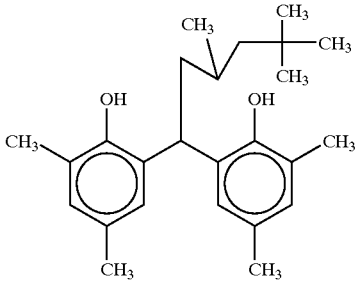

A-5

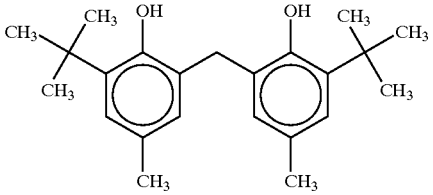

-continued

A-6

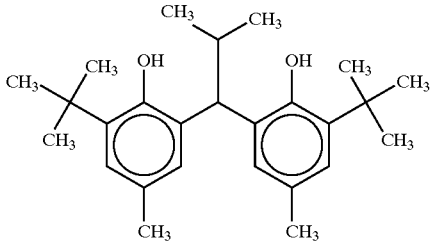

A-7

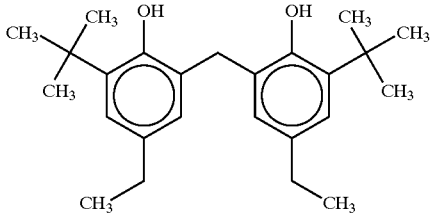

The compound of formula (A) is preferably used in an amount of $1\times10^{-2}$ to 10 mol, more preferably $1\times10^{-2}$ to 1.5 mol per mol of silver.

In another embodiment of the invention, compounds of the following general formulae (R-I), (R-II), (R-III) and (R-IV) are contained as the reducing agent in the thermographic recording element.

(R-I)

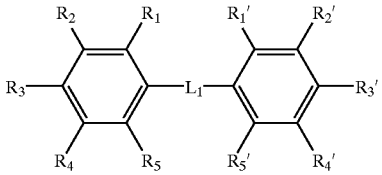

(R-II)

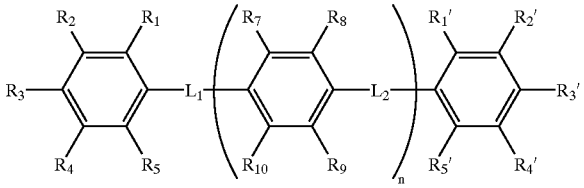

(R-III)

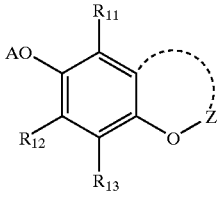

(R-IV)

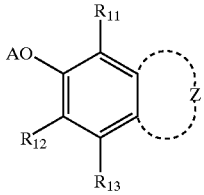

In formula (R-III), Z forms a cyclic structure represented by the following formula (Z-1) or (Z-2).

(Z-2)

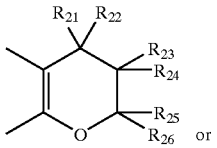

or

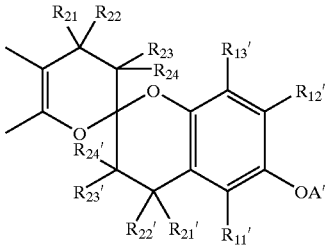

In formula (R-IV), Z forms a cyclic structure represented by the following formula (Z-3) or (Z-4).

(Z-3)

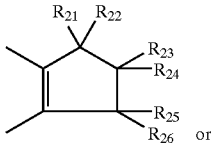

or (Z-4)

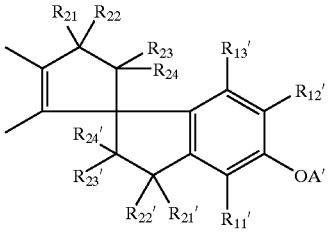

In formulae (R-I) and (R-II), each of $L_1$ and $L_2$ is a group —CH—($R_6$)—, —CH—($R_6$')— or a sulfur atom, and n is a natural number.

Herein, $R_1$ to $R_5$, $R_6$, $R_7$ to $R_{10}$, $R_1$' to $R_5$, $R_6$', $R^{11}$ to $R_{13}$, $R_{11}$' to $R_{13}$', $R_{21}$ to $R_{26}$, $R_{21}$' to $R_{24}$' are hydrogen atoms, alkyl groups, aryl groups, aralkyl groups, halogen atoms, amino groups or substituents represented by —OA, with the proviso that at least one of $R^1$ to $R_5$, at least one of $R_1$' to $R_5$', and at least one of $R_7$ to $R_{10}$ each are a group represented by —OA. In formula (R-II), $L_1$ is a sulfur atom where at least one of $R^1$ to $R_5$ and at least one of $R_1$' to $R_5$' are groups represented by —OA. Also, a plurality of substituents in each of $R_1$ to $R_5$, $R_7$ to $R_{10}$, $R^{1'}$ to $R_5$', $R_{11}$ to $R_{13}$, $R_{11}$' to $R_{13}$', $R_{21}$ to $R_{26}$, $R_{21}$' to $R_{24}$', taken together, may form a ring.

A and A' each are a hydrogen atom, alkyl group having 1 to 30 carbon atoms, acyl group having 1 to 30 carbon atoms, aryl group, phosphate group or sulfonyl group.

$R^1$ to $R_5$, $R_7$ to $R_{10}$, $R^{1'}$ to $R_5$', $R^{11}$ to $R_{13}$, $R_{11}$' to $R_{13}$', $R_{21}$ to $R_{26}$, $R_{21}$' to $R_{24}$', A and A' may be substituted groups while typical examples of the substituent include alkyl groups (including active methine groups), nitro groups, alkenyl groups, alkynyl groups, aryl groups, heterocyclic ring-containing groups, groups containing a quaternized nitrogen atom-containing heterocyclic ring (e.g., pyridinio group), hydroxy groups, alkoxy groups (including groups containing recurring ethyleneoxy or propyleneoxy units), aryloxy groups, acyloxy groups, acyl groups, alkoxycarbonyl groups, aryloxycarbonyl groups, carbamoyl groups, urethane groups, carboxyl groups, imido groups, amino groups, carbonamide groups, sulfonamide groups, ureido groups, thioureido groups, sulfamoylamino groups, semicarbazide groups, thiosemicarbazide groups, hydrazino-containing groups, quaternary ammonio-containing groups, mercapto groups, (alkyl, aryl or heterocyclic) thio groups, (alkyl or aryl) sulfonyl groups, (alkyl or aryl) sulfinyl groups, sulfo groups, sulfamoyl groups, acylsulfamoyl groups, (alkyl or aryl) sulfonylureido groups, (alkyl or aryl) sulfonylcarbamoyl groups, halogen atoms, cyano groups, phosphoramide groups, phosphate structure-containing groups, acylurea structure-bearing groups, selenium or tellurium atom-containing groups, and tertiary or quaternary sulfonium structure-bearing groups. These substituents may be further substituted, with preferred examples of the further substituent being the same as the foregoing substituents.

Illustrative, non-limiting, examples of the compounds represented by formulae (R-I), (R-II), (R-III) and (R-IV) are given below.

TABLE 23

| No. | $R_1$, $R_1$' | $R_2$, $R_2$' | $R_3$, $R_3$' | $R_4$, $R_4$' | $R_5$, $R_5$' | $L_1$ | $R_6$ |
|---|---|---|---|---|---|---|---|
| R-I-1 | —OH | —$CH_3$ | —H | —$CH_3$ | —H | S | — |
| R-I-2 | —OH | —$CH_3$ | —H | —$C_2H_5$ | —H | S | — |
| R-I-3 | —OH | —$CH_3$ | —H | —$C_4H_9$ (t) | —H | S | — |
| R-I-4 | —H | —$C_4H_9$ (t) | —OH | —CPen | —H | CHR6 | —H |
| R-I-5 | —H | —$C_4H_9$ (t) | —OH | —$C_4H_9$ (t) | —H | CHR6 | —TMB |
| R-I-6 | —H | —$C_4H_9$ (t) | —OH | —H | —H | CHR6 | —H |
| R-I-7 | —H | —$C_4H_9$ (t) | —OH | —H | —H | CHR6 | —$C_3H_7$ |
| R-I-8 | —H | —$CH_3$ | —OH | —$C_4H_9$ (t) | —H | CHR6 | —TMB |
| R-I-9 | —H | —$C_2H_5$ | —OH | —$C_4H_9$ (t) | —H | CHR6 | —H |
| R-I-10 | —H | —$CH_3$ | —OH | —$C_2H_5$ | —H | CHR6 | —TMB |
| R-I-11 | —H | —$CH_3$ | —OH | —$CH_3$ | —H | S | — |
| R-I-12 | —H | —$CH_3$ | —OH | —$CH_3$ | —Cl | S | — |
| R-I-13 | —H | —$CH_3$ | —OH | —$C_2H_5$ | —Cl | S | — |
| R-I-14 | —H | —$C_2H_5$ | —OH | —$C_2H_5$ | —H | S | — |
| R-I-15 | —H | —$C_2H_5$ | —OH | —$CH_3$ | —Cl | S | — |
| R-I-16 | —H | —$CH_3$ | —OH | —$C_4H_9$ (t) | —H | S | — |
| R-I-17 | —H | —CHex | —OH | —$C_4H_9$ (t) | —H | S | — |

TMB: 1,3,3-trimethylbutyl group
CPen: cyclopentyl group
CHex: cyclohexyl group

TABLE 24

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-18 | —OH | —$CH_3$ | —H | —$CH_3$ | —H | —H | —$CH_3$ | —OH | —$CH_3$ | —H | CH-R6 | —H |
| R-I-19 | —OH | —$C_4H_9$(t) | —H | —$CH_3$ | —H | —H | —$CH_3$ | —OH | —$CH_3$ | —H | CH-R6 | —H |
| R-I-20 | —OH | —$CH_3$ | —H | —$CH_3$ | —H | —H | —CHex | —OH | —$CH_3$ | —H | CH-R6 | —$CH_3$ |
| R-I-21 | —OH | —$C_4H_9$(t) | —H | —$CH_3$ | —H | —H | —$CH_3$ | —OH | —$CH_3$ | —H | CH-R6 | —$CH_3$ |
| R-I-22 | —OH | —$CH_3$ | —H | —$CH_3$ | —H | —H | —$CH_3$ | —OH | —$CH_3$ | —H | CH-R6 | —TMB |
| R-I-23 | —OH | —$C_4H_9$(t) | —H | —$CH_3$ | —H | —H | —$CH_3$ | —OH | —$CH_3$ | —H | CH-R6 | —TMB |
| R-I-24 | —OH | —$CH_3$ | —H | —$CH_3$ | —H | —H | —$CH_3$ | —OH | —$CH_3$ | —H | S | — |
| R-I-25 | —OH | —$C_4H_9$(t) | —H | —$CH_3$ | —H | —H | —$CH_3$ | —OH | —$CH_3$ | —H | S | — |
| R-I-26 | —OH | —$CH_3$ | —H | —$CH_3$ | —H | —H | —CHex | —OH | —$CH_3$ | —H | S | — |
| R-I-27 | 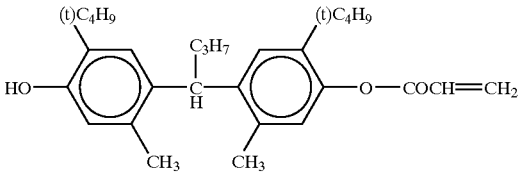 | | | | | | | | | | | |
| R-I-28 | 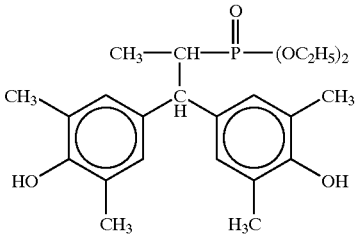 | | | | | | | | | | | |

TABLE 25

| No | $R_1$,$R_{1'}$ | $R_2$,$R_{2'}$ | $R_3$,$R_{3'}$ | $R_4$,$R_{4'}$ | $R_5$,$R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH-R6 | —H | CH-R6' | —$CH_3$ | 1 |
| R-II-2 | —OH | —$CH_3$ | —H | —$CH_3$ | —H | —OH | —$C_2H_5$ | —$CH_3$ | —H | CH-R6 | —TMB | CH-R6' | —$CH_3$ | 1 |
| R-II-3 | —OH | —$C_4H_9$(t) | —H | —$CH_3$ | —H | —OH | —$CH_3$ | —$CH_3$ | —H | CH-R6 | —H | CH-R6' | —TMB | 3 |
| R-II-4 | —OH | —$CH_3$ | —H | —$CH_3$ | —H | —OH | —$C_2H_5$ | —$CH_3$ | —H | CH-R6 | —TMB | CH-R6' | —TMB | 2 |
| R-II-5 | —H | —$C_4H_9$(t) | —OH | —$CH_3$ | —H | —OH | —$CH_3$ | —$CH_3$ | —H | S | — | CH-R6' | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH-R6' | —TMB | 3 |
| R-II-9 | 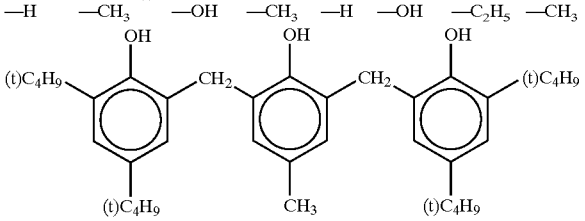 | | | | | | | | | | | | | |
| R-II-10 | 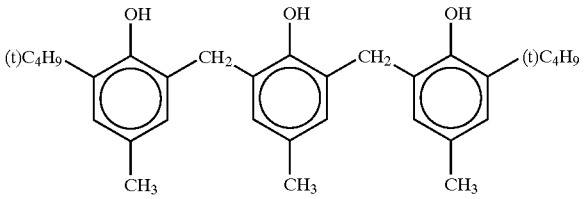 | | | | | | | | | | | | | |

TABLE 25-continued

| No | $R_1$,$R_{1'}$ | $R_2$,$R_{2'}$ | $R_3$,$R_{3'}$ | $R_4$,$R_{4'}$ | $R_5$,$R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-11 | 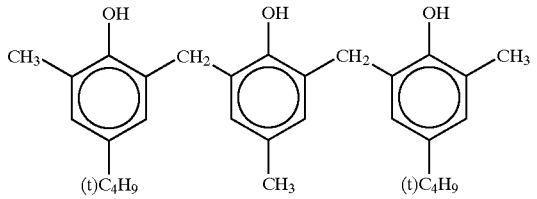 | | | | | | | | | | | | | |
| R-II-12 | 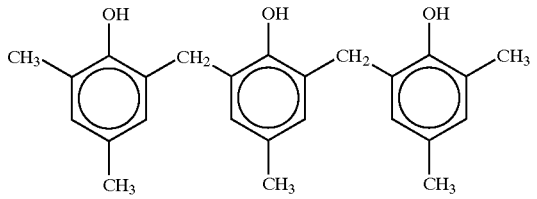 | | | | | | | | | | | | | |

TABLE 26

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group

TABLE 27

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

TABLE 28

| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

TABLE 29

| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |

The reducing agents represented by the general formulae (R-I) to (R-IV) are preferably used in amounts of $1\times10^{-3}$ to 10 mol, more preferably $1\times10^{-2}$ to 1.5 mol per mol of silver.

The compounds of formula (A) and the compounds of formulae (R-I) to (R-IV) may be used alone or in admixture. When they are used in admixture, the auxiliary reducing agent and the main reducing agent are preferably used in a molar ratio between 1/1000 and 1/1, more preferably between 1/100 and 1/1.

The thermographic recording element according to the invention is processed by a heat development process to form photographic images. As described in the preamble, photothermographic elements which constitute one embodiment of the invention are disclosed in U.S. Pat. Nos.

3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The thermographic recording element of the invention which forms photographic images through heat development preferably contains a reducible silver source (e.g., organic silver salt), a catalytic amount of a photocatalyst (e.g., silver halide), a toner for controlling the tone of silver, and a reducing agent, typically dispersed in a binder (typically organic binder) matrix. Although the photothermographic material is stable at room temperature, it is developed merely by heating at an elevated temperature (e.g., 80° C. or higher) after exposure, that is, without a need for a processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

The thermographic recording element of the invention has at least one image forming layer, typically a photo-sensitive layer, on a support. It is acceptable to form only an image forming layer such as a photosensitive layer on a support although it is preferred to form at least one image protective layer such as a non-photosensitive layer on the image forming layer such as the photosensitive layer.

In the photothermographic elements which constitute the preferred embodiment of the invention, in order to control the quantity or wavelength distribution of light transmitted to the photosensitive layer, a filter layer may be formed on the same side as or on the opposite side to the photosensitive layer, or a dyestuff or pigment may be contained in the photosensitive layer. The dyestuff used to this end is preferably selected from the compounds described in Japanese Patent Application No. 11184/1995.

The photosensitive layer serving as the image forming layer may consist of two or more strata. Also a combination of high/low sensitivity strata or low/high sensitivity strata may be used for the adjustment of gradation.

Various additives may be added to any of the image forming layer (typically photosensitive layer), non-image-forming layer (typically non-photosensitive layer), and other layers.

In the thermographic recording element of the invention, various additives such as surfactants, antioxidants, stabilizers, plasticizers, UV absorbers, and coating aids may be used.

Binder

A binder is used to hold such additives. It is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, polylvinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

At least one layer of the image-forming layers used herein may be an image forming layer wherein a polymer latex constitutes more than 50% by weight of the entire binder. This image forming layer is sometimes referred to as "inventive image-forming layer" and the polymer latex used. as the binder therefor is referred to as "inventive polymer latex," hereinafter. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the inventive polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the inventive polymer latex should preferably have an equilibrium moisture content at 25° C. and RH 60% of up to 2% by weight, more preferably up to 1% by weight. The lower limit of equilibrium moisture content is not critical although it is preferably 0.01% by weight, more preferably 0.03% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image-forming layer of the thermographic image recording element of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers. These polymers or polymer latices are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nippon Ink Chemical K.K.) and WD-size and WMS (Eastman Chemical Products, Inc.). Exemplary polyurethane resins are HYDRAN AP10, 20, 30 and 40 (Dai-Nippon Ink Chemical K.K.). Exemplary rubbery resins are LACSTAR 7310K, 3307B, 4700H and 7132C (Dai-Nippon Ink Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the inventive image-forming layer, the polymer latex described above is preferably used in an amount of at least 50% by weight, especially at least 70% by weight, of the entire binder. In the inventive image-forming layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The inventive image-forming layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide or ethyl acetate. Exemplary solvent compositions include water, a 90/10 or 70/30 mixture of water/methanol, a 90/10 mixture of water/ethanol, a 90/10 mixture of water/isopropanol, a 95/5 mixture of water/dimethyl-formamide, a 80/15/5 or 90/5/5 mixture of water/methanol/dimethylformamide, all expressed in a weight ratio. The method described in U.S. Pat. No. 5,496,695 is also useful.

In the inventive image-forming layer, the total amount of binder is preferably 0.2 to 30 g/m$^2$, more preferably 1 to 15 g/m$^2$ per layer. To the image forming layer, crosslinking agents for crosslinking, surfactants for ease of application, and other addenda may be added.

Addition of toners is quite desirable. Preferred toners are disclosed in Research Disclosure No. 17029. Exemplary toners include imides such as phthalimide; cyclic imides such as succinimide, pyrazoline-5-ones, quinazolinone, 3-phenyl-2-pyrazoline-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans such as 3-mercapto-1,2,4-triazole; N-(aminomethyl) aryldicarboxyimides such as N-(dimethylaminomethyl) phthalimide; combinations of a blocked pyrazole, an isothiuronium derivative and a certain optical bleaching agent such as a combination of N,N'-hexamethylenebis(1-carbamoyl-3,5-dimethylpyrazole), 1,8-(3,6-dioxaoctane)bis (isothiuroniumtrifluoroacetate) and 2-tribromomethylsulfonyl-benzothiazole; merocyanine dyes such as 3-ethyl-5-{(3-ethyl-2-benzothiazolinylidene)-1-methylethylidene}-2-thio-2,4-oxazolidinedione; phthalazinones, phthalazinone derivatives or metal salts thereof such as 4-(1-naphthyl)phthalazinone, 6-chlorophthalazinone, 5,7-dimethyloxyphthalazinone and 2,3-dihydro-1,4-phthalazinedione; combinations of phthalazinones with sulfinic acid derivatives such as a combination of 6-chlorophthalazinone with sodium benzenesulfinate and a combination of 8-methylphthalazinone with sodium p-trisulfonate; combinations of phthalazines with phthalic acid; combinations of phthalazines (inclusive of phthalazine adducts) with maleic anhydride and at least one of phthalic acid, 2,3-naphthalenedicarboxylic acid and o-phenylenic acid derivative and anhydrides thereof (e.g., phthalic acid, 4-methylphthalic acid, 4-nitrophthalic acid, and tetrachlorophthalic anhydride); quinazolinediones, benzoxazine, and naphthoxazine derivatives; benzoxazine-2,4-diones such as 1,3-benzoxazine-2,4-dione; pyrimidine and asym-triazines such as 2,4-dihydroxypyrimidine; and tetraazapentalene derivatives such as 3,6-dimercapto-1,4-diphenyl-1H,4H-2,3a,5,6a-tetraazapentalene. Phthalazones are preferred toners.

The silver halide which is useful as a catalytic amount of photocatalyst in the photothermographic element according to the preferred embodiment of the invention may be selected from photosensitive silver halides such as silver bromide, silver iodide, silver chloride, silver chlorobromide, silver iodobromide, and silver chloroiodobromide, with an iodide ion being preferably contained. The silver halide may be added to the image forming layer by any desired method whereupon the silver halide is disposed close to the reducible silver source. In general, the silver halide is preferably contained in an amount of 0.75 to 30% by weight based on the reducible silver source. The silver halide may be prepared by converting a silver soap moiety through reaction with a halide ion, or by preforming silver halide and adding it upon generation of a soap, or a combination of these methods. The latter method is preferred.

The reducible silver source is preferably selected from silver salts of organic and hetero-organic acids containing a reducible silver ion source, especially silver salts of long chain aliphatic carboxylic acids having 10 to 30 carbon atoms, especially 15 to 25 carbon atoms. Also preferred are complexes of organic or inorganic silver salts with ligands having an overall stability constant to silver ion in the range of 4.0 to 10.0. Preferred examples of the silver salt are described in Research Disclosure Nos. 17029 and 29963. Included are silver salts of organic acids (e.g., gallic acid, oxalic acid, behenic acid, stearic acid, palmitic acid, and lauric acid); silver salts of carboxyalkylthio-ureas (e.g., 1-(3-carboxypropyl)thiourea and 1-(3-carboxy-propyl)-3,3-dimethylthiourea); silver complexes of polymeric reaction products of aldehydes and hydroxy-substituted aromatic carboxylic acids (exemplary aldehydes are formaldehyde, acetaldehyde and butylaldehyde and exemplary hydroxy-substituted acids are salicylic acid, benzoic acid, 3,5-dihydroxybenzoic acid, and 5,5-thiodisalicylic acid); silver salts or complexes of thioenes (e.g., 3-(2-carboxy-ethyl)-4-hydroxymethyl-4-(thiazoline-2-thioene and 3-carboxymethyl-4-thiazoline-2-thioene); silver complexes or salts of nitrogenous acids such as imidazoles, pyrazoles, urazoles, 1,2,4-thiazoles, 1H-tetrazoles, 3-amino-5-benzylthio-1,2,4-triazoles, and benzotriazoles; silver salts of saccharin and 5-chlorosalicylaldoxime; and silver salts of mercaptides. The preferred silver source is silver behenate. The reducible silver source is preferably used in an amount of up to 3 g/m$^2$, more preferably up to 2 g/m$^2$ of silver. The lower limit is usually 0.1 g/m$^2$, though not critical.

An antifoggant may be contained in the thermographic recording element according to the invention. The most effective antifoggant was mercury ion. Use of a mercury compound as the antifoggant in photosensitive material is disclosed, for example, in U.S. Pat. No. 3,589,903. Mercury compounds, however, are undesirable from the ecological aspect. Preferred in this regard are non-mercury antifoggants as disclosed, for example, in U.S. Pat. Nos. 4,546,075 and 4,452,885 and JP-A 57234/1984.

Especially preferred non-mercury antifoggants are compounds as disclosed in U.S. Pat. Nos. 3,874,946 and 4,756,999 and heterocyclic compounds having at least one substituent represented by —C($X^1$) ($X^2$) ($X^3$) wherein $X^1$ and $X^2$ are halogen atoms such as F, Cl, Br, and I, and $X^3$ is hydrogen or halogen. Preferred examples of the antifoggant are shown below.

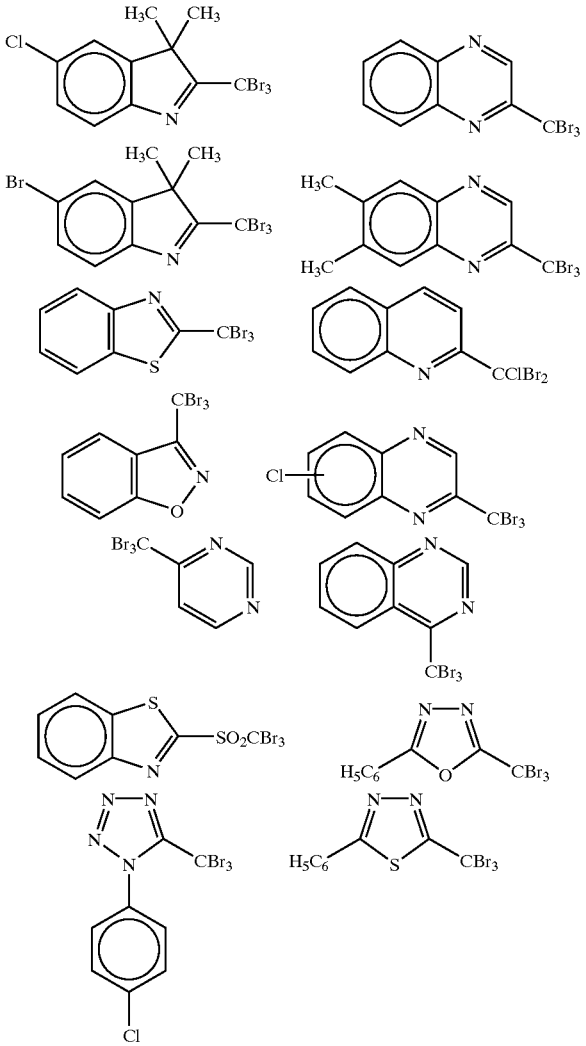

-continued

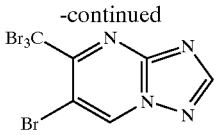

More preferred antifoggants are disclosed in U.S. Pat. No. 5,028,523, British Patent Application Nos. 92221383.4, 9300147.7 and 9311790.1.

In the photothermographic material according to the preferred embodiment of the invention, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,455, 4,741,966, 4,751,175, and 4,835,096.

Useful sensitizing dyes which can be used herein are described in Research Disclosure, Item 17643 IV-A (December 1978, page 23), ibid., Item 1831 X (August 1978, page 437) and the references cited therein.

It is advantageous to select a sensitizing dye having appropriate spectral sensitivity to the spectral properties of a particular light source of various scanners. Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He—Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

For exposure of the photothermographic material of the invention, an Ar laser (488 nm), He—Ne laser (633 nm), red semiconductor laser (670 nm), and infrared semiconductor laser (780 nm and 830 nm) are preferably used.

A dyestuff-containing layer may be included as an antihalation layer in the photothermographic material of the invention. For Ar laser, He—Ne laser, and red semiconductor laser light sources, a dyestuff is preferably added so as to provide an absorbance of at least 0.3, more preferably at least 0.8 at an exposure wavelength in the range of 400 to 750 nm. For infrared semiconductor laser light sources, a dyestuff is preferably added so as to provide an absorbance of at least 0.3, more preferably at least 0.8 at an exposure wavelength in the range of 750 to 1500 nm. The dyestuffs may be used alone or in admixture of two or more. The dyestuff may be added to a dyestuff layer disposed on the same side as the photosensitive layer adjacent to the support or a dyestuff layer disposed on the support opposite to the photosensitive layer.

Various supports are used in the invention. Useful supports are paper, synthetic paper, synthetic resin-laminated paper (exemplary synthetic resins being polyethylene, polypropylene and polystyrene), plastic films (e.g., polyethylene terephthalate, polycarbonate, polyimide, nylon, and cellulose triacetate), metal sheets (e.g., aluminum, aluminum alloys, zinc, iron and copper), paper sheets and plastic films having such metals laminated or evaporated thereon.

When plastic film is passed through a thermographic processor, the film experiences dimensional shrinkage or expansion. When the thermographic recording element is intended for printing purposes, this dimensional shrinkage or expansion gives rise to a serious problem against precision multi-color printing. Therefore, the invention favors the use of a film experiencing a minimal dimensional change. Exemplary materials are styrene polymers having a syndiotactic structure and heat-treated polyethylene. Also useful are materials having a high glass transition temperature, for example, polyether ethyl ketone, poly-styrene, polysulfone, polyether sulfone, and polyarylate.

EXAMPLE

Examples of the invention are given below by way of illustration and not by way of limitation.

The trade names used in Examples have the following meaning.

Denka Butyral: polyvinyl butyral by Denki Kagaku Kogyo K.X.

CAB 171-15S: cellulose acetate butyrate by Eastman Chemical Products, Inc.

Sildex: spherical silica by Dokai Chemical K.K.

Sumidur N3500: polyisocyanate by Sumitomo-Bayern Urethane K.K.

Megafax F-176P: fluorinated surfactant by Dai-Nippon Ink Chemicals K.K.

LACSTAR 3307B: styrene-butadiene rubber (SBR) latex by Dai-Nippon Ink Chemicals K.K. The polymer has an equilibrium moisture content of 0.6 wt % at 25° C. and RH 60% and the dispersed particles have a mean particle diameter of about 0.1 to 0.15 μm.

Example 1

Organic Silver Salt Emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide (C-12) was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate/stearate and silver bromide, which was dispersed in 1,800 grams of a 2.6% 2-butanone solution of polyvinyl butyral (Denka Butyral #3000-K). The dispersion was further dispersed in 600grams of polyvinyl butyral (Denka Butyral #4000-2) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Emulsion Layer Coating Solution A

The following chemicals were added to the above-prepared organic acid silver salt emulsion A in amounts per mol of silver. With stirring at 25° C., 10 mg of sodium phenylthiosulfonate, 20 mg of Sensitizing Dye A, 25 mg of Sensitizing Dye B, 15 mg of Sensitizing Dye C, 2 grams of 2-mercapto-5-methylbenzimidazole (C-1), 1 gram of 2-mercapto-5-methylbenzothiazole (C-2), 21.5 grams of 4-chlorobenzophenone-2-carboxylic acid (C-3), 580 grams of 2-butanone and 220 grams of dimethylformamide were added to the emulsion, which was allowed to stand for 3 hours. With stirring, 4.5 grams of 4,6-ditrichloromethyl-2-phenyltriazine (C-4), 2 grams of Disulfide compound A, 160 grams of 1,1-bis(2-hydroxy-3,5-dimethylphenyl)-3,5,5-trimethylhexane (C-5), 15 grams of phthalazine (C-6), 5 grams of tetrachlorophthalic acid (C-7), an amount of a hydrazine derivative as shown in Table 30, an amount of a compound of formula (1) to (14) or a comparative compound as shown in Table 30, 1.1 grams of fluorinated surfactant Megafax F-176P, 590 grams of 2-butanone, and 10 grams of methyl isobutyl ketone were added to the emulsion.

Emulsion Surface Protective Layer Coating Solution A

A coating solution A for an emulsion layer surface protective layer was prepared by dissolving 75 grams of cellulose acetate butyrate CAB 171-15S, 5.7 grams of 4-methylphthalic acid (C-8), 1.5 grams of tetrachlorophthalic anhydride (C-9), 10 grams of 2-tribromomethylsulfonyl-benzothiazole (C-10), 2 grams of phthalazone (C-11), 0.3 gram of Megafax F-176P, 2 grams of spherical silica Sildex H31 (mean size 3 μm), and 5 grams of polyisocyanate Sumidur N3500 in 3070 grams of 2-butanone and 30 grams of ethyl acetate.

Preparation of Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff A in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 633 nm.

On the thus prepared support, the emulsion layer coating solution was coated so as to give a coverage of 2 g/m$^2$ of silver, and the emulsion layer protective layer coating solution was then coated on the emulsion layer so as to give a dry thickness of 5 μm, obtaining a coated sample.

Some of the compounds used in this Example are shown below by structural formulae. They are also used in Examples 2 and 7. For the sake of convenience, the structural formulae of compounds used in Examples 2 and 7 are also shown here.

Sensitizing Dye A
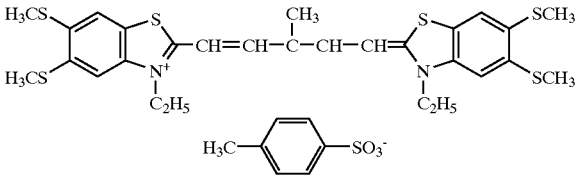
Sensitizing Dye B
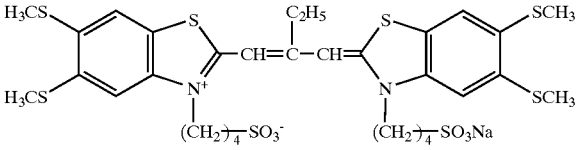
Sensitizing Dye C
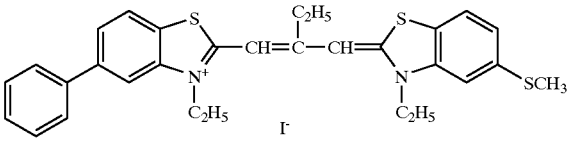
Dyestuff A
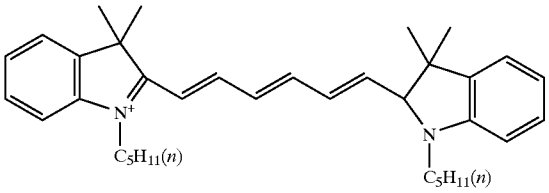
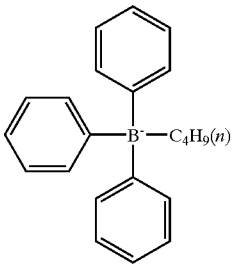
(C-1)
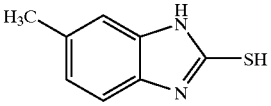
(C-2)
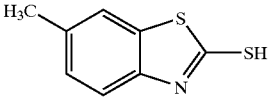
(C-3)
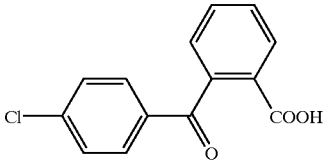
-continued
(C-4)
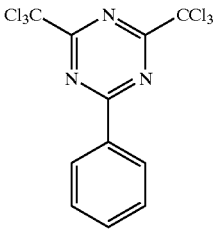
(C-5)
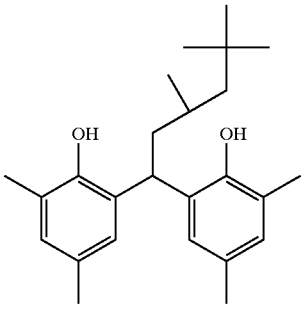
(C-6)
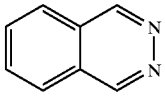
(C-7)
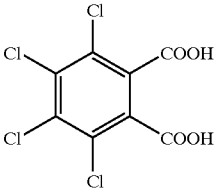
(C-8)
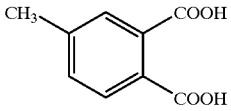
(C-9)
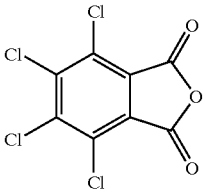
(C-10)
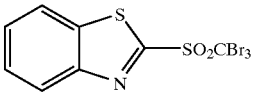
(C-11)
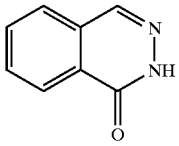

-continued (C-12)

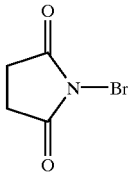

(C-13)

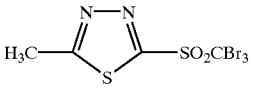

(C-14)

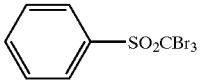

Disulfide Compound A

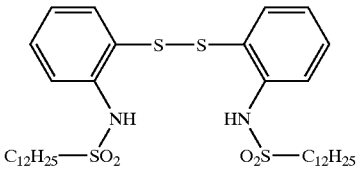

Photographic Property Test

The recording element samples prepared above were exposed by means of a helium-neon light source color scanner SG-608 (by Dai-Nippon Screen K.K.) and heated for development at 115° C. for 25 seconds on a heat drum. They were further exposed to a halogen lamp for 15 seconds. The resulting images were determined for Dmax and sensitivity by a densitometer. The sensitivity (S) is the reciprocal of a ratio of the exposure providing a density of Dmin +1.5. The gradient of a straight line connecting points of density 0.3 and 3.0 on a characteristic curve is also reported as gradation (γ). The results are shown in Table 30.

Black Pepper Rating

The unexposed recording element samples were heated for development at 120° C. for 60 seconds on a heat drum. By visually observing the number of black peppers generated, the samples were rated on a 5-point scale with "5" for best quality and "1" for worst quality. Rating "3" is the practically acceptable limit, and samples rated "2" and "1" are unacceptable. The results are shown in Table 30.

TABLE 30

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 1a | $2.4 \times 10^{-3}$ | — | — | 3.4 | 1.16 | 12.1 | 2 |
| 3* | 54a | $2.0 \times 10^{-3}$ | — | — | 3.8 | 1.30 | 13.6 | 3 |
| 4* | 56a | $1.8 \times 10^{-3}$ | — | — | 3.8 | 1.30 | 13.6 | 3 |
| 5* | 56m | $7.2 \times 10^{-3}$ | — | — | 3.6 | 1.23 | 12.9 | 2 |
| 6* | 58a | $1.4 \times 10^{-3}$ | — | — | 3.9 | 1.33 | 13.9 | 3 |
| 7* | 66a | $8.0 \times 10^{-3}$ | — | — | 3.5 | 1.20 | 12.5 | 2 |
| 8* | 95-1 | $6.0 \times 10^{-3}$ | — | — | 3.7 | 1.27 | 13.2 | 2 |
| 9* | 104x | $1.8 \times 10^{-3}$ | — | — | 3.5 | 1.20 | 12.5 | 2 |
| 10* | 106-10 | $9.0 \times 10^{-3}$ | — | — | 3.6 | 1.23 | 12.9 | 2 |
| 11* | 118 | $9.5 \times 10^{-3}$ | — | — | 3.4 | 1.16 | 12.1 | 2 |
| 12* | 1a | $2.4 \times 10^{-3}$ | VC-1 | $1.9 \times 10^{-3}$ | 3.6 | 1.22 | 12.3 | 2 |
| 13* | 54a | $2.0 \times 10^{-3}$ | VC-1 | $1.6 \times 10^{-3}$ | 4.0 | 1.37 | 14.3 | 3 |
| 14* | 56a | $1.8 \times 10^{-3}$ | VC-1 | $1.4 \times 10^{-3}$ | 4.0 | 1.37 | 14.3 | 3 |
| 15* | 56m | $7.2 \times 10^{-3}$ | VC-1 | $5.8 \times 10^{-3}$ | 3.8 | 1.29 | 13.5 | 3 |
| 16* | 58a | $1.4 \times 10^{-3}$ | VC-1 | $1.1 \times 10^{-3}$ | 4.1 | 1.40 | 14.6 | 3 |
| 17* | 66a | $8.0 \times 10^{-3}$ | VC-1 | $6.4 \times 10^{-3}$ | 3.7 | 1.26 | 13.1 | 2 |
| 18* | 95-1 | $6.0 \times 10^{-3}$ | VC-1 | $4.8 \times 10^{-3}$ | 3.9 | 1.33 | 13.9 | 3 |
| 19* | 104x | $1.8 \times 10^{-3}$ | VC-1 | $1.4 \times 10^{-3}$ | 3.7 | 1.26 | 13.1 | 2 |
| 20* | 106-10 | $9.0 \times 10^{-3}$ | VC-1 | $7.2 \times 10^{-3}$ | 3.8 | 1.29 | 13.5 | 3 |
| 21* | 118 | $9.5 \times 10^{-3}$ | VC-1 | $7.6 \times 10^{-3}$ | 3.6 | 1.22 | 12.8 | 2 |
| 22** | 1a | $2.4 \times 10^{-3}$ | 1 | $1.7 \times 10^{-3}$ | 4.1 | 1.40 | 14.6 | 4 |
| 23** | 54a | $2.0 \times 10^{-3}$ | 1 | $1.4 \times 10^{-3}$ | 4.6 | 1.56 | 16.3 | 5 |
| 24** | 56a | $1.8 \times 10^{-3}$ | 1 | $1.3 \times 10^{-3}$ | 4.6 | 1.56 | 16.3 | 5 |
| 25** | 56m | $7.2 \times 10^{-3}$ | 1 | $5.0 \times 10^{-3}$ | 4.3 | 1.48 | 15.4 | 5 |
| 26** | 58a | $1.4 \times 10^{-3}$ | 1 | $1.0 \times 10^{-3}$ | 4.7 | 1.60 | 16.7 | 5 |
| 27** | 66a | $8.0 \times 10^{-3}$ | 1 | $5.6 \times 10^{-3}$ | 4.2 | 1.44 | 15.0 | 4 |
| 28** | 95-1 | $6.0 \times 10^{-3}$ | 1 | $4.2 \times 10^{-3}$ | 4.4 | 1.52 | 15.9 | 5 |
| 29** | 104x | $1.8 \times 10^{-3}$ | 1 | $1.3 \times 10^{-3}$ | 4.2 | 1.44 | 15.0 | 4 |
| 30** | 106-10 | $9.0 \times 10^{-3}$ | 1 | $6.3 \times 10^{-3}$ | 4.3 | 1.48 | 15.4 | 5 |
| 31** | 118 | $9.5 \times 10^{-3}$ | 1 | $6.7 \times 10^{-3}$ | 4.1 | 1.40 | 14.6 | 4 |
| 32** | 1a | $2.4 \times 10^{-3}$ | 63 | $1.7 \times 10^{-3}$ | 4.1 | 1.39 | 14.5 | 4 |
| 33** | 54a | $2.0 \times 10^{-3}$ | 63 | $1.4 \times 10^{-3}$ | 4.5 | 1.55 | 16.2 | 5 |
| 34** | 56a | $1.8 \times 10^{-3}$ | 63 | $1.3 \times 10^{-3}$ | 4.5 | 1.55 | 16.2 | 5 |
| 35** | 56m | $7.2 \times 10^{-3}$ | 63 | $5.2 \times 10^{-3}$ | 4.3 | 1.47 | 15.4 | 5 |
| 36** | 58a | $1.4 \times 10^{-3}$ | 63 | $1.0 \times 10^{-3}$ | 4.7 | 1.59 | 16.6 | 5 |
| 37** | 66a | $8.0 \times 10^{-3}$ | 63 | $5.8 \times 10^{-3}$ | 4.2 | 1.43 | 14.9 | 4 |
| 38** | 95-1 | $6.0 \times 10^{-3}$ | 63 | $4.3 \times 10^{-3}$ | 4.4 | 1.51 | 15.3 | 5 |
| 39** | 104x | $1.8 \times 10^{-3}$ | 63 | $1.3 \times 10^{-3}$ | 4.2 | 1.43 | 14.9 | 4 |

TABLE 30-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 40** | 106-10 | $9.0 \times 10^{-3}$ | 63 | $6.5 \times 10^{-3}$ | 4.3 | 1.47 | 15.4 | 5 |
| 41** | 118 | $9.5 \times 10^{-3}$ | 63 | $6.8 \times 10^{-3}$ | 4.1 | 1.39 | 14.5 | 4 |
| 42** | 1a | $2.4 \times 10^{-3}$ | 7 | $1.6 \times 10^{-3}$ | 4.0 | 1.38 | 14.4 | 4 |
| 43** | 54a | $2.0 \times 10^{-3}$ | 7 | $1.4 \times 10^{-3}$ | 4.5 | 1.54 | 16.1 | 5 |
| 44** | 56a | $1.8 \times 10^{-3}$ | 7 | $1.2 \times 10^{-3}$ | 4.5 | 1.54 | 16.1 | 5 |
| 45** | 56m | $7.2 \times 10^{-3}$ | 7 | $4.9 \times 10^{-3}$ | 4.3 | 1.46 | 15.2 | 4 |
| 46** | 58a | $1.4 \times 10^{-3}$ | 7 | $1.0 \times 10^{-3}$ | 4.6 | 1.58 | 16.5 | 5 |
| 47** | 66a | $8.0 \times 10^{-3}$ | 7 | $5.4 \times 10^{-3}$ | 4.1 | 1.42 | 14.8 | 4 |
| 48** | 95-1 | $6.0 \times 10^{-3}$ | 7 | $4.1 \times 10^{-3}$ | 4.4 | 1.50 | 15.7 | 5 |
| 49** | 104x | $1.8 \times 10^{-3}$ | 7 | $1.2 \times 10^{-3}$ | 4.1 | 1.42 | 14.8 | 4 |
| 50** | 106-10 | $9.0 \times 10^{-3}$ | 7 | $6.1 \times 10^{-3}$ | 4.3 | 1.46 | 15.2 | 4 |
| 51** | 118 | $9.5 \times 10^{-3}$ | 7 | $6.5 \times 10^{-3}$ | 4.0 | 1.38 | 14.4 | 4 |
| 52** | 1a | $2.4 \times 10^{-3}$ | 14 | $1.7 \times 10^{-3}$ | 4.0 | 1.37 | 14.6 | 4 |
| 53** | 54a | $2.0 \times 10^{-3}$ | 14 | $1.4 \times 10^{-3}$ | 4.6 | 1.56 | 16.0 | 5 |
| 54** | 56a | $1.8 \times 10^{-3}$ | 14 | $1.3 \times 10^{-3}$ | 4.6 | 1.53 | 16.0 | 5 |
| 55** | 56m | $7.2 \times 10^{-3}$ | 14 | $5.2 \times 10^{-3}$ | 4.2 | 1.45 | 15.1 | 4 |
| 56** | 58a | $1.4 \times 10^{-3}$ | 14 | $1.0 \times 10^{-3}$ | 4.6 | 1.57 | 16.4 | 5 |
| 57** | 66a | $8.0 \times 10^{-3}$ | 14 | $5.8 \times 10^{-3}$ | 4.1 | 1.41 | 14.7 | 4 |
| 58** | 95-1 | $6.0 \times 10^{-3}$ | 14 | $4.3 \times 10^{-3}$ | 4.4 | 1.49 | 15.6 | 5 |
| 59** | 104x | $1.8 \times 10^{-3}$ | 14 | $1.3 \times 10^{-3}$ | 4.1 | 1.41 | 14.7 | 4 |
| 60** | 106-10 | $9.0 \times 10^{-3}$ | 14 | $6.5 \times 10^{-3}$ | 4.2 | 1.45 | 15.1 | 4 |
| 61** | 118 | $9.5 \times 10^{-3}$ | 14 | $6.8 \times 10^{-3}$ | 4.0 | 1.37 | 14.3 | 4 |
| 62** | 1a | $2.4 \times 10^{-3}$ | 37 | $1.6 \times 10^{-3}$ | 4.0 | 1.38 | 14.4 | 4 |
| 63** | 54a | $2.0 \times 10^{-3}$ | 37 | $1.4 \times 10^{-3}$ | 4.5 | 1.55 | 16.1 | 5 |
| 64** | 56a | $1.8 \times 10^{-3}$ | 37 | $1.2 \times 10^{-3}$ | 4.5 | 1.55 | 16.1 | 5 |
| 65** | 56m | $7.2 \times 10^{-3}$ | 37 | $4.9 \times 10^{-3}$ | 4.3 | 1.46 | 15.3 | 4 |
| 66** | 58a | $1.4 \times 10^{-3}$ | 37 | $1.0 \times 10^{-3}$ | 4.6 | 1.59 | 16.6 | 5 |
| 67** | 66a | $8.0 \times 10^{-3}$ | 37 | $5.4 \times 10^{-3}$ | 4.2 | 1.42 | 14.9 | 4 |
| 68** | 95-1 | $6.0 \times 10^{-3}$ | 37 | $4.1 \times 10^{-3}$ | 4.4 | 1.51 | 15.7 | 5 |
| 69** | 104x | $1.8 \times 10^{-3}$ | 37 | $1.2 \times 10^{-3}$ | 4.2 | 1.42 | 14.9 | 4 |
| 70** | 106-10 | $9.0 \times 10^{-3}$ | 37 | $6.1 \times 10^{-3}$ | 4.3 | 1.46 | 15.3 | 4 |
| 71** | 118 | $9.5 \times 10^{-3}$ | 37 | $6.5 \times 10^{-3}$ | 4.0 | 1.38 | 14.4 | 4 |
| 72** | 1a | $2.4 \times 10^{-3}$ | 39 | $1.9 \times 10^{-3}$ | 4.1 | 1.39 | 14.5 | 4 |
| 73** | 54a | $2.0 \times 10^{-3}$ | 39 | $1.6 \times 10^{-3}$ | 4.5 | 1.55 | 16.2 | 5 |
| 74** | 56a | $1.8 \times 10^{-3}$ | 39 | $1.4 \times 10^{-3}$ | 4.5 | 1.55 | 16.2 | 5 |
| 75** | 56m | $7.2 \times 10^{-3}$ | 39 | $5.6 \times 10^{-3}$ | 4.3 | 1.47 | 15.4 | 5 |
| 76** | 58a | $1.4 \times 10^{-3}$ | 39 | $1.1 \times 10^{-3}$ | 4.7 | 1.60 | 16.7 | 5 |
| 77** | 66a | $8.0 \times 10^{-3}$ | 39 | $6.2 \times 10^{-3}$ | 4.2 | 1.43 | 15.0 | 4 |
| 78** | 95-1 | $6.0 \times 10^{-3}$ | 39 | $4.7 \times 10^{-3}$ | 4.4 | 1.51 | 15.8 | 5 |
| 79** | 104x | $1.8 \times 10^{-3}$ | 39 | $1.4 \times 10^{-3}$ | 4.2 | 1.43 | 15.0 | 4 |
| 80** | 106-10 | $9.0 \times 10^{-3}$ | 39 | $7.0 \times 10^{-3}$ | 4.3 | 1.47 | 15.4 | 5 |
| 81** | 118 | $9.5 \times 10^{-3}$ | 39 | $7.4 \times 10^{-3}$ | 4.1 | 1.39 | 14.5 | 4 |
| 82** | 1a | $2.4 \times 10^{-3}$ | 41 | $1.8 \times 10^{-3}$ | 4.0 | 1.38 | 14.4 | 4 |
| 83** | 54a | $2.0 \times 10^{-3}$ | 41 | $1.5 \times 10^{-3}$ | 4.5 | 1.55 | 16.1 | 5 |
| 84** | 56a | $1.8 \times 10^{-3}$ | 41 | $1.3 \times 10^{-3}$ | 4.5 | 1.55 | 16.1 | 5 |
| 85** | 56m | $7.2 \times 10^{-3}$ | 41 | $5.3 \times 10^{-3}$ | 4.3 | 1.46 | 15.3 | 4 |
| 86** | 58a | $1.4 \times 10^{-3}$ | 41 | $1.0 \times 10^{-3}$ | 4.6 | 1.59 | 16.6 | 5 |
| 87** | 66a | $8.0 \times 10^{-3}$ | 41 | $5.9 \times 10^{-3}$ | 4.2 | 1.42 | 14.9 | 4 |
| 88** | 95-1 | $6.0 \times 10^{-3}$ | 41 | $4.4 \times 10^{-3}$ | 4.4 | 1.51 | 15.7 | 5 |
| 89** | 104x | $1.8 \times 10^{-3}$ | 41 | $1.3 \times 10^{-3}$ | 4.2 | 1.42 | 14.9 | 4 |
| 90** | 106-10 | $9.0 \times 10^{-3}$ | 41 | $6.7 \times 10^{-3}$ | 4.3 | 1.46 | 15.3 | 4 |
| 91** | 118 | $9.5 \times 10^{-3}$ | 41 | $7.0 \times 10^{-3}$ | 4.0 | 1.38 | 14.4 | 4 |

*comparison
**invention

VC-1

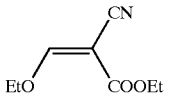

It is evident from Table 30 that using hydrazine derivatives within the scope of the invention and compounds of formulae (1) to (14), thermographic recording elements satisfying all the requirements of high Dmax, high contrast, and minimal black pepper are obtained.

Example 2

Silver Halide Grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_3[IrCl_6]$ were added over 10 minutes by the controlled double jet method while maintaining the solution at pAg 7.7. Note that $[IrCl_6]^{3-}$ was added in an amount of $3\times10^{-7}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Organic Acid Silver Emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide (C-12) was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a ½ solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining a silver behenate emulsion B of needle grains having a mean minor diameter of 0.04 μm, a mean major diameter of 1 μm and a coefficient of variation of 30%.

Emulsion Layer Coating Solution B

The following chemicals were added to the above-prepared organic acid silver salt emulsion B in amounts per mol of silver. With stirring at 25° C., 10 mg of sodium phenylthiosulfonate, 25 mg of Sensitizing Dye A, 20 mg of Sensitizing Dye B, 18 mg of Sensitizing Dye C, 2 grams of 2-mercapto-5-methylbenzimidazole (C-1), 21.5 grams of 4-chlorobenzophenone-2-carboxylic acid (C-3), 580 grams of 2-butanone and 220 grams of dimethylformamide were added to the emulsion, which was allowed to stand for 3 hours. With stirring, 4 grams of 4,6-ditrichloromethyl-2-phenyltriazine (C-4), 2 grams of Disulfide compound A, 170 grams of 1,1-bis(2-hydroxy-3,5-dimethylphenyl)-3,5,5-trimethylhexane (C-5), 15 grams of phthalazine (C-6), 5 grams of tetrachloro-phthalic acid (C-7), an amount of a hydrazine derivative as shown in Table 31, 1.1 grams of Megafax F-176P, 590 grams of 2-butanone, and 10 grams of methyl isobutyl ketone were added to the emulsion.

Emulsion Surface Protective Layer Coating Solution B

A coating solution B for an emulsion layer surface protective layer was prepared by dissolving 75 grams of CAB 171-15S, 5.7 grams of 4-methylphthalic acid (C-8), 1.5 grams of tetrachlorophthalic anhydride (C-9), 8 grams of 5-tribromomethylsulfonyl-2-methylthiadiazole (C-13), 6 grams of 2-tribromomethylsulfonylbenzothiazole (C-10), 3 grams of phthalazone (C-11), 0.3 gram of Megafax F-176P, an amount of a compound of formula (1) to (14) or a comparative compound as shown in Table 31, 2 grams of spherical silica Sildex H31 (mean size 3 μm), and 6 grams of polyisocyanate Sumidur N3500 in 3070 grams of 2-butanone and 30 grams of ethyl acetate.

Preparation of Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff A in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 688 nm.

On the thus prepared support, the emulsion layer coating solution was coated so as to give a coverage of 2 g/m$^2$ of silver and the emulsion layer protective layer coating solution was then coated on the emulsion layer so as to give a dry thickness of 5 μm, obtaining a coated sample of thermographic recording element.

Photographic Property/black Pepper Tests

The samples were determined for photographic properties and black pepper as in Example 1. The results are shown in Table 31.

TABLE 31

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 2b | $1.8 \times 10^{-3}$ | — | — | 3.5 | 1.20 | 12.5 | 2 |
| 3* | 31a | $1.9 \times 10^{-3}$ | — | — | 3.9 | 1.33 | 13.9 | 3 |
| 4* | 34a | $1.6 \times 10^{-3}$ | — | — | 3.8 | 1.30 | 13.6 | 3 |
| 5* | 54a | $2.0 \times 10^{-3}$ | — | — | 3.7 | 1.27 | 13.2 | 2 |
| 6* | 55r | $6.0 \times 10^{-3}$ | — | — | 3.9 | 1.33 | 13.9 | 3 |
| 7* | 56a | $1.8 \times 10^{-3}$ | — | — | 3.6 | 1.23 | 12.9 | 2 |
| 8* | 72x | $9.5 \times 10^{-3}$ | — | — | 3.7 | 1.27 | 13.2 | 2 |
| 9* | 83 | $2.2 \times 10^{-3}$ | — | — | 3.6 | 1.23 | 12.9 | 2 |
| 10* | 95-1 | $5.0 \times 10^{-3}$ | — | — | 3.6 | 1.23 | 12.9 | 2 |

TABLE 31-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 11* | 109m | $9.8 \times 10^{-3}$ | — | — | 3.5 | 1.20 | 12.5 | 2 |
| 12* | 2b | $1.8 \times 10^{-3}$ | VC-2 | $1.6 \times 10^{-3}$ | 3.7 | 1.26 | 13.2 | 2 |
| 13* | 31a | $1.9 \times 10^{-3}$ | VC-2 | $1.7 \times 10^{-3}$ | 4.1 | 1.41 | 14.7 | 3 |
| 14* | 34a | $1.6 \times 10^{-3}$ | VC-2 | $1.4 \times 10^{-3}$ | 4.0 | 1.37 | 14.3 | 3 |
| 15* | 54a | $2.0 \times 10^{-3}$ | VC-2 | $1.8 \times 10^{-3}$ | 3.9 | 1.34 | 13.9 | 3 |
| 16* | 55r | $6.0 \times 10^{-3}$ | VC-2 | $5.4 \times 10^{-3}$ | 4.1 | 1.41 | 14.7 | 3 |
| 17* | 56a | $1.8 \times 10^{-3}$ | VC-2 | $1.6 \times 10^{-3}$ | 3.8 | 1.30 | 13.6 | 3 |
| 18* | 72x | $9.5 \times 10^{-3}$ | VC-2 | $8.6 \times 10^{-3}$ | 3.9 | 1.34 | 13.9 | 3 |
| 19* | 83 | $2.2 \times 10^{-3}$ | VC-2 | $2.0 \times 10^{-3}$ | 3.8 | 1.30 | 13.6 | 3 |
| 20* | 95-1 | $5.0 \times 10^{-3}$ | VC-2 | $4.5 \times 10^{-3}$ | 3.8 | 1.30 | 13.6 | 3 |
| 21* | 109m | $9.8 \times 10^{-3}$ | VC-2 | $8.8 \times 10^{-3}$ | 3.7 | 1.26 | 13.2 | 2 |
| 22** | 2b | $1.8 \times 10^{-3}$ | 2 | $1.4 \times 10^{-3}$ | 4.2 | 1.42 | 14.9 | 4 |
| 23** | 31a | $1.9 \times 10^{-3}$ | 2 | $1.5 \times 10^{-3}$ | 4.6 | 1.59 | 16.6 | 5 |
| 24** | 34a | $1.6 \times 10^{-3}$ | 2 | $1.3 \times 10^{-3}$ | 4.5 | 1.55 | 16.2 | 5 |
| 25** | 54a | $2.0 \times 10^{-3}$ | 2 | $1.6 \times 10^{-3}$ | 4.4 | 1.51 | 15.7 | 5 |
| 26** | 55r | $6.0 \times 10^{-3}$ | 2 | $4.8 \times 10^{-3}$ | 4.6 | 1.59 | 16.6 | 5 |
| 27** | 56a | $1.8 \times 10^{-3}$ | 2 | $1.4 \times 10^{-3}$ | 4.3 | 1.47 | 15.3 | 4 |
| 28** | 72x | $9.5 \times 10^{-3}$ | 2 | $7.6 \times 10^{-3}$ | 4.4 | 1.51 | 15.7 | 5 |
| 29** | 83 | $2.2 \times 10^{-3}$ | 2 | $1.8 \times 10^{-3}$ | 4.3 | 1.47 | 15.3 | 4 |
| 30** | 95-1 | $5.0 \times 10^{-3}$ | 2 | $4.0 \times 10^{-3}$ | 4.3 | 1.47 | 15.3 | 4 |
| 31** | 109m | $9.8 \times 10^{-3}$ | 2 | $7.8 \times 10^{-3}$ | 4.2 | 1.42 | 14.9 | 4 |
| 32** | 2b | $1.8 \times 10^{-3}$ | 38 | $1.5 \times 10^{-3}$ | 4.2 | 1.43 | 15.0 | 4 |
| 33** | 31a | $1.9 \times 10^{-3}$ | 38 | $1.6 \times 10^{-3}$ | 4.7 | 1.60 | 16.7 | 5 |
| 34** | 34a | $1.6 \times 10^{-3}$ | 38 | $1.3 \times 10^{-3}$ | 4.6 | 1.56 | 16.3 | 5 |
| 35** | 54a | $2.0 \times 10^{-3}$ | 38 | $1.7 \times 10^{-3}$ | 4.4 | 1.52 | 15.8 | 5 |
| 36** | 55r | $6.0 \times 10^{-3}$ | 38 | $5.0 \times 10^{-3}$ | 4.7 | 1.60 | 16.7 | 5 |
| 37** | 56a | $1.8 \times 10^{-3}$ | 38 | $1.5 \times 10^{-3}$ | 4.3 | 1.48 | 15.4 | 5 |
| 38** | 72x | $9.5 \times 10^{-3}$ | 38 | $8.0 \times 10^{-3}$ | 4.4 | 1.52 | 15.8 | 5 |
| 39** | 83 | $2.2 \times 10^{-3}$ | 38 | $1.8 \times 10^{-3}$ | 4.3 | 1.48 | 15.4 | 5 |
| 40** | 95-1 | $5.0 \times 10^{-3}$ | 38 | $4.2 \times 10^{-3}$ | 4.3 | 1.48 | 15.4 | 5 |
| 41** | 109m | $9.8 \times 10^{-3}$ | 38 | $8.2 \times 10^{-3}$ | 4.2 | 1.43 | 15.0 | 4 |
| 42** | 2b | $1.8 \times 10^{-3}$ | 12 | $1.4 \times 10^{-3}$ | 4.2 | 1.42 | 14.9 | 4 |
| 43** | 31a | $1.9 \times 10^{-3}$ | 12 | $1.5 \times 10^{-3}$ | 4.6 | 1.59 | 16.6 | 5 |
| 44** | 34a | $1.6 \times 10^{-3}$ | 12 | $1.3 \times 10^{-3}$ | 4.5 | 1.55 | 16.2 | 5 |
| 45** | 54a | $2.0 \times 10^{-3}$ | 12 | $1.6 \times 10^{-3}$ | 4.4 | 1.51 | 15.7 | 5 |
| 46** | 55r | $6.0 \times 10^{-3}$ | 12 | $4.8 \times 10^{-3}$ | 4.6 | 1.59 | 16.6 | 5 |
| 47** | 56a | $1.8 \times 10^{-3}$ | 12 | $1.4 \times 10^{-3}$ | 4.3 | 1.47 | 15.3 | 4 |
| 48** | 72x | $9.5 \times 10^{-3}$ | 12 | $7.6 \times 10^{-3}$ | 4.4 | 1.51 | 15.7 | 5 |
| 49** | 83 | $2.2 \times 10^{-3}$ | 12 | $1.8 \times 10^{-3}$ | 4.3 | 1.47 | 15.3 | 4 |
| 50** | 95-1 | $5.0 \times 10^{-3}$ | 12 | $4.0 \times 10^{-3}$ | 4.3 | 1.47 | 15.3 | 4 |
| 51** | 109m | $9.8 \times 10^{-3}$ | 12 | $7.8 \times 10^{-3}$ | 4.2 | 1.42 | 14.9 | 4 |
| 52** | 2b | $1.8 \times 10^{-3}$ | 24 | $1.5 \times 10^{-3}$ | 4.2 | 1.42 | 14.9 | 4 |
| 53** | 31a | $1.9 \times 10^{-3}$ | 24 | $1.6 \times 10^{-3}$ | 4.6 | 1.59 | 16.5 | 5 |
| 54** | 34a | $1.6 \times 10^{-3}$ | 24 | $1.3 \times 10^{-3}$ | 4.5 | 1.54 | 16.1 | 5 |
| 55** | 54a | $2.0 \times 10^{-3}$ | 24 | $1.7 \times 10^{-3}$ | 4.4 | 1.50 | 15.7 | 5 |
| 56** | 55r | $6.0 \times 10^{-3}$ | 24 | $5.0 \times 10^{-3}$ | 4.6 | 1.59 | 16.5 | 5 |
| 57** | 56a | $1.8 \times 10^{-3}$ | 24 | $1.5 \times 10^{-3}$ | 4.3 | 1.46 | 15.3 | 4 |
| 58** | 72x | $9.5 \times 10^{-3}$ | 24 | $8.0 \times 10^{-3}$ | 4.4 | 1.50 | 15.7 | 5 |
| 59** | 83 | $2.2 \times 10^{-3}$ | 24 | $1.8 \times 10^{-3}$ | 4.3 | 1.46 | 15.3 | 4 |
| 60** | 95-1 | $5.0 \times 10^{-3}$ | 24 | $4.2 \times 10^{-3}$ | 4.3 | 1.46 | 15.3 | 4 |
| 61** | 109m | $9.8 \times 10^{-3}$ | 24 | $8.2 \times 10^{-3}$ | 4.2 | 1.42 | 14.9 | 4 |
| 62** | 2b | $1.8 \times 10^{-3}$ | 60 | $1.5 \times 10^{-3}$ | 4.2 | 1.43 | 14.9 | 4 |
| 63** | 31a | $1.9 \times 10^{-3}$ | 60 | $1.6 \times 10^{-3}$ | 4.7 | 1.59 | 16.6 | 5 |
| 64** | 34a | $1.6 \times 10^{-3}$ | 60 | $1.3 \times 10^{-3}$ | 4.5 | 1.55 | 16.2 | 5 |
| 65** | 54a | $2.0 \times 10^{-3}$ | 60 | $1.6 \times 10^{-3}$ | 4.4 | 1.51 | 15.8 | 5 |
| 66** | 55r | $6.0 \times 10^{-3}$ | 60 | $4.9 \times 10^{-3}$ | 4.7 | 1.59 | 16.6 | 5 |
| 67** | 56a | $1.8 \times 10^{-3}$ | 60 | $1.5 \times 10^{-3}$ | 4.3 | 1.47 | 15.4 | 5 |
| 68** | 72x | $9.5 \times 10^{-3}$ | 60 | $7.8 \times 10^{-3}$ | 4.4 | 1.51 | 15.8 | 5 |
| 69** | 83 | $2.2 \times 10^{-3}$ | 60 | $1.8 \times 10^{-3}$ | 4.3 | 1.47 | 15.4 | 5 |
| 70** | 95-1 | $5.0 \times 10^{-3}$ | 60 | $4.1 \times 10^{-3}$ | 4.3 | 1.47 | 15.4 | 5 |
| 71** | 109m | $9.8 \times 10^{-3}$ | 60 | $8.0 \times 10^{-3}$ | 4.2 | 1.43 | 14.9 | 4 |
| 72** | 2b | $1.8 \times 10^{-3}$ | 40 | $1.5 \times 10^{-3}$ | 4.2 | 1.43 | 15.0 | 4 |
| 73** | 31a | $1.9 \times 10^{-3}$ | 40 | $1.6 \times 10^{-3}$ | 4.7 | 1.60 | 16.7 | 5 |
| 74** | 34a | $1.6 \times 10^{-3}$ | 40 | $1.4 \times 10^{-3}$ | 4.6 | 1.56 | 16.3 | 5 |
| 75** | 54a | $2.0 \times 10^{-3}$ | 40 | $1.7 \times 10^{-3}$ | 4.4 | 1.52 | 15.8 | 5 |
| 76** | 55r | $6.0 \times 10^{-3}$ | 40 | $5.2 \times 10^{-3}$ | 4.7 | 1.60 | 16.7 | 5 |
| 77** | 56a | $1.8 \times 10^{-3}$ | 40 | $1.5 \times 10^{-3}$ | 4.3 | 1.48 | 15.4 | 5 |
| 78** | 72x | $9.5 \times 10^{-3}$ | 40 | $8.2 \times 10^{-3}$ | 4.4 | 1.52 | 15.8 | 5 |
| 79** | 83 | $2.2 \times 10^{-3}$ | 40 | $1.9 \times 10^{-3}$ | 4.3 | 1.48 | 15.4 | 5 |
| 80** | 95-1 | $5.0 \times 10^{-3}$ | 40 | $4.3 \times 10^{-3}$ | 4.3 | 1.48 | 15.4 | 5 |
| 81** | 109m | $9.8 \times 10^{-3}$ | 40 | $8.4 \times 10^{-3}$ | 4.2 | 1.43 | 15.0 | 4 |
| 82** | 2b | $1.8 \times 10^{-3}$ | 57 | $1.5 \times 10^{-3}$ | 4.2 | 1.42 | 14.9 | 4 |
| 83** | 31a | $1.9 \times 10^{-3}$ | 57 | $1.6 \times 10^{-3}$ | 4.6 | 1.59 | 16.6 | 5 |
| 84** | 34a | $1.6 \times 10^{-3}$ | 57 | $1.3 \times 10^{-3}$ | 4.5 | 1.55 | 16.2 | 5 |

TABLE 31-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 85** | 54a | $2.0 \times 10^{-3}$ | 57 | $1.7 \times 10^{-3}$ | 4.4 | 1.51 | 15.7 | 5 |
| 86** | 55r | $6.0 \times 10^{-3}$ | 57 | $5.0 \times 10^{-3}$ | 4.6 | 1.59 | 16.6 | 5 |
| 87** | 56a | $1.8 \times 10^{-3}$ | 57 | $1.5 \times 10^{-3}$ | 4.3 | 1.47 | 15.3 | 4 |
| 88** | 72x | $9.5 \times 10^{-3}$ | 57 | $8.0 \times 10^{-3}$ | 4.4 | 1.51 | 15.7 | 5 |
| 89** | 83 | $2.2 \times 10^{-3}$ | 57 | $1.8 \times 10^{-3}$ | 4.3 | 1.47 | 15.3 | 4 |
| 90** | 95-1 | $5.0 \times 10^{-3}$ | 57 | $4.2 \times 10^{-3}$ | 4.3 | 1.47 | 15.3 | 4 |
| 91** | 109m | $9.8 \times 10^{-3}$ | 57 | $8.2 \times 10^{-3}$ | 4.2 | 1.42 | 14.9 | 4 |

*comparison
**invention

VC-2

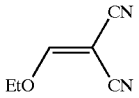

It is evident from Table 31 that using hydrazine derivatives within the scope of the invention and compounds of formulae (1) to (14), thermographic recording elements satisfying all the requirements of high Dmax, high contrast, and minimal black pepper are obtained.

Example 3

Samples were prepared as in Example 1 except that hydrazine derivatives and compounds of formulae (1) to (14) or comparative compounds were used as shown in Table 32, the sensitizing dye used was a mixture of 15 mg of Sensitizing Dye D, 20 mg of Sensitizing Dye E and 18 mg of Sensitizing Dye F, and the support was coated with a backcoat layer having Dyestuff B added so as to provide an absorbance of 0.7 at 780 nm.

The sensitizing dyes and dyestuff used in this Example are shown below by structural formulae. They are also used in Example 4. For the sake of convenience, the structural formulae of compounds used in Example 4 are also shown here.

Sensitizing Dye D

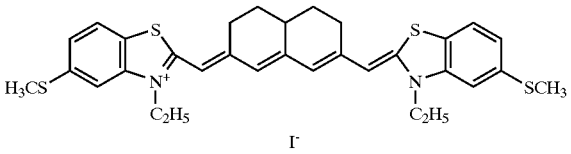

Sentizing Dye E

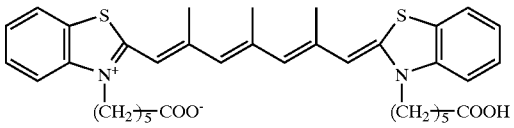

Sentizing Dye F

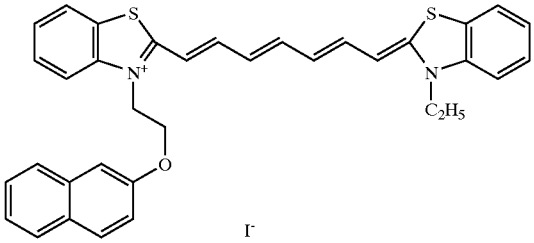

Dyestuff B

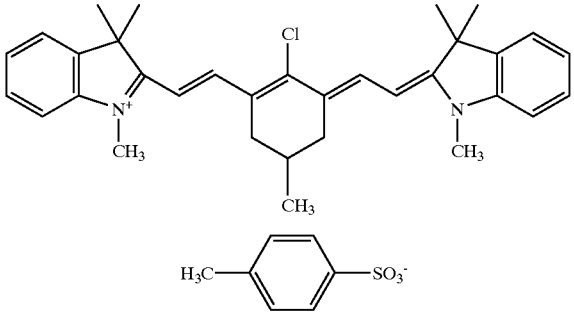

Dyestuff C

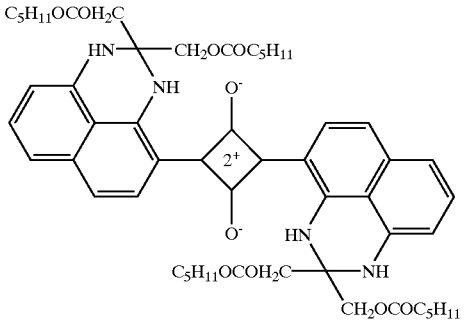

Photographic Property Test

After the samples prepared above were exposed to xenon flash light for an emission time of $10^{-6}$ sec through an interference filter having a peak at 780 nm and a step wedge, they were processed and tested as in Example 1 except that exposure to the halogen lamp was omitted.

Black Pepper Test

The samples were rated as in Example 1.

The results are shown in Table 32.

TABLE 32

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 10e | $0.5 \times 10^{-3}$ | — | — | 3.5 | 1.20 | 12.5 | 2 |
| 3* | 11g | $2.8 \times 10^{-3}$ | — | — | 3.9 | 1.33 | 13.9 | 3 |
| 4* | 54a | $1.9 \times 10^{-3}$ | — | — | 3.8 | 1.30 | 13.6 | 3 |
| 5* | 56a | $1.8 \times 10^{-3}$ | — | — | 3.7 | 1.27 | 13.2 | 2 |
| 6* | 62g | $4.5 \times 10^{-3}$ | — | — | 3.9 | 1.33 | 13.9 | 3 |
| 7* | 66u | $9.8 \times 10^{-3}$ | — | — | 3.6 | 1.23 | 12.9 | 2 |
| 8* | 95-1 | $6.0 \times 10^{-3}$ | — | — | 3.7 | 1.27 | 13.2 | 2 |
| 9* | 107a | $9.5 \times 10^{-3}$ | — | — | 3.6 | 1.23 | 12.9 | 2 |
| 10* | 101-5 | $4.8 \times 10^{-3}$ | — | — | 3.6 | 1.23 | 12.9 | 2 |
| 11* | 116-12 | $9.6 \times 10^{-3}$ | — | — | 3.5 | 1.20 | 12.5 | 2 |
| 12* | 10e | $0.5 \times 10^{-3}$ | VC-3 | $0.4 \times 10^{-3}$ | 3.7 | 1.26 | 13.2 | 2 |
| 13* | 11g | $2.8 \times 10^{-3}$ | VC-3 | $2.4 \times 10^{-3}$ | 4.1 | 1.40 | 14.7 | 3 |
| 14* | 54a | $1.9 \times 10^{-3}$ | VC-3 | $1.6 \times 10^{-3}$ | 4.0 | 1.37 | 14.3 | 3 |
| 15* | 56a | $1.8 \times 10^{-3}$ | VC-3 | $1.5 \times 10^{-3}$ | 3.9 | 1.33 | 13.9 | 3 |
| 16* | 62g | $4.5 \times 10^{-3}$ | VC-3 | $3.8 \times 10^{-3}$ | 4.1 | 1.40 | 14.7 | 3 |
| 17* | 66u | $9.8 \times 10^{-3}$ | VC-3 | $8.2 \times 10^{-3}$ | 3.8 | 1.30 | 13.5 | 3 |
| 18* | 95-1 | $6.0 \times 10^{-3}$ | VC-3 | $5.0 \times 10^{-3}$ | 3.9 | 1.33 | 13.9 | 3 |
| 19* | 107a | $9.5 \times 10^{-3}$ | VC-3 | $8.0 \times 10^{-3}$ | 3.8 | 1.30 | 13.5 | 3 |
| 20* | 101-5 | $4.8 \times 10^{-3}$ | VC-3 | $4.0 \times 10^{-3}$ | 3.8 | 1.30 | 13.5 | 3 |
| 21* | 116-12 | $9.6 \times 10^{-3}$ | VC-3 | $8.1 \times 10^{-3}$ | 3.7 | 1.26 | 13.2 | 2 |
| 22** | 10e | $0.5 \times 10^{-3}$ | 2 | $0.4 \times 10^{-3}$ | 4.1 | 1.41 | 14.8 | 4 |
| 23** | 11g | $2.8 \times 10^{-3}$ | 2 | $2.2 \times 10^{-3}$ | 4.6 | 1.57 | 16.4 | 5 |
| 24** | 54a | $1.9 \times 10^{-3}$ | 2 | $1.5 \times 10^{-3}$ | 4.5 | 1.53 | 16.0 | 5 |
| 25** | 56a | $1.8 \times 10^{-3}$ | 2 | $1.4 \times 10^{-3}$ | 4.4 | 1.49 | 15.6 | 5 |
| 26** | 62g | $4.5 \times 10^{-3}$ | 2 | $3.5 \times 10^{-3}$ | 4.6 | 1.57 | 16.4 | 5 |
| 27** | 66u | $9.8 \times 10^{-3}$ | 2 | $7.6 \times 10^{-3}$ | 4.2 | 1.45 | 15.2 | 4 |
| 28** | 95-1 | $6.0 \times 10^{-3}$ | 2 | $4.7 \times 10^{-3}$ | 4.4 | 1.49 | 15.6 | 5 |
| 29** | 107a | $9.5 \times 10^{-3}$ | 2 | $7.4 \times 10^{-3}$ | 4.2 | 1.45 | 15.2 | 4 |
| 30** | 101-5 | $4.8 \times 10^{-3}$ | 2 | $3.7 \times 10^{-3}$ | 4.2 | 1.45 | 15.2 | 4 |
| 31** | 116-12 | $9.6 \times 10^{-3}$ | 2 | $7.5 \times 10^{-3}$ | 4.1 | 1.41 | 14.8 | 4 |
| 32** | 10e | $0.5 \times 10^{-3}$ | 38 | $0.4 \times 10^{-3}$ | 4.2 | 1.42 | 14.9 | 4 |
| 33** | 11g | $2.8 \times 10^{-3}$ | 38 | $2.2 \times 10^{-3}$ | 4.6 | 1.59 | 16.6 | 5 |
| 34** | 54a | $1.9 \times 10^{-3}$ | 38 | $1.5 \times 10^{-3}$ | 4.5 | 1.55 | 16.2 | 5 |
| 35** | 56a | $1.8 \times 10^{-3}$ | 38 | $1.4 \times 10^{-3}$ | 4.4 | 1.51 | 15.7 | 5 |
| 36** | 62g | $4.5 \times 10^{-3}$ | 38 | $3.6 \times 10^{-3}$ | 4.6 | 1.59 | 16.6 | 5 |
| 37** | 66u | $9.8 \times 10^{-3}$ | 38 | $7.8 \times 10^{-3}$ | 4.3 | 1.47 | 15.3 | 4 |
| 38** | 95-1 | $6.0 \times 10^{-3}$ | 38 | $4.8 \times 10^{-3}$ | 4.4 | 1.51 | 15.7 | 5 |
| 39** | 107a | $9.5 \times 10^{-3}$ | 38 | $7.6 \times 10^{-3}$ | 4.3 | 1.47 | 15.3 | 4 |
| 40** | 101-5 | $4.8 \times 10^{-3}$ | 38 | $3.8 \times 10^{-3}$ | 4.3 | 1.47 | 15.3 | 4 |
| 41** | 116-12 | $9.6 \times 10^{-3}$ | 38 | $7.7 \times 10^{-3}$ | 4.2 | 1.42 | 14.9 | 4 |
| 42** | 10e | $0.5 \times 10^{-3}$ | 12 | $0.4 \times 10^{-3}$ | 4.1 | 1.42 | 14.8 | 4 |
| 43** | 11g | $2.8 \times 10^{-3}$ | 12 | $2.3 \times 10^{-3}$ | 4.6 | 1.58 | 16.5 | 5 |
| 44** | 54a | $1.9 \times 10^{-3}$ | 12 | $1.6 \times 10^{-3}$ | 4.5 | 1.54 | 16.1 | 5 |
| 45** | 56a | $1.8 \times 10^{-3}$ | 12 | $1.5 \times 10^{-3}$ | 4.4 | 1.50 | 15.6 | 5 |
| 46** | 62g | $4.5 \times 10^{-3}$ | 12 | $3.7 \times 10^{-3}$ | 4.6 | 1.58 | 16.5 | 5 |
| 47** | 66u | $9.8 \times 10^{-3}$ | 12 | $8.0 \times 10^{-3}$ | 4.3 | 1.46 | 15.2 | 4 |
| 48** | 95-1 | $6.0 \times 10^{-3}$ | 12 | $4.9 \times 10^{-3}$ | 4.4 | 1.50 | 15.6 | 5 |
| 49** | 107a | $9.5 \times 10^{-3}$ | 12 | $7.8 \times 10^{-3}$ | 4.3 | 1.46 | 15.2 | 4 |
| 50** | 101-5 | $4.8 \times 10^{-3}$ | 12 | $3.9 \times 10^{-3}$ | 4.3 | 1.46 | 15.2 | 4 |
| 51** | 116-12 | $9.6 \times 10^{-3}$ | 12 | $7.9 \times 10^{-3}$ | 4.1 | 1.42 | 14.8 | 4 |
| 52** | 10e | $0.5 \times 10^{-3}$ | 24 | $0.4 \times 10^{-3}$ | 4.1 | 1.41 | 14.8 | 4 |
| 53** | 11g | $2.8 \times 10^{-3}$ | 24 | $2.3 \times 10^{-3}$ | 4.6 | 1.57 | 16.4 | 5 |
| 54** | 54a | $1.9 \times 10^{-3}$ | 24 | $1.6 \times 10^{-3}$ | 4.5 | 1.53 | 16.0 | 5 |
| 55** | 56a | $1.8 \times 10^{-3}$ | 24 | $1.5 \times 10^{-3}$ | 4.4 | 1.49 | 15.6 | 5 |
| 56** | 62g | $4.5 \times 10^{-3}$ | 24 | $3.7 \times 10^{-3}$ | 4.6 | 1.57 | 16.4 | 5 |
| 57** | 66u | $9.8 \times 10^{-3}$ | 24 | $8.0 \times 10^{-3}$ | 4.2 | 1.45 | 15.2 | 4 |
| 58** | 95-1 | $6.0 \times 10^{-3}$ | 24 | $4.9 \times 10^{-3}$ | 4.4 | 1.49 | 15.6 | 5 |
| 59** | 107a | $9.5 \times 10^{-3}$ | 24 | $7.5 \times 10^{-3}$ | 4.2 | 1.45 | 15.2 | 4 |
| 60** | 101-5 | $4.8 \times 10^{-3}$ | 24 | $3.9 \times 10^{-3}$ | 4.2 | 1.45 | 15.2 | 4 |
| 61** | 116-12 | $9.6 \times 10^{-3}$ | 24 | $7.9 \times 10^{-3}$ | 4.1 | 1.41 | 14.8 | 4 |
| 62** | 10e | $0.5 \times 10^{-3}$ | 60 | $0.4 \times 10^{-3}$ | 4.2 | 1.42 | 14.9 | 4 |
| 63** | 11g | $2.8 \times 10^{-3}$ | 60 | $2.2 \times 10^{-3}$ | 4.6 | 1.59 | 16.6 | 5 |
| 64** | 54a | $1.9 \times 10^{-3}$ | 60 | $1.5 \times 10^{-3}$ | 4.5 | 1.55 | 16.2 | 5 |
| 65** | 56a | $1.8 \times 10^{-3}$ | 60 | $1.4 \times 10^{-3}$ | 4.4 | 1.51 | 15.7 | 5 |

TABLE 32-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 66** | 62g | $4.5 \times 10^{-3}$ | 60 | $3.5 \times 10^{-3}$ | 4.6 | 1.59 | 16.6 | 5 |
| 67** | 66u | $9.8 \times 10^{-3}$ | 60 | $7.6 \times 10^{-3}$ | 4.3 | 1.47 | 15.3 | 4 |
| 68** | 95-1 | $6.0 \times 10^{-3}$ | 60 | $4.7 \times 10^{-3}$ | 4.4 | 1.51 | 15.7 | 5 |
| 69** | 107a | $9.5 \times 10^{-3}$ | 60 | $7.4 \times 10^{-3}$ | 4.3 | 1.47 | 15.3 | 4 |
| 70** | 101-5 | $4.8 \times 10^{-3}$ | 60 | $3.7 \times 10^{-3}$ | 4.3 | 1.47 | 15.3 | 4 |
| 71** | 116-12 | $9.6 \times 10^{-3}$ | 60 | $7.5 \times 10^{-3}$ | 4.2 | 1.42 | 14.9 | 4 |
| 72** | 10e | $0.5 \times 10^{-3}$ | 40 | $0.4 \times 10^{-3}$ | 4.2 | 1.43 | 14.9 | 4 |
| 73** | 11g | $2.8 \times 10^{-3}$ | 40 | $2.3 \times 10^{-3}$ | 4.7 | 1.59 | 16.6 | 5 |
| 74** | 54a | $1.9 \times 10^{-3}$ | 40 | $1.6 \times 10^{-3}$ | 4.5 | 1.55 | 16.2 | 5 |
| 75** | 56a | $1.8 \times 10^{-3}$ | 40 | $1.5 \times 10^{-3}$ | 4.4 | 1.51 | 15.8 | 5 |
| 76** | 62g | $4.5 \times 10^{-3}$ | 40 | $3.7 \times 10^{-3}$ | 4.7 | 1.59 | 16.6 | 5 |
| 77** | 66u | $9.8 \times 10^{-3}$ | 40 | $8.0 \times 10^{-3}$ | 4.3 | 1.47 | 15.3 | 4 |
| 78** | 95-1 | $6.0 \times 10^{-3}$ | 40 | $4.9 \times 10^{-3}$ | 4.4 | 1.51 | 15.8 | 5 |
| 79** | 107a | $9.5 \times 10^{-3}$ | 40 | $7.8 \times 10^{-3}$ | 4.3 | 1.47 | 15.3 | 4 |
| 80** | 101-5 | $4.8 \times 10^{-3}$ | 40 | $3.9 \times 10^{-3}$ | 4.3 | 1.47 | 15.3 | 4 |
| 81** | 116-12 | $9.6 \times 10^{-3}$ | 40 | $7.9 \times 10^{-3}$ | 4.2 | 1.43 | 14.9 | 4 |
| 82** | 10e | $0.5 \times 10^{-3}$ | 57 | $0.4 \times 10^{-3}$ | 4.1 | 1.42 | 14.8 | 4 |
| 83** | 11g | $2.8 \times 10^{-3}$ | 57 | $2.2 \times 10^{-3}$ | 4.6 | 1.58 | 16.5 | 5 |
| 84** | 54a | $1.9 \times 10^{-3}$ | 57 | $1.5 \times 10^{-3}$ | 4.5 | 1.54 | 16.1 | 5 |
| 85** | 56a | $1.8 \times 10^{-3}$ | 57 | $1.4 \times 10^{-3}$ | 4.4 | 1.50 | 15.7 | 5 |
| 86** | 62g | $4.5 \times 10^{-3}$ | 57 | $3.6 \times 10^{-3}$ | 4.6 | 1.58 | 16.5 | 5 |
| 87** | 66u | $9.8 \times 10^{-3}$ | 57 | $7.8 \times 10^{-3}$ | 4.3 | 1.46 | 15.2 | 4 |
| 88** | 95-1 | $6.0 \times 10^{-3}$ | 57 | $4.8 \times 10^{-3}$ | 4.4 | 1.50 | 15.7 | 5 |
| 89** | 107a | $9.5 \times 10^{-3}$ | 57 | $7.6 \times 10^{-3}$ | 4.3 | 1.46 | 15.2 | 4 |
| 90** | 101-5 | $4.8 \times 10^{-3}$ | 57 | $3.8 \times 10^{-3}$ | 4.3 | 1.46 | 15.2 | 4 |
| 91** | 116-12 | $9.6 \times 10^{-3}$ | 57 | $7.7 \times 10^{-3}$ | 4.1 | 1.42 | 14.8 | 4 |

*comparison
**invention

VC-3

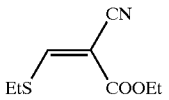

It is evident from Table 32 that using hydrazine derivatives within the scope of the invention and compounds of formulae (1) to (14), thermographic recording elements satisfying all the requirements of high Dmax, high contrast, and minimal black pepper are obtained.

Example 4

Samples were prepared as in Example 2 except that hydrazine derivatives and compounds of formulae (1) to (14) or comparative compounds (both added to the emulsion layer) were used as shown in Table 33, the sensitizing dye used was a mixture of 18 mg of Sensitizing Dye D, 15 mg of Sensitizing Dye E and 15 mg of Sensitizing Dye F, and the support was coated with a backcoat layer having Dyestuff C added so as to provide an absorbance of 0.7 at 780 nm.

Photographic Property Test

After the samples prepared above were exposed to xenon flash light for an emission time of $10^{-6}$ sec through an interference filter having a peak at 780 nm and a step wedge, they were processed and tested as in Example 1 except that exposure to the halogen lamp was omitted.

Black Pepper Test

The samples were rated as in Example 1.

The results are shown in Table 33.

TABLE 33

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 1b | $1.2 \times 10^{-3}$ | — | — | 3.4 | 1.16 | 12.1 | 2 |
| 3* | 10a | $1.0 \times 10^{-3}$ | — | — | 3.8 | 1.30 | 13.6 | 3 |
| 4* | 54a | $2.0 \times 10^{-3}$ | — | — | 3.8 | 1.30 | 13.6 | 3 |
| 5* | 56a | $1.8 \times 10^{-3}$ | — | — | 3.6 | 1.23 | 12.9 | 2 |
| 6* | 56r | $6.3 \times 10^{-3}$ | — | — | 3.9 | 1.33 | 13.9 | 3 |
| 7* | 59m | $7.2 \times 10^{-3}$ | — | — | 3.5 | 1.20 | 12.5 | 2 |
| 8* | 95-1 | $6.0 \times 10^{-3}$ | — | — | 3.7 | 1.27 | 13.2 | 2 |

TABLE 33-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 9* | 95-4 | $5.4 \times 10^{-3}$ | — | — | 3.5 | 1.20 | 12.5 | 2 |
| 10* | 113-11 | $9.6 \times 10^{-3}$ | — | — | 3.6 | 1.23 | 12.9 | 2 |
| 11* | 122 | $9.8 \times 10^{-3}$ | — | — | 3.4 | 1.16 | 12.1 | 2 |
| 12* | 1b | $1.2 \times 10^{-3}$ | VC-4 | $1.2 \times 10^{-3}$ | 3.6 | 1.23 | 12.8 | 2 |
| 13* | 10a | $1.0 \times 10^{-3}$ | VC-4 | $1.0 \times 10^{-3}$ | 4.0 | 1.37 | 14.3 | 3 |
| 14* | 54a | $2.0 \times 10^{-3}$ | VC-4 | $2.0 \times 10^{-3}$ | 4.0 | 1.37 | 14.3 | 3 |
| 15* | 56a | $1.8 \times 10^{-3}$ | VC-4 | $1.8 \times 10^{-3}$ | 3.8 | 1.30 | 13.6 | 3 |
| 16* | 56r | $6.3 \times 10^{-3}$ | VC-4 | $6.1 \times 10^{-3}$ | 4.1 | 1.41 | 14.7 | 3 |
| 17* | 59m | $7.2 \times 10^{-3}$ | VC-4 | $7.0 \times 10^{-3}$ | 3.7 | 1.26 | 13.2 | 2 |
| 18* | 95-1 | $6.0 \times 10^{-3}$ | VC-4 | $5.9 \times 10^{-3}$ | 3.9 | 1.34 | 14.0 | 3 |
| 19* | 95-4 | $5.4 \times 10^{-3}$ | VC-4 | $5.3 \times 10^{-3}$ | 3.7 | 1.26 | 13.2 | 2 |
| 20* | 113-11 | $9.6 \times 10^{-3}$ | VC-4 | $9.4 \times 10^{-3}$ | 3.8 | 1.30 | 13.6 | 3 |
| 21* | 122 | $9.8 \times 10^{-3}$ | VC-4 | $9.6 \times 10^{-3}$ | 3.6 | 1.23 | 12.8 | 2 |
| 22** | 1b | $1.2 \times 10^{-3}$ | 1 | $1.0 \times 10^{-3}$ | 4.1 | 1.41 | 14.7 | 4 |
| 23** | 10a | $1.0 \times 10^{-3}$ | 1 | $0.8 \times 10^{-3}$ | 4.6 | 1.57 | 16.4 | 5 |
| 24** | 54a | $2.0 \times 10^{-3}$ | 1 | $1.6 \times 10^{-3}$ | 4.6 | 1.57 | 16.4 | 5 |
| 25** | 56a | $1.8 \times 10^{-3}$ | 1 | $1.4 \times 10^{-3}$ | 4.4 | 1.49 | 15.6 | 5 |
| 26** | 56r | $6.3 \times 10^{-3}$ | 1 | $5.0 \times 10^{-3}$ | 4.7 | 1.61 | 16.9 | 5 |
| 27** | 59m | $7.2 \times 10^{-3}$ | 1 | $5.8 \times 10^{-3}$ | 4.2 | 1.45 | 15.1 | 4 |
| 28** | 95-1 | $6.0 \times 10^{-3}$ | 1 | $4.8 \times 10^{-3}$ | 4.5 | 1.53 | 16.0 | 5 |
| 29** | 95-4 | $5.4 \times 10^{-3}$ | 1 | $4.3 \times 10^{-3}$ | 4.2 | 1.45 | 15.1 | 4 |
| 30** | 113-11 | $9.6 \times 10^{-3}$ | 1 | $7.7 \times 10^{-3}$ | 4.4 | 1.49 | 15.6 | 5 |
| 31** | 122 | $9.8 \times 10^{-3}$ | 1 | $7.8 \times 10^{-3}$ | 4.1 | 1.41 | 14.7 | 4 |
| 32** | 1b | $1.2 \times 10^{-3}$ | 63 | $1.0 \times 10^{-3}$ | 4.1 | 1.39 | 14.5 | 4 |
| 33** | 10a | $1.0 \times 10^{-3}$ | 63 | $0.8 \times 10^{-3}$ | 4.6 | 1.56 | 16.3 | 5 |
| 34** | 54a | $2.0 \times 10^{-3}$ | 63 | $1.6 \times 10^{-3}$ | 4.6 | 1.56 | 16.3 | 5 |
| 35** | 56a | $1.8 \times 10^{-3}$ | 63 | $1.5 \times 10^{-3}$ | 4.3 | 1.48 | 15.4 | 5 |
| 36** | 56r | $6.3 \times 10^{-3}$ | 63 | $5.2 \times 10^{-3}$ | 4.7 | 1.60 | 16.7 | 5 |
| 37** | 59m | $7.2 \times 10^{-3}$ | 63 | $5.9 \times 10^{-3}$ | 4.2 | 1.43 | 15.0 | 4 |
| 38** | 95-1 | $6.0 \times 10^{-3}$ | 63 | $4.9 \times 10^{-3}$ | 4.4 | 1.52 | 15.8 | 5 |
| 39** | 95-4 | $5.4 \times 10^{-3}$ | 63 | $4.4 \times 10^{-3}$ | 4.2 | 1.43 | 15.0 | 4 |
| 40** | 113-11 | $9.6 \times 10^{-3}$ | 63 | $7.9 \times 10^{-3}$ | 4.3 | 1.48 | 15.4 | 5 |
| 41** | 122 | $9.8 \times 10^{-3}$ | 63 | $8.0 \times 10^{-3}$ | 4.1 | 1.39 | 14.5 | 4 |
| 42** | 1b | $1.2 \times 10^{-3}$ | 7 | $0.9 \times 10^{-3}$ | 4.0 | 1.38 | 14.4 | 4 |
| 43** | 10a | $1.0 \times 10^{-3}$ | 7 | $0.8 \times 10^{-3}$ | 4.5 | 1.55 | 16.1 | 5 |
| 44** | 54a | $2.0 \times 10^{-3}$ | 7 | $1.6 \times 10^{-3}$ | 4.5 | 1.55 | 16.1 | 5 |
| 45** | 56a | $1.8 \times 10^{-3}$ | 7 | $1.4 \times 10^{-3}$ | 4.3 | 1.46 | 15.3 | 4 |
| 46** | 56r | $6.3 \times 10^{-3}$ | 7 | $4.9 \times 10^{-3}$ | 4.6 | 1.59 | 16.6 | 5 |
| 47** | 59m | $7.2 \times 10^{-3}$ | 7 | $5.6 \times 10^{-3}$ | 4.2 | 1.42 | 14.9 | 4 |
| 48** | 95-1 | $6.0 \times 10^{-3}$ | 7 | $4.7 \times 10^{-3}$ | 4.4 | 1.51 | 15.7 | 5 |
| 49** | 95-4 | $5.4 \times 10^{-3}$ | 7 | $4.2 \times 10^{-3}$ | 4.2 | 1.42 | 14.9 | 4 |
| 50** | 113-11 | $9.6 \times 10^{-3}$ | 7 | $7.5 \times 10^{-3}$ | 4.3 | 1.46 | 15.3 | 4 |
| 51** | 122 | $9.8 \times 10^{-3}$ | 7 | $7.6 \times 10^{-3}$ | 4.0 | 1.38 | 14.4 | 4 |
| 52** | 1b | $1.2 \times 10^{-3}$ | 14 | $0.9 \times 10^{-3}$ | 4.0 | 1.38 | 14.4 | 4 |
| 53** | 10a | $1.0 \times 10^{-3}$ | 14 | $0.8 \times 10^{-3}$ | 4.5 | 1.54 | 16.1 | 5 |
| 54** | 54a | $2.0 \times 10^{-3}$ | 14 | $1.5 \times 10^{-3}$ | 4.5 | 1.54 | 16.1 | 5 |
| 55** | 56a | $1.8 \times 10^{-3}$ | 14 | $1.4 \times 10^{-3}$ | 4.3 | 1.46 | 15.2 | 4 |
| 56** | 56r | $6.3 \times 10^{-3}$ | 14 | $4.8 \times 10^{-3}$ | 4.6 | 1.58 | 16.5 | 5 |
| 57** | 59m | $7.2 \times 10^{-3}$ | 14 | $5.5 \times 10^{-3}$ | 4.1 | 1.42 | 14.8 | 4 |
| 58** | 95-1 | $6.0 \times 10^{-3}$ | 14 | $4.6 \times 10^{-3}$ | 4.4 | 1.50 | 15.7 | 5 |
| 59** | 95-4 | $5.4 \times 10^{-3}$ | 14 | $4.1 \times 10^{-3}$ | 4.1 | 1.42 | 14.8 | 4 |
| 60** | 113-11 | $9.6 \times 10^{-3}$ | 14 | $7.3 \times 10^{-3}$ | 4.3 | 1.46 | 15.2 | 4 |
| 61** | 122 | $9.8 \times 10^{-3}$ | 14 | $7.4 \times 10^{-3}$ | 4.0 | 1.38 | 14.4 | 4 |
| 62** | 1b | $1.2 \times 10^{-3}$ | 37 | $1.0 \times 10^{-3}$ | 4.1 | 1.39 | 14.5 | 4 |
| 63** | 10a | $1.0 \times 10^{-3}$ | 37 | $0.8 \times 10^{-3}$ | 4.5 | 1.55 | 16.2 | 5 |
| 64** | 54a | $2.0 \times 10^{-3}$ | 37 | $1.6 \times 10^{-3}$ | 4.5 | 1.55 | 16.2 | 5 |
| 65** | 56a | $1.8 \times 10^{-3}$ | 37 | $1.4 \times 10^{-3}$ | 4.3 | 1.47 | 15.3 | 4 |
| 66** | 56r | $6.3 \times 10^{-3}$ | 37 | $5.0 \times 10^{-3}$ | 4.7 | 1.59 | 16.6 | 5 |
| 67** | 59m | $7.2 \times 10^{-3}$ | 37 | $5.8 \times 10^{-3}$ | 4.2 | 1.43 | 14.9 | 4 |
| 68** | 95-1 | $6.0 \times 10^{-3}$ | 37 | $4.8 \times 10^{-3}$ | 4.4 | 1.51 | 15.8 | 5 |
| 69** | 95-4 | $5.4 \times 10^{-3}$ | 37 | $4.3 \times 10^{-3}$ | 4.2 | 1.43 | 14.9 | 4 |
| 70** | 113-11 | $9.6 \times 10^{-3}$ | 37 | $7.7 \times 10^{-3}$ | 4.3 | 1.47 | 15.3 | 4 |
| 71** | 122 | $9.8 \times 10^{-3}$ | 37 | $7.8 \times 10^{-3}$ | 4.1 | 1.39 | 14.5 | 4 |
| 72** | 1b | $1.2 \times 10^{-3}$ | 39 | $1.0 \times 10^{-3}$ | 4.1 | 1.39 | 14.5 | 4 |
| 73** | 10a | $1.0 \times 10^{-3}$ | 39 | $0.8 \times 10^{-3}$ | 4.5 | 1.56 | 16.2 | 5 |
| 74** | 54a | $2.0 \times 10^{-3}$ | 39 | $1.7 \times 10^{-3}$ | 4.5 | 1.56 | 16.2 | 5 |
| 75** | 56a | $1.8 \times 10^{-3}$ | 39 | $1.5 \times 10^{-3}$ | 4.3 | 1.47 | 15.4 | 5 |
| 76** | 56r | $6.3 \times 10^{-3}$ | 39 | $5.3 \times 10^{-3}$ | 4.7 | 1.60 | 16.7 | 5 |
| 77** | 59m | $7.2 \times 10^{-3}$ | 39 | $6.0 \times 10^{-3}$ | 4.2 | 1.43 | 15.0 | 4 |
| 78** | 95-1 | $6.0 \times 10^{-3}$ | 39 | $5.0 \times 10^{-3}$ | 4.4 | 1.52 | 15.8 | 5 |
| 79** | 95-4 | $5.4 \times 10^{-3}$ | 39 | $4.5 \times 10^{-3}$ | 4.2 | 1.43 | 15.0 | 4 |
| 80** | 113-11 | $9.6 \times 10^{-3}$ | 39 | $8.1 \times 10^{-3}$ | 4.3 | 1.47 | 15.4 | 5 |
| 81** | 122 | $9.8 \times 10^{-3}$ | 39 | $8.2 \times 10^{-3}$ | 4.1 | 1.39 | 14.5 | 4 |
| 82** | 1b | $1.2 \times 10^{-3}$ | 41 | $1.0 \times 10^{-3}$ | 4.0 | 1.38 | 14.5 | 4 |

TABLE 33-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 83** | 10a | $1.0 \times 10^{-3}$ | 41 | $0.8 \times 10^{-3}$ | 4.5 | 1.55 | 16.2 | 5 |
| 84** | 54a | $2.0 \times 10^{-3}$ | 41 | $1.6 \times 10^{-3}$ | 4.5 | 1.55 | 16.2 | 5 |
| 85** | 56a | $1.8 \times 10^{-3}$ | 41 | $1.5 \times 10^{-3}$ | 4.3 | 1.47 | 15.3 | 4 |
| 86** | 56r | $6.3 \times 10^{-3}$ | 41 | $5.2 \times 10^{-3}$ | 4.6 | 1.59 | 16.6 | 5 |
| 87** | 59m | $7.2 \times 10^{-3}$ | 41 | $5.9 \times 10^{-3}$ | 4.2 | 1.42 | 14.9 | 4 |
| 88** | 95-1 | $6.0 \times 10^{-3}$ | 41 | $4.9 \times 10^{-3}$ | 4.4 | 1.51 | 15.7 | 5 |
| 89** | 95-4 | $5.4 \times 10^{-3}$ | 41 | $4.4 \times 10^{-3}$ | 4.2 | 1.42 | 14.9 | 4 |
| 90** | 113-11 | $9.6 \times 10^{-3}$ | 41 | $7.9 \times 10^{-3}$ | 4.3 | 1.47 | 15.3 | 4 |
| 91** | 122 | $9.8 \times 10^{-3}$ | 41 | $8.0 \times 10^{-3}$ | 4.0 | 1.38 | 14.5 | 4 |

*comparison
**invention

VC-4

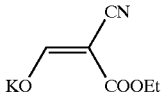

It is evident from Table 33 that using hydrazine derivatives within the scope of the invention and compounds of formulae (1) to (14), thermographic recording elements satisfying all the requirements of high Dmax, high contrast, and minimal black pepper are obtained.

Example 5

Samples were prepared as in Example 3 except that hydrazine derivatives and compounds of formulae (1) to (14) or comparative compounds were used as shown in Table 34.

Photographic Property Test

The samples were examined as in Example 3.

Black Pepper Test

The samples were rated as in Example 1.

The results are shown in Table 34.

TABLE 34

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 11g | $1.5 \times 10^{-5}$ | — | — | 3.6 | 1.13 | 12.7 | 2 |
| 3* | 72y | $7.5 \times 10^{-5}$ | — | — | 3.4 | 1.06 | 12.0 | 3 |
| 4* | 85 | $1.5 \times 10^{-5}$ | — | — | 3.7 | 1.16 | 13.1 | 3 |
| 5* | 106-10 | $7.5 \times 10^{-5}$ | — | — | 3.5 | 1.09 | 12.4 | 2 |
| 6* | 122 | $7.5 \times 10^{-5}$ | — | — | 3.4 | 1.06 | 12.0 | 3 |
| 7* | 125a | $1.5 \times 10^{-5}$ | — | — | 3.6 | 1.13 | 12.7 | 2 |
| 8* | 130c | $1.5 \times 10^{-5}$ | — | — | 3.7 | 1.16 | 13.1 | 2 |
| 9* | — | — | VC-2 | $2.5 \times 10^{-3}$ | 3.3 | 1.03 | 11.7 | 3 |
| 10** | — | — | 1 | $2.5 \times 10^{-3}$ | 3.7 | 1.19 | 14.8 | 4 |
| 11** | — | — | 60 | $2.5 \times 10^{-3}$ | 4.2 | 1.40 | 16.0 | 5 |
| 12** | — | — | 12 | $2.5 \times 10^{-3}$ | 3.9 | 1.20 | 15.2 | 5 |
| 13** | — | — | 45 | $2.5 \times 10^{-3}$ | 4.0 | 1.39 | 15.0 | 4 |
| 14** | — | — | 50 | $2.5 \times 10^{-3}$ | 4.2 | 1.40 | 16.5 | 5 |
| 15** | — | — | 52 | $2.5 \times 10^{-3}$ | 3.8 | 1.31 | 15.5 | 4 |
| 16** | — | — | 58 | $2.5 \times 10^{-3}$ | 3.9 | 1.30 | 15.7 | 4 |
| 17** | — | — | 59 | $2.5 \times 10^{-3}$ | 3.7 | 1.29 | 15.5 | 4 |
| 18* | 11g | $1.5 \times 10^{-5}$ | VC-2 | $1.8 \times 10^{-4}$ | 3.7 | 1.16 | 13.1 | 3 |
| 19* | 71y | $7.5 \times 10^{-5}$ | VC-2 | $1.8 \times 10^{-4}$ | 3.5 | 1.09 | 12.4 | 3 |
| 20* | 85 | $1.5 \times 10^{-5}$ | VC-2 | $1.8 \times 10^{-4}$ | 3.8 | 1.19 | 13.4 | 3 |
| 21* | 106-10 | $7.5 \times 10^{-5}$ | VC-2 | $1.8 \times 10^{-4}$ | 3.6 | 1.13 | 12.7 | 3 |
| 22* | 122 | $7.5 \times 10^{-5}$ | VC-2 | $1.8 \times 10^{-4}$ | 3.5 | 1.09 | 12.4 | 3 |
| 23* | 125a | $1.5 \times 10^{-5}$ | VC-2 | $1.8 \times 10^{-4}$ | 3.7 | 1.16 | 13.1 | 3 |
| 24* | 130c | $1.5 \times 10^{-5}$ | VC-2 | $1.8 \times 10^{-4}$ | 3.8 | 1.19 | 13.4 | 3 |
| 25** | 11g | $1.5 \times 10^{-5}$ | 1 | $1.8 \times 10^{-4}$ | 4.1 | 1.36 | 15.4 | 4 |
| 26** | 72y | $7.5 \times 10^{-5}$ | 1 | $1.8 \times 10^{-4}$ | 3.8 | 1.29 | 14.6 | 5 |
| 27** | 85 | $1.5 \times 10^{-5}$ | 1 | $1.8 \times 10^{-4}$ | 4.2 | 1.40 | 15.8 | 5 |
| 28** | 106-10 | $7.5 \times 10^{-5}$ | 1 | $1.8 \times 10^{-4}$ | 3.9 | 1.33 | 15.0 | 4 |
| 29** | 122 | $7.5 \times 10^{-5}$ | 1 | $1.8 \times 10^{-4}$ | 3.8 | 1.29 | 14.6 | 5 |
| 30** | 125a | $1.5 \times 10^{-5}$ | 1 | $1.8 \times 10^{-4}$ | 4.1 | 1.36 | 15.4 | 5 |
| 31** | 130c | $1.5 \times 10^{-5}$ | 1 | $1.8 \times 10^{-4}$ | 4.2 | 1.40 | 15.8 | 5 |

TABLE 34-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 32** | 11g | $1.5 \times 10^{-5}$ | 60 | $1.8 \times 10^{-4}$ | 4.1 | 1.39 | 15.7 | 4 |
| 33** | 72y | $7.5 \times 10^{-5}$ | 60 | $1.8 \times 10^{-4}$ | 3.9 | 1.31 | 14.8 | 5 |
| 34** | 85 | $1.5 \times 10^{-5}$ | 60 | $1.8 \times 10^{-4}$ | 4.3 | 1.43 | 16.1 | 5 |
| 35** | 106-10 | $7.5 \times 10^{-5}$ | 60 | $1.8 \times 10^{-4}$ | 4.0 | 1.35 | 15.3 | 4 |
| 36** | 122 | $7.5 \times 10^{-5}$ | 60 | $1.8 \times 10^{-4}$ | 3.9 | 1.31 | 14.8 | 5 |
| 37** | 125a | $1.5 \times 10^{-5}$ | 60 | $1.8 \times 10^{-4}$ | 4.1 | 1.39 | 15.7 | 5 |
| 38** | 130c | $1.5 \times 10^{-5}$ | 60 | $1.8 \times 10^{-4}$ | 4.3 | 1.43 | 16.1 | 5 |
| 39** | 11g | $1.5 \times 10^{-5}$ | 12 | $1.8 \times 10^{-4}$ | 4.0 | 1.34 | 15.2 | 4 |
| 40** | 72y | $7.5 \times 10^{-5}$ | 12 | $1.8 \times 10^{-4}$ | 3.8 | 1.27 | 14.3 | 5 |
| 41** | 85 | $1.5 \times 10^{-5}$ | 12 | $1.8 \times 10^{-4}$ | 4.1 | 1.38 | 15.6 | 5 |
| 42** | 106-10 | $7.5 \times 10^{-5}$ | 12 | $1.8 \times 10^{-4}$ | 3.9 | 1.31 | 14.7 | 4 |
| 43** | 122 | $7.5 \times 10^{-5}$ | 12 | $1.8 \times 10^{-4}$ | 3.8 | 1.27 | 14.3 | 5 |
| 44** | 125a | $1.5 \times 10^{-5}$ | 12 | $1.8 \times 10^{-4}$ | 4.0 | 1.34 | 15.2 | 5 |
| 45** | 130c | $1.5 \times 10^{-5}$ | 12 | $1.8 \times 10^{-4}$ | 4.1 | 1.38 | 15.6 | 5 |
| 46** | 11g | $1.5 \times 10^{-5}$ | 45 | $1.8 \times 10^{-4}$ | 4.2 | 1.42 | 16.0 | 4 |
| 47** | 72y | $7.5 \times 10^{-5}$ | 45 | $1.8 \times 10^{-4}$ | 4.0 | 1.34 | 15.1 | 5 |
| 48** | 85 | $1.5 \times 10^{-5}$ | 45 | $1.8 \times 10^{-4}$ | 4.3 | 1.45 | 16.4 | 5 |
| 49** | 106-10 | $7.5 \times 10^{-5}$ | 45 | $1.8 \times 10^{-4}$ | 4.1 | 1.38 | 15.6 | 4 |
| 50** | 122 | $7.5 \times 10^{-5}$ | 45 | $1.8 \times 10^{-4}$ | 4.0 | 1.34 | 15.1 | 5 |
| 51** | 125a | $1.5 \times 10^{-5}$ | 45 | $1.8 \times 10^{-4}$ | 4.2 | 1.42 | 16.0 | 5 |
| 52** | 130c | $1.5 \times 10^{-5}$ | 45 | $1.8 \times 10^{-4}$ | 4.3 | 1.45 | 16.4 | 5 |
| 53** | 11g | $1.5 \times 10^{-5}$ | 50 | $1.8 \times 10^{-4}$ | 4.4 | 1.47 | 16.5 | 5 |
| 54** | 72y | $7.5 \times 10^{-5}$ | 50 | $1.8 \times 10^{-4}$ | 4.1 | 1.38 | 15.6 | 5 |
| 55** | 85 | $1.5 \times 10^{-5}$ | 50 | $1.8 \times 10^{-4}$ | 4.5 | 1.51 | 17.0 | 5 |
| 56** | 106-10 | $7.5 \times 10^{-5}$ | 50 | $1.8 \times 10^{-4}$ | 4.2 | 1.42 | 16.1 | 4 |
| 57** | 122 | $7.5 \times 10^{-5}$ | 50 | $1.8 \times 10^{-4}$ | 4.1 | 1.38 | 15.6 | 5 |
| 58** | 125a | $1.5 \times 10^{-5}$ | 50 | $1.8 \times 10^{-4}$ | 4.4 | 1.47 | 16.5 | 5 |
| 59** | 130c | $1.5 \times 10^{-5}$ | 50 | $1.8 \times 10^{-4}$ | 4.5 | 1.51 | 17.0 | 5 |
| 60** | 11g | $1.5 \times 10^{-5}$ | 52 | $1.8 \times 10^{-4}$ | 4.2 | 1.42 | 16.1 | 4 |
| 61** | 72y | $7.5 \times 10^{-5}$ | 52 | $1.8 \times 10^{-4}$ | 4.0 | 1.35 | 15.2 | 5 |
| 62** | 85 | $1.5 \times 10^{-5}$ | 52 | $1.8 \times 10^{-4}$ | 4.4 | 1.46 | 16.5 | 5 |
| 63** | 106-10 | $7.5 \times 10^{-5}$ | 52 | $1.8 \times 10^{-4}$ | 4.1 | 1.39 | 15.6 | 4 |
| 64** | 122 | $7.5 \times 10^{-5}$ | 52 | $1.8 \times 10^{-4}$ | 4.0 | 1.35 | 15.2 | 5 |
| 65** | 125a | $1.5 \times 10^{-5}$ | 52 | $1.8 \times 10^{-4}$ | 4.2 | 1.42 | 16.1 | 5 |
| 66** | 130c | $1.5 \times 10^{-5}$ | 52 | $1.8 \times 10^{-4}$ | 4.4 | 1.46 | 16.5 | 5 |
| 67** | 11g | $1.5 \times 10^{-5}$ | 58 | $1.8 \times 10^{-4}$ | 4.3 | 1.44 | 16.2 | 5 |
| 68** | 72y | $7.5 \times 10^{-5}$ | 58 | $1.8 \times 10^{-4}$ | 4.0 | 1.36 | 15.3 | 5 |
| 69** | 85 | $1.5 \times 10^{-5}$ | 58 | $1.8 \times 10^{-4}$ | 4.4 | 1.47 | 16.7 | 5 |
| 70** | 106-10 | $7.5 \times 10^{-5}$ | 58 | $1.8 \times 10^{-4}$ | 4.2 | 1.40 | 15.8 | 4 |
| 71** | 122 | $7.5 \times 10^{-5}$ | 58 | $1.8 \times 10^{-4}$ | 4.0 | 1.36 | 15.3 | 5 |
| 72** | 125a | $1.5 \times 10^{-5}$ | 58 | $1.8 \times 10^{-4}$ | 4.3 | 1.44 | 16.2 | 5 |
| 73** | 130c | $1.5 \times 10^{-5}$ | 58 | $1.8 \times 10^{-3}$ | 4.4 | 1.47 | 16.7 | 5 |
| 74** | 11g | $1.5 \times 10^{-5}$ | 59 | $1.8 \times 10^{-4}$ | 4.1 | 1.39 | 15.7 | 4 |
| 75** | 72y | $7.5 \times 10^{-5}$ | 59 | $1.8 \times 10^{-4}$ | 3.9 | 1.31 | 14.8 | 5 |
| 76** | 85 | $1.5 \times 10^{-5}$ | 59 | $1.8 \times 10^{-4}$ | 4.2 | 1.43 | 16.1 | 5 |
| 77** | 106-10 | $7.5 \times 10^{-5}$ | 59 | $1.8 \times 10^{-4}$ | 4.0 | 1.35 | 15.3 | 4 |
| 78** | 122 | $7.5 \times 10^{-5}$ | 59 | $1.8 \times 10^{-4}$ | 3.9 | 1.31 | 14.8 | 5 |
| 79** | 125a | $1.5 \times 10^{-5}$ | 59 | $1.8 \times 10^{-4}$ | 4.1 | 1.39 | 15.7 | 5 |
| 80** | 130c | $1.5 \times 10^{-5}$ | 59 | $1.8 \times 10^{-4}$ | 4.2 | 1.43 | 16.1 | 5 |

*comparison
**invention

VC-2

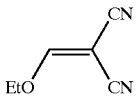

It is evident from Table 34 that using compounds of formulae (1) to (14) according to the invention, thermographic recording elements satisfying all the requirements of high Dmax, high contrast, and minimal black pepper are obtained.

Example 6

Samples were prepared as in Example 4 except that hydrazine derivatives and compounds of formulae (1) to (14) or comparative compounds were used as shown in Table 35.

Photographic Property Test

The samples were examined as in Example 3.

Black Pepper Test

The samples were rated as in Example 1.

The results are shown in Table 35.

TABLE 35

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 11g | $1.5 \times 10^{-5}$ | — | — | 3.6 | 1.14 | 12.8 | 2 |
| 3* | 72y | $7.5 \times 10^{-5}$ | — | — | 3.4 | 1.07 | 12.1 | 3 |
| 4* | 85 | $1.5 \times 10^{-5}$ | — | — | 3.7 | 1.17 | 13.2 | 3 |
| 5* | 106-10 | $7.5 \times 10^{-5}$ | — | — | 3.5 | 1.11 | 12.5 | 2 |
| 6* | 122 | $7.5 \times 10^{-5}$ | — | — | 3.4 | 1.07 | 12.1 | 3 |
| 7* | 125a | $1.5 \times 10^{-5}$ | — | — | 3.6 | 1.14 | 12.8 | 2 |
| 8* | 130c | $1.5 \times 10^{-5}$ | — | — | 3.7 | 1.17 | 13.2 | 2 |
| 9* | — | — | VC-6 | $2.5 \times 10^{-3}$ | 3.3 | 1.04 | 11.8 | 3 |
| 10** | — | — | 2 | $2.5 \times 10^{-3}$ | 4.0 | 1.35 | 14.9 | 4 |
| 11** | — | — | 38 | $2.5 \times 10^{-3}$ | 4.0 | 1.36 | 15.0 | 4 |
| 12** | — | — | 57 | $2.5 \times 10^{-3}$ | 4.0 | 1.33 | 15.5 | 5 |
| 13** | — | — | 46 | $2.5 \times 10^{-3}$ | 3.9 | 1.35 | 15.3 | 4 |
| 14** | — | — | 47 | $2.5 \times 10^{-3}$ | 4.1 | 1.40 | 15.5 | 5 |
| 15** | — | — | 51 | $2.5 \times 10^{-3}$ | 4.3 | 1.48 | 16.6 | 5 |
| 16** | — | — | 55 | $2.5 \times 10^{-3}$ | 4.0 | 1.39 | 15.7 | 5 |
| 17** | — | — | 64 | $2.5 \times 10^{-3}$ | 4.1 | 1.39 | 15.8 | 4 |
| 18* | 11g | $1.5 \times 10^{-5}$ | VC-6 | $1.8 \times 10^{-4}$ | 3.7 | 1.17 | 13.2 | 3 |
| 19* | 72y | $7.5 \times 10^{-5}$ | VC-6 | $1.8 \times 10^{-4}$ | 3.5 | 1.10 | 12.5 | 3 |
| 20* | 85 | $1.5 \times 10^{-5}$ | VC-6 | $1.8 \times 10^{-4}$ | 3.9 | 1.20 | 13.6 | 3 |
| 21* | 106-10 | $7.5 \times 10^{-5}$ | VC-6 | $1.8 \times 10^{-4}$ | 3.6 | 1.14 | 12.8 | 3 |
| 22* | 122 | $7.5 \times 10^{-5}$ | VC-6 | $1.8 \times 10^{-4}$ | 3.5 | 1.10 | 12.5 | 3 |
| 23* | 125a | $1.5 \times 10^{-5}$ | VC-6 | $1.8 \times 10^{-4}$ | 3.7 | 1.17 | 13.2 | 3 |
| 24* | 130c | $1.5 \times 10^{-5}$ | VC-6 | $1.8 \times 10^{-4}$ | 3.9 | 1.20 | 13.6 | 3 |
| 25** | 11g | $1.5 \times 10^{-5}$ | 2 | $1.8 \times 10^{-4}$ | 4.1 | 1.38 | 15.5 | 4 |
| 26** | 72y | $7.5 \times 10^{-5}$ | 2 | $1.8 \times 10^{-4}$ | 3.9 | 1.30 | 14.7 | 5 |
| 27** | 85 | $1.5 \times 10^{-5}$ | 2 | $1.8 \times 10^{-4}$ | 4.2 | 1.41 | 16.0 | 5 |
| 28** | 106-10 | $7.5 \times 10^{-5}$ | 2 | $1.8 \times 10^{-4}$ | 4.0 | 1.34 | 15.1 | 4 |
| 29** | 122 | $7.5 \times 10^{-5}$ | 2 | $1.8 \times 10^{-4}$ | 3.9 | 1.30 | 14.7 | 5 |
| 30** | 125a | $1.5 \times 10^{-5}$ | 2 | $1.8 \times 10^{-4}$ | 4.1 | 1.38 | 15.5 | 5 |
| 31** | 130c | $1.5 \times 10^{-5}$ | 2 | $1.8 \times 10^{-4}$ | 4.2 | 1.41 | 16.0 | 5 |
| 32** | 11g | $1.5 \times 10^{-5}$ | 38 | $1.8 \times 10^{-4}$ | 4.2 | 1.40 | 15.9 | 4 |
| 33** | 72y | $7.5 \times 10^{-5}$ | 38 | $1.8 \times 10^{-4}$ | 4.0 | 1.33 | 15.0 | 5 |
| 34** | 85 | $1.5 \times 10^{-5}$ | 38 | $1.8 \times 10^{-4}$ | 4.3 | 1.44 | 16.3 | 5 |
| 35** | 106-10 | $7.5 \times 10^{-5}$ | 38 | $1.8 \times 10^{-4}$ | 4.1 | 1.37 | 15.4 | 4 |
| 36** | 122 | $7.5 \times 10^{-5}$ | 38 | $1.8 \times 10^{-4}$ | 4.0 | 1.33 | 15.0 | 5 |
| 37** | 125a | $1.5 \times 10^{-5}$ | 38 | $1.8 \times 10^{-4}$ | 4.2 | 1.40 | 15.9 | 5 |
| 38** | 130c | $1.5 \times 10^{-5}$ | 38 | $1.8 \times 10^{-4}$ | 4.3 | 1.44 | 16.3 | 5 |
| 39** | 11g | $1.5 \times 10^{-5}$ | 57 | $1.8 \times 10^{-4}$ | 4.0 | 1.35 | 15.3 | 4 |
| 40** | 72y | $7.5 \times 10^{-5}$ | 57 | $1.8 \times 10^{-4}$ | 3.8 | 1.28 | 14.5 | 5 |
| 41** | 85 | $1.5 \times 10^{-5}$ | 57 | $1.8 \times 10^{-4}$ | 4.1 | 1.39 | 15.7 | 5 |
| 42** | 106-10 | $7.5 \times 10^{-5}$ | 57 | $1.8 \times 10^{-4}$ | 3.9 | 1.32 | 14.9 | 4 |
| 43** | 122 | $7.5 \times 10^{-5}$ | 57 | $1.8 \times 10^{-4}$ | 3.8 | 1.28 | 14.5 | 5 |
| 44** | 125a | $1.5 \times 10^{-5}$ | 57 | $1.8 \times 10^{-4}$ | 4.0 | 1.35 | 15.3 | 5 |
| 45** | 130c | $1.5 \times 10^{-5}$ | 57 | $1.8 \times 10^{-4}$ | 4.1 | 1.39 | 15.7 | 5 |
| 46** | 11g | $1.5 \times 10^{-5}$ | 46 | $1.8 \times 10^{-4}$ | 4.3 | 1.43 | 16.1 | 4 |
| 47** | 72y | $7.5 \times 10^{-5}$ | 46 | $1.8 \times 10^{-4}$ | 4.0 | 1.35 | 15.3 | 5 |
| 48** | 85 | $1.5 \times 10^{-5}$ | 46 | $1.8 \times 10^{-4}$ | 4.4 | 1.47 | 16.6 | 5 |
| 49** | 106-10 | $7.5 \times 10^{-5}$ | 46 | $1.8 \times 10^{-4}$ | 4.1 | 1.39 | 15.7 | 4 |
| 50** | 122 | $7.5 \times 10^{-5}$ | 46 | $1.8 \times 10^{-4}$ | 4.0 | 1.35 | 15.3 | 5 |
| 51** | 125a | $1.5 \times 10^{-5}$ | 46 | $1.8 \times 10^{-4}$ | 4.3 | 1.43 | 16.1 | 5 |
| 52** | 130c | $1.5 \times 10^{-5}$ | 46 | $1.8 \times 10^{-4}$ | 4.4 | 1.47 | 16.6 | 5 |
| 53** | 11g | $1.5 \times 10^{-5}$ | 47 | $1.8 \times 10^{-4}$ | 4.4 | 1.48 | 16.7 | 5 |
| 54** | 72y | $7.5 \times 10^{-5}$ | 47 | $1.8 \times 10^{-4}$ | 4.2 | 1.40 | 15.8 | 5 |
| 55** | 85 | $1.5 \times 10^{-5}$ | 47 | $1.8 \times 10^{-4}$ | 4.5 | 1.52 | 17.2 | 5 |
| 56** | 106-10 | $7.5 \times 10^{-5}$ | 47 | $1.8 \times 10^{-4}$ | 4.3 | 1.44 | 16.2 | 4 |
| 57** | 122 | $7.5 \times 10^{-5}$ | 47 | $1.8 \times 10^{-4}$ | 4.2 | 1.40 | 15.8 | 5 |
| 58** | 125a | $1.5 \times 10^{-5}$ | 47 | $1.8 \times 10^{-4}$ | 4.4 | 1.48 | 16.7 | 5 |
| 59** | 130c | $1.5 \times 10^{-5}$ | 47 | $1.8 \times 10^{-4}$ | 4.5 | 1.52 | 17.2 | 5 |
| 60** | 11g | $1.5 \times 10^{-5}$ | 51 | $1.8 \times 10^{-4}$ | 4.3 | 1.44 | 16.2 | 4 |
| 61** | 72y | $7.5 \times 10^{-5}$ | 51 | $1.8 \times 10^{-4}$ | 4.0 | 1.36 | 15.4 | 5 |
| 62** | 85 | $1.5 \times 10^{-5}$ | 51 | $1.8 \times 10^{-4}$ | 4.4 | 1.48 | 16.7 | 5 |
| 63** | 106-10 | $7.5 \times 10^{-5}$ | 51 | $1.8 \times 10^{-4}$ | 4.2 | 1.40 | 15.8 | 4 |
| 64** | 122 | $7.5 \times 10^{-5}$ | 51 | $1.8 \times 10^{-4}$ | 4.0 | 1.36 | 15.4 | 5 |
| 65** | 125a | $1.5 \times 10^{-5}$ | 51 | $1.8 \times 10^{-4}$ | 4.3 | 1.44 | 16.2 | 5 |
| 66** | 130c | $1.5 \times 10^{-5}$ | 51 | $1.8 \times 10^{-4}$ | 4.4 | 1.48 | 16.7 | 5 |
| 67** | 11g | $1.5 \times 10^{-5}$ | 55 | $1.8 \times 10^{-4}$ | 4.3 | 1.45 | 16.4 | 5 |
| 68** | 72y | $7.5 \times 10^{-5}$ | 55 | $1.8 \times 10^{-4}$ | 4.1 | 1.37 | 15.5 | 5 |
| 69** | 85 | $1.5 \times 10^{-5}$ | 55 | $1.8 \times 10^{-4}$ | 4.4 | 1.49 | 16.8 | 5 |
| 70** | 106-10 | $7.5 \times 10^{-5}$ | 55 | $1.8 \times 10^{-4}$ | 4.2 | 1.41 | 15.9 | 4 |
| 71** | 122 | $7.5 \times 10^{-5}$ | 55 | $1.8 \times 10^{-4}$ | 4.1 | 1.37 | 15.5 | 5 |
| 72** | 125a | $1.5 \times 10^{-5}$ | 55 | $1.8 \times 10^{-4}$ | 4.3 | 1.45 | 16.4 | 5 |
| 73** | 130c | $1.5 \times 10^{-5}$ | 55 | $1.8 \times 10^{-4}$ | 4.4 | 1.49 | 16.8 | 5 |
| 74** | 11g | $1.5 \times 10^{-5}$ | 64 | $1.8 \times 10^{-4}$ | 4.2 | 1.40 | 15.9 | 4 |

TABLE 35-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 75** | 72y | $7.5 \times 10^{-5}$ | 64 | $1.8 \times 10^{-4}$ | 4.0 | 1.33 | 15.0 | 5 |
| 76** | 85 | $1.5 \times 10^{-5}$ | 64 | $1.8 \times 10^{-4}$ | 4.3 | 1.44 | 16.3 | 5 |
| 77** | 106-10 | $7.5 \times 10^{-5}$ | 64 | $1.8 \times 10^{-4}$ | 4.1 | 1.37 | 15.4 | 4 |
| 78** | 122 | $7.5 \times 10^{-5}$ | 64 | $1.8 \times 10^{-4}$ | 4.0 | 1.33 | 15.0 | 5 |
| 79** | 125a | $1.5 \times 10^{-5}$ | 64 | $1.8 \times 10^{-4}$ | 4.2 | 1.40 | 15.9 | 5 |
| 80** | 130c | $1.5 \times 10^{-5}$ | 64 | $1.8 \times 10^{-4}$ | 4.3 | 1.44 | 16.3 | 5 |

*comparison
**invention

VC-6

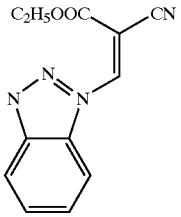

It is evident from Table 35 that using compounds of formulae (1) to (14) according to the invention, thermographic recording elements satisfying all the requirements of high Dmax, high contrast, and minimal black pepper are obtained.

Example 7

Silver Halide Emulsion C

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, an aqueous solution containing $8\times10^{-6}$ mol/liter of $K_3[IrCl_6]$ and 1 mol/liter of potassium bromide was added over 30 minutes by the controlled double jet method while maintaining the solution at pAg 7.7. The emulsion was adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains C were heated at 60° C., to which $8.5\times10^{-5}$ mol of sodium thiosulfate, $1.1\times10^{-5}$ mol of 2,3,4,5,6-pentafluorophenyldiphenylsulfin selenide, $2\times10^{-6}$ mol of Tellurium Compound 1, $3.3\times10^{-6}$ mol of chloroauric acid, and $2.3\times10^{-4}$ mol of thiocyanic acid were added per mol of silver. The emulsion was ripened for 120 minutes and then quenched to 50° C. With stirring, $8\times10^{-4}$ mol of Sensitizing Dye G was added, and $3.5\times10^{-2}$ mol of potassium iodide was added to the emulsion, which was stirred for 30 minutes and then quenched to 30° C., completing the preparation of a silver halide emulsion C.

Sensitizing Dye G

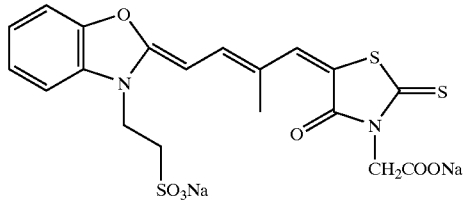

Tellurium Compound 1

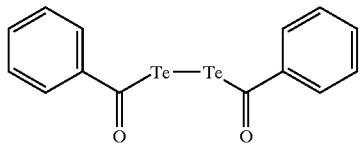

Organic Acid Silver Microcrystalline Dispersion

A mixture of 40 grams of behenic acid, 7.3 grams of stearic acid, and 500 ml of distilled water was stirred at 90° C. for 15 minutes. With vigorous stirring, 187 ml of 1N NaOH aqueous solution was added over 15 minutes, 61 ml of 1N nitric acid was added, and the solution was cooled to 50° C. Then, 124 ml of an aqueous solution of 1N silver nitrate was added and stirring was continued for 30 minutes. Thereafter, the solids were separated by suction filtration and washed with water until the water filtrate reached a conductivity of 30 μS/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼G Sand Grinder Mill by Imex K.K.) was operated for 5 hours for dispersion, completing the preparation of a microcrystalline dispersion of organic acid silver grains having a volume weighed mean grain diameter of 1.5 μm as measured by Master Sizer X (Malvern Instruments Ltd.).

Solid Particle Dispersions of Chemical Addenda

Solid particle dispersions of tetrachlorophthalic acid (C-7), 4-methylphthalic acid (C-8), 1,1-bis(2-hydroxy-3,5-dimethylphenyl)-3,5,5-trimethylhexane (C-5), phthalazine (C-6), and tribromomethylsulfonylbenzene (C-14) were prepared.

To tetrachlorophthalic acid were added 0.81 gram of hydroxypropyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Emulsion Layer Coating Solution

An emulsion layer coating solution was prepared by adding the following compositions to the organic acid silver microparticulate dispersion prepared above.

| | |
|---|---|
| Organic acid silver particle dispersion | 1 mol |
| Silver halide emulsion C | 0.05 mol |
| Binder: LACSTAR 3307B SBR latex | 430 g |
| Addenda for development: | 5 g |
| Tetrachlorophthalic acid | |
| 1,1-bis(2-hydroxy-3,5-dimethylphenyl)-3,5,5-trimethylhexane | 98 g |
| Phthalazine | 9.2 g |
| Tribromomethylphenylsulfone | 12 g |
| 4-methylphthalic acid | 7 g |

Hydrazine derivative (see Table 36)

Inventive compound (see Table 36)

Comparative compound (see Table 36)

Note that the type and amount of hydrazine derivative, inventive compound and comparative compound added are shown in Table 36, the amount being expressed by mol per mol of silver.

Emulsion Surface Protective Layer Coating Solution

An emulsion surface protective layer coating solution was prepared by adding 0.26 gram of Surfactant A, 0.09 gram of Surfactant B, 0.9 gram of silica microparticulates having a mean particle size of 2.5 μm, 0.3 gram of 1,2-bis(vinylsulfonylacetamide)ethane and 64 grams of water to 10 grams of inert gelatin.

Surfactant A

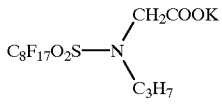

Surfactant B

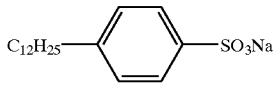

Coated Sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff B in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 1.6 g/m$^2$ of silver, and the emulsion layer protective layer coating solution was then coated on the emulsion layer so as to give a gelatin coverage of 1.8 g/m$^2$, obtaining a coated sample.

Photographic Property Test

The samples were examined as in Example 1.

Black Pepper Test

The samples were rated as in Example 1.

The results are shown in Table 36.

TABLE 36

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 1* | — | — | — | — | 2.6 | 0.80 | — | 5 |
| 2* | 11g | $2.5 \times 10^{-4}$ | — | — | 3.7 | 1.15 | 10.7 | 2 |
| 3* | 72y | $5.0 \times 10^{-4}$ | — | — | 3.5 | 1.09 | 10.1 | 3 |
| 4* | 85 | $2.5 \times 10^{-4}$ | — | — | 3.8 | 1.18 | 11.0 | 3 |
| 5* | 106-10 | $5.0 \times 10^{-4}$ | — | — | 3.6 | 1.12 | 10.4 | 2 |
| 6* | 122 | $5.0 \times 10^{-4}$ | — | — | 3.5 | 1.09 | 10.1 | 3 |
| 7* | 125a | $2.5 \times 10^{-4}$ | — | — | 3.7 | 1.15 | 10.7 | 2 |
| 8* | 130c | $2.5 \times 10^{-4}$ | — | — | 3.8 | 1.18 | 11.0 | 2 |
| 9* | — | — | VC-5 | $7.5 \times 10^{-3}$ | 3.4 | 1.05 | 9.8 | 3 |
| 10** | — | — | 2 | $7.5 \times 10^{-3}$ | 4.0 | 1.33 | 12.9 | 4 |
| 11** | — | — | 38 | $7.5 \times 10^{-3}$ | 4.1 | 1.38 | 13.0 | 4 |

TABLE 36-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 12** | — | — | 57 | $7.5 \times 10^{-3}$ | 4.1 | 1.32 | 12.5 | 5 |
| 13** | — | — | 46 | $7.5 \times 10^{-3}$ | 4.2 | 1.40 | 13.0 | 4 |
| 14** | — | — | 47 | $7.5 \times 10^{-3}$ | 4.5 | 1.41 | 13.8 | 5 |
| 15** | — | — | 51 | $7.5 \times 10^{-3}$ | 4.5 | 1.48 | 13.9 | 5 |
| 16** | — | — | 55 | $7.5 \times 10^{-3}$ | 4.3 | 1.39 | 12.4 | 4 |
| 17** | — | — | 64 | $7.5 \times 10^{-3}$ | 4.0 | 1.37 | 13.0 | 4 |
| 18* | 11g | $2.5 \times 10^{-4}$ | VC-5 | $3.6 \times 10^{-4}$ | 3.8 | 1.18 | 11.0 | 3 |
| 19* | 72y | $5.0 \times 10^{-4}$ | VC-5 | $3.6 \times 10^{-4}$ | 3.6 | 1.12 | 10.4 | 3 |
| 20* | 85 | $2.5 \times 10^{-4}$ | VC-5 | $3.6 \times 10^{-4}$ | 3.9 | 1.21 | 11.3 | 3 |
| 21* | 106-10 | $5.0 \times 10^{-4}$ | VC-5 | $3.6 \times 10^{-4}$ | 3.7 | 1.15 | 10.7 | 3 |
| 22* | 122 | $5.0 \times 10^{-4}$ | VC-5 | $3.6 \times 10^{-4}$ | 3.6 | 1.12 | 10.4 | 3 |
| 23* | 125a | $2.5 \times 10^{-4}$ | VC-5 | $3.6 \times 10^{-4}$ | 3.8 | 1.18 | 11.0 | 3 |
| 24* | 130c | $2.5 \times 10^{-4}$ | VC-5 | $3.6 \times 10^{-4}$ | 3.9 | 1.21 | 11.3 | 3 |
| 25** | 11g | $2.5 \times 10^{-4}$ | 2 | $3.6 \times 10^{-4}$ | 4.2 | 1.39 | 12.9 | 4 |
| 26** | 72y | $5.0 \times 10^{-4}$ | 2 | $3.6 \times 10^{-4}$ | 3.9 | 1.32 | 12.2 | 5 |
| 27** | 85 | $2.5 \times 10^{-4}$ | 2 | $3.6 \times 10^{-4}$ | 4.3 | 1.43 | 13.3 | 5 |
| 28** | 106-10 | $5.0 \times 10^{-4}$ | 2 | $3.6 \times 10^{-4}$ | 4.0 | 1.35 | 12.6 | 4 |
| 29** | 122 | $5.0 \times 10^{-4}$ | 2 | $3.6 \times 10^{-4}$ | 3.9 | 1.32 | 12.2 | 5 |
| 30** | 125a | $2.5 \times 10^{-4}$ | 2 | $3.6 \times 10^{-4}$ | 4.2 | 1.39 | 12.9 | 5 |
| 31** | 130c | $2.5 \times 10^{-4}$ | 2 | $3.6 \times 10^{-4}$ | 4.3 | 1.43 | 13.3 | 5 |
| 32** | 11g | $2.5 \times 10^{-4}$ | 38 | $3.6 \times 10^{-4}$ | 4.2 | 1.42 | 13.2 | 4 |
| 33** | 72y | $5.0 \times 10^{-4}$ | 38 | $3.6 \times 10^{-4}$ | 4.0 | 1.34 | 12.5 | 5 |
| 34** | 85 | $2.5 \times 10^{-4}$ | 38 | $3.6 \times 10^{-4}$ | 4.4 | 1.46 | 13.6 | 5 |
| 35** | 106-10 | $5.0 \times 10^{-4}$ | 38 | $3.6 \times 10^{-4}$ | 4.1 | 1.38 | 12.8 | 4 |
| 36** | 122 | $5.0 \times 10^{-4}$ | 38 | $3.6 \times 10^{-4}$ | 4.0 | 1.34 | 12.5 | 5 |
| 37** | 125a | $2.5 \times 10^{-4}$ | 38 | $3.6 \times 10^{-4}$ | 4.2 | 1.42 | 13.2 | 5 |
| 38** | 130c | $2.5 \times 10^{-4}$ | 38 | $3.6 \times 10^{-4}$ | 4.4 | 1.46 | 13.6 | 5 |
| 39** | 11g | $2.5 \times 10^{-4}$ | 57 | $3.6 \times 10^{-4}$ | 4.1 | 1.37 | 12.7 | 4 |
| 40** | 72y | $5.0 \times 10^{-4}$ | 57 | $3.6 \times 10^{-4}$ | 3.9 | 1.29 | 12.0 | 5 |
| 41** | 85 | $2.5 \times 10^{-4}$ | 57 | $3.6 \times 10^{-4}$ | 4.2 | 1.41 | 13.1 | 5 |
| 42** | 106-10 | $5.0 \times 10^{-4}$ | 57 | $3.6 \times 10^{-4}$ | 4.0 | 1.33 | 12.4 | 4 |
| 43** | 122 | $5.0 \times 10^{-4}$ | 57 | $3.6 \times 10^{-4}$ | 3.9 | 1.29 | 12.0 | 5 |
| 44** | 125a | $2.5 \times 10^{-4}$ | 57 | $3.6 \times 10^{-4}$ | 4.1 | 1.37 | 12.7 | 5 |
| 45** | 130c | $2.5 \times 10^{-4}$ | 57 | $3.6 \times 10^{-4}$ | 4.2 | 1.41 | 13.1 | 5 |
| 46** | 11g | $2.5 \times 10^{-4}$ | 46 | $3.6 \times 10^{-4}$ | 4.3 | 1.45 | 13.4 | 4 |
| 47** | 72y | $5.0 \times 10^{-4}$ | 46 | $3.6 \times 10^{-4}$ | 4.1 | 1.37 | 12.7 | 5 |
| 48** | 85 | $2.5 \times 10^{-4}$ | 46 | $3.6 \times 10^{-4}$ | 4.4 | 1.48 | 13.8 | 5 |
| 49** | 106-10 | $5.0 \times 10^{-4}$ | 46 | $3.6 \times 10^{-4}$ | 4.2 | 1.41 | 13.1 | 4 |
| 50** | 122 | $5.0 \times 10^{-4}$ | 46 | $3.6 \times 10^{-4}$ | 4.1 | 1.37 | 12.7 | 5 |
| 51** | 125a | $2.5 \times 10^{-4}$ | 46 | $3.6 \times 10^{-4}$ | 4.3 | 1.45 | 13.4 | 5 |
| 52** | 130c | $2.5 \times 10^{-4}$ | 46 | $3.6 \times 10^{-4}$ | 4.4 | 1.48 | 13.8 | 5 |
| 53** | 11g | $2.5 \times 10^{-4}$ | 47 | $3.6 \times 10^{-4}$ | 4.5 | 1.50 | 13.9 | 5 |
| 54** | 72y | $5.0 \times 10^{-4}$ | 47 | $3.6 \times 10^{-4}$ | 4.2 | 1.41 | 13.1 | 5 |
| 55** | 85 | $2.5 \times 10^{-4}$ | 47 | $3.6 \times 10^{-4}$ | 4.6 | 1.54 | 14.3 | 5 |
| 56** | 106-10 | $5.0 \times 10^{-4}$ | 47 | $3.6 \times 10^{-4}$ | 4.4 | 1.45 | 13.5 | 4 |
| 57** | 122 | $5.0 \times 10^{-4}$ | 47 | $3.6 \times 10^{-4}$ | 4.2 | 1.41 | 13.1 | 5 |
| 58** | 125a | $2.5 \times 10^{-4}$ | 47 | $3.6 \times 10^{-4}$ | 4.5 | 1.50 | 13.9 | 5 |
| 59** | 130c | $2.5 \times 10^{-4}$ | 47 | $3.6 \times 10^{-4}$ | 4.6 | 1.54 | 14.3 | 5 |
| 60** | 11g | $2.5 \times 10^{-4}$ | 51 | $3.6 \times 10^{-4}$ | 4.4 | 1.45 | 13.5 | 4 |
| 61** | 72y | $5.0 \times 10^{-4}$ | 51 | $3.6 \times 10^{-4}$ | 4.1 | 1.37 | 12.8 | 5 |
| 62** | 85 | $2.5 \times 10^{-4}$ | 51 | $3.6 \times 10^{-4}$ | 4.5 | 1.49 | 13.9 | 5 |
| 63** | 106-10 | $5.0 \times 10^{-4}$ | 51 | $3.6 \times 10^{-4}$ | 4.2 | 1.41 | 13.1 | 4 |
| 64** | 122 | $5.0 \times 10^{-4}$ | 51 | $3.6 \times 10^{-4}$ | 4.1 | 1.37 | 12.8 | 5 |
| 65** | 125a | $2.5 \times 10^{-4}$ | 51 | $3.6 \times 10^{-4}$ | 4.4 | 1.45 | 13.5 | 5 |
| 66** | 130c | $2.5 \times 10^{-4}$ | 51 | $3.6 \times 10^{-4}$ | 4.5 | 1.49 | 13.9 | 5 |
| 67** | 11g | $2.5 \times 10^{-4}$ | 55 | $3.6 \times 10^{-4}$ | 4.4 | 1.47 | 13.6 | 5 |
| 68** | 72y | $5.0 \times 10^{-4}$ | 55 | $3.6 \times 10^{-4}$ | 4.1 | 1.39 | 12.9 | 5 |
| 69** | 85 | $2.5 \times 10^{-4}$ | 55 | $3.6 \times 10^{-4}$ | 4.5 | 1.51 | 14.0 | 5 |
| 70** | 106-10 | $5.0 \times 10^{-4}$ | 55 | $3.6 \times 10^{-4}$ | 4.3 | 1.43 | 13.2 | 4 |
| 71** | 122 | $5.0 \times 10^{-4}$ | 55 | $3.6 \times 10^{-4}$ | 4.1 | 1.39 | 12.9 | 5 |
| 72** | 125a | $2.5 \times 10^{-4}$ | 55 | $3.6 \times 10^{-4}$ | 4.4 | 1.47 | 13.6 | 5 |
| 73** | 130c | $2.5 \times 10^{-4}$ | 55 | $3.6 \times 10^{-4}$ | 4.5 | 1.51 | 14.0 | 5 |
| 74** | 11g | $2.5 \times 10^{-4}$ | 64 | $3.6 \times 10^{-4}$ | 4.2 | 1.42 | 13.2 | 4 |
| 75** | 72y | $5.0 \times 10^{-4}$ | 64 | $3.6 \times 10^{-4}$ | 4.0 | 1.34 | 12.5 | 5 |
| 76** | 85 | $2.5 \times 10^{-4}$ | 64 | $3.6 \times 10^{-4}$ | 4.4 | 1.46 | 13.5 | 5 |
| 77** | 106-10 | $5.0 \times 10^{-4}$ | 64 | $3.6 \times 10^{-4}$ | 4.1 | 1.38 | 12.8 | 4 |
| 78** | 122 | $5.0 \times 10^{-4}$ | 64 | $3.6 \times 10^{-4}$ | 4.0 | 1.34 | 12.5 | 5 |

TABLE 36-continued

| | Hydrazine compound | Addition amount (mol/mol of Ag) | Substituted alkene derivative | Addition amount (mol/mol of Ag) | Dmax | S | γ | black pepper |
|---|---|---|---|---|---|---|---|---|
| 79** | 125a | $2.5 \times 10^{-4}$ | 64 | $3.6 \times 10^{-4}$ | 4.2 | 1.42 | 13.2 | 5 |
| 80** | 130c | $2.5 \times 10^{-4}$ | 64 | $3.6 \times 10^{-4}$ | 4.4 | 1.46 | 13.5 | 5 |

*comparison
**invention
VC-5

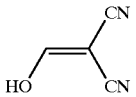

It is evident from Table 36 that using compounds of formulae (1) to (14) according to the invention, thermographic recording elements satisfying all the requirements of high Dmax, high contrast, and minimal black pepper are obtained.

There has been described a thermographic recording element featuring high Dmax, high sensitivity and satisfactory contrast and free of black pepper.

Reasonable modifications and variations are possible from the foregoing disclosure without departing from either the spirit or scope of the present invention as defined by the claims.

What is claimed is:

1. A thermographic recording element having at least one image forming layer, said element comprising an organic silver salt, a reducing agent, and at least one of substituted alkene derivatives of formula (14):

formula (14)

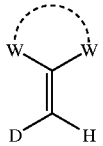

wherein W is an electron attractive group; D is an electron donative group selected from the group consisting of hydroxy groups, salts of hydroxy groups, mercapto groups, salts of mercapto groups, alkoxy groups, alkylthio groups, arylthio groups, amino groups, alkylamino groups, arylamino groups and phenyl groups having an electron donative group as a substituent; H is hydrogen; and two of said W groups form a cyclic structure which is substituted or unsubstituted and is selected from the group consisting of saturated carbocyclic, unsaturated carbocyclic, saturated heterocyclic, unsaturated heterocyclic and cyclic ketone, and wherein said W groups may have substituents.

2. The thermographic recording element of claim 1 further comprising a photosensitive silver halide.

3. The thermographic recording element of claim 1, wherein the alkene derivative has one of the following structures:

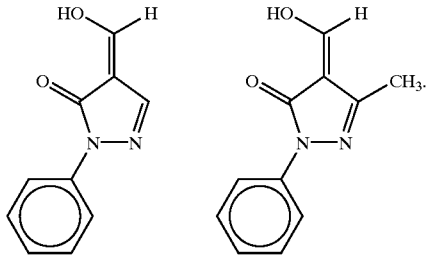

4. The thermographic recording element of claim 1, wherein the alkene derivative has the following structure:

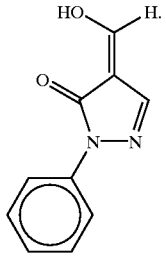

5. The thermographic recording element of claim 1, wherein the alkene derivative has one of the following structures:

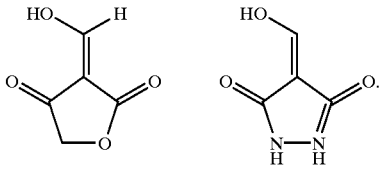

6. The thermographic recording element of claim 1, wherein W is at least one electron attractive group selected from the group consisting of substituted or uhsubstituted cyano, nitro, alkenyl, acyl, alkoxycarbonyl, aryloxycarbonyl, alkylsulfonyl, arylsulfonyl, carbamoyl, sulfamoyl, phosphoryl, 5- and 6-membered heterocyclic group which may have a benzene or naphthalene ring fused thereto, and phenyl having at least one of said electron attractive group as a substituent.

7. A thermographic recording element having at least one image forming layer, said element comprising an organic silver salt, a reducing agent, and at least one of substituted alkene derivatives of formula (14):

formula (14)

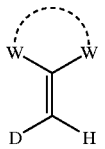

wherein W is an electron attractive group; D is an electron donative group selected from the group consisting of hydroxy groups, salts of hydroxy groups, mercapto groups, salts of mercapto groups, alkoxy groups, alkylthio groups, arylthio groups, amino groups, alkylamino groups, arylamino groups and phenyl groups having an electron donative group as a substituent; H is hydrogen; and two of said W groups form a cyclic structure which is substituted or unsubstituted and is selected from the group consisting of saturated carbocyclic, unsaturated carbocyclic, saturated heterocyclic, unsaturated heterocyclic and cyclic ketone, and wherein said W groups may have substituents; and a hydrazine derivative of the formula (I):

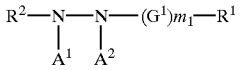

wherein $R^2$ is an aliphatic, aromatic or heterocyclic group, $R^1$ and $R^3$ are independently hydrogen, aliphatic group, aromatic group, heterocyclic group, hydrazino group, alkoxy group, aryloxy group, or amino group, $G^1$ is —CO—, —COCO—, —C(=S)—, $SO_2$—, —SO—, —PO($R^3$)— or iminomethylene group, $A^1$ and $A^2$ are independently hydrogen, alkylsulfonyl, arylsulfonyl or acyl groups, at least one of $A^1$ and $A^2$ is hydrogen, and letter $m_1$ is equal to 0 or 1, with the proviso that $R^1$ is an aliphatic, aromatic or heterocyclic group when m1 is 0.

8. The thermographic recording element of claim 7, wherein W is at least one electron attractive group selected from the group consisting of substituted or unsubstituted cyano, nitro, alkenyl, acyl, alkoxycarbonyl, aryloxycarbonyl, alkylsulfonyl, arylsulfonyl, carbamoyl, sulfamoyl, phosphoryl, 5- and 6-membered heterocyclic group which may have a benzene or naphthalene ring fused thereto, and phenyl having at least one of said electron attractive group as a substituent.

* * * * *